US007731104B2

(12) United States Patent
Peterson et al.

(10) Patent No.: US 7,731,104 B2
(45) **Date of Patent: *Jun. 8, 2010**

(54) TEXTURE SPRAYER

(75) Inventors: Craig Peterson, Carver, MN (US); Anthony J. Torntore, Bloomington, MN (US); Ross Rossner, St. Michael, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 713 days.

This patent is subject to a terminal disclaimer.

(21) Appl. No.: 11/411,644

(22) Filed: Apr. 26, 2006

(65) Prior Publication Data

US 2007/0252019 A1 Nov. 1, 2007

(51) Int. Cl.
*B05B 15/06* (2006.01)

(52) U.S. Cl. ..... 239/279; 239/153; 239/345; 239/379; 239/332; 239/268; 239/529; 222/175; 222/333

(58) Field of Classification Search ..... 239/153, 239/154, 332, 345, 268, 379, 529; 222/333
See application file for complete search history.

(56) References Cited

U.S. PATENT DOCUMENTS

| | | | | |
|---|---|---|---|---|
| 1,792,803 | A * | 2/1931 | Brandt | 239/308 |
| 1,881,570 | A * | 10/1932 | Hermann | 239/290 |
| 2,707,068 | A * | 4/1955 | Williamson | 222/175 |
| 3,236,459 | A * | 2/1966 | McRitchie | 239/416 |
| 3,275,248 | A | 9/1966 | O'Brien et al. | |
| 3,486,700 | A | 12/1969 | Bristow | |
| 3,945,571 | A | 3/1976 | Rash | |
| 4,079,868 | A | 3/1978 | Moniot | |
| 4,411,387 | A | 10/1983 | Stern et al. | |
| 4,545,534 | A | 10/1985 | Schaefer | |
| 4,863,104 | A | 9/1989 | Masterson | |
| 4,961,537 | A | 10/1990 | Stern | |
| 4,978,072 | A | 12/1990 | Kurowski | |
| 5,037,011 | A | 8/1991 | Woods | |
| 5,119,993 | A | 6/1992 | Gunzel, Jr. et al. | |
| 5,139,357 | A | 8/1992 | Reents | |
| 5,188,263 | A | 2/1993 | Woods | |
| 5,190,225 | A | 3/1993 | Williams | |

(Continued)

FOREIGN PATENT DOCUMENTS

| | | |
|---|---|---|
| DE | 3416169 | 11/1985 |

(Continued)

OTHER PUBLICATIONS

Supplementary Search Report from foreign application No. GB0707861.1, dated Nov. 14, 2007, 3 pp.

(Continued)

*Primary Examiner*—Dinh Q Nguyen
(74) *Attorney, Agent, or Firm*—Faegre & Benson LLP

(57) ABSTRACT

A hand-held apparatus for spraying texture material including a body, a pressurized air source mounted on the body, a texture material hopper mounted on the body, and a texture delivery nozzle for selectively spraying texture material from the hopper onto a surface to be coated by propelling the texture material using pressurized air from the pressurized air source wherein each of the air source and the hopper can be disconnected from the body without the use of tools.

18 Claims, 73 Drawing Sheets

U.S. PATENT DOCUMENTS

| | | | | | |
|---|---|---|---|---|---|
| 5,232,161 | A | | 8/1993 | Clemmons | |
| 5,255,846 | A | | 10/1993 | Ortega | |
| 5,287,887 | A | | 2/1994 | Hengesbach et al. | |
| 5,310,095 | A | | 5/1994 | Stern et al. | |
| 5,341,970 | A | | 8/1994 | Woods | |
| 5,361,946 | A | * | 11/1994 | Ginther et al. | 222/175 |
| 5,409,148 | A | | 4/1995 | Stern et al. | |
| 5,409,166 | A | | 4/1995 | Gunzel, Jr. et al. | |
| 5,415,351 | A | | 5/1995 | Otto et al. | |
| 5,450,983 | A | | 9/1995 | Stern et al. | |
| 5,476,879 | A | | 12/1995 | Woods et al. | |
| 5,489,048 | A | | 2/1996 | Stern et al. | |
| 5,505,344 | A | | 4/1996 | Woods | |
| 5,524,798 | A | | 6/1996 | Stern et al. | |
| 5,645,198 | A | | 7/1997 | Stern et al. | |
| 5,715,975 | A | | 2/1998 | Stern et al. | |
| 5,727,736 | A | | 3/1998 | Tryon | |
| 5,775,446 | A | | 7/1998 | Lott | |
| 5,803,360 | A | | 9/1998 | Spitznagel | |
| 5,810,258 | A | | 9/1998 | Wu | |
| 5,904,434 | A | | 5/1999 | Bekius et al. | |
| 5,918,815 | A | | 7/1999 | Wu | |
| 5,921,446 | A | | 7/1999 | Stern | |
| 5,934,518 | A | | 8/1999 | Stern et al. | |
| 5,979,797 | A | | 11/1999 | Castellano | |
| 6,000,583 | A | | 12/1999 | Stern et al. | |
| 6,012,651 | A | | 1/2000 | Spitznagel | |
| 6,053,436 | A | | 4/2000 | Morford | |
| 6,070,809 | A | * | 6/2000 | Price | 239/273 |
| 6,092,740 | A | | 7/2000 | Liu | |
| 6,105,882 | A | | 8/2000 | Woltjen | |
| 6,116,473 | A | | 9/2000 | Stern et al. | |
| 6,152,335 | A | | 11/2000 | Stern et al. | |
| 6,168,093 | B1 | | 1/2001 | Greer, Jr. et al. | |
| 6,213,410 | B1 | | 4/2001 | Spitznagel | |
| 6,276,570 | B1 | | 8/2001 | Stern et al. | |
| 6,328,185 | B1 | | 12/2001 | Stern et al. | |
| 6,352,184 | B1 | | 3/2002 | Stern et al. | |
| D455,761 | S | | 4/2002 | Graber et al. | |
| 6,446,842 | B2 | | 9/2002 | Stern et al. | |
| 6,536,633 | B2 | | 3/2003 | Stern et al. | |
| 6,536,684 | B1 | | 3/2003 | Wei | |
| 6,537,760 | B1 | | 3/2003 | Bergmann et al. | |
| 6,712,292 | B1 | | 3/2004 | Gosis et al. | |
| 6,726,125 | B1 | | 4/2004 | Nonis et al. | |
| 6,845,923 | B1 | * | 1/2005 | Slotsve | 239/376 |
| 6,863,227 | B2 | | 3/2005 | Wollenberg et al. | |
| 2003/0010843 | A1 | * | 1/2003 | Liao | 239/273 |

FOREIGN PATENT DOCUMENTS

| | | | |
|---|---|---|---|
| EP | 1 486 258 | | 12/2004 |
| EP | 1511575 | A1 | 3/2005 |
| GB | 714522 | | 9/1954 |
| GB | 2 372 226 | | 8/2002 |
| WO | 03106042 | A1 | 12/2003 |

OTHER PUBLICATIONS

UK Intellectual Property Office Search Report dated Jul. 26, 2007.

Product Information, "Compressor Care on the Web-Paint Spraying Sandblast Blowguns," http://www.compressor-care.com, 2 pp.

Instruction-Parts List for Texture Spray Gun, Graco Inc., 2 pp., 1998.

Product Information, "Cleaning/Paint Supplies—Homax Pneumatic II Spray Texture Gun (4610)," Ace Hardware, http://www.acehardware.com, 1 pg., 2005.

Product Information, "Painting—Air Texture Gun Sprays Liquid Drywall Materials," Northern Tool + Equipment, http://www.northerntool.com, 2 pp.

Product Information—"Discount Air Texture Spray Gun," Front Range Tool Warehouse, http://www.dropshipdiscounttools.com, 1 pp.

Product Information, "Graco Professional Hopper Gun," O-Gee Paint Co., http://www.o-geepaint.com, 2 pp.

English Translation of Office Action for Chinese App 200710138501.6, 5 pages, issued on Jun. 12, 2009.

* cited by examiner

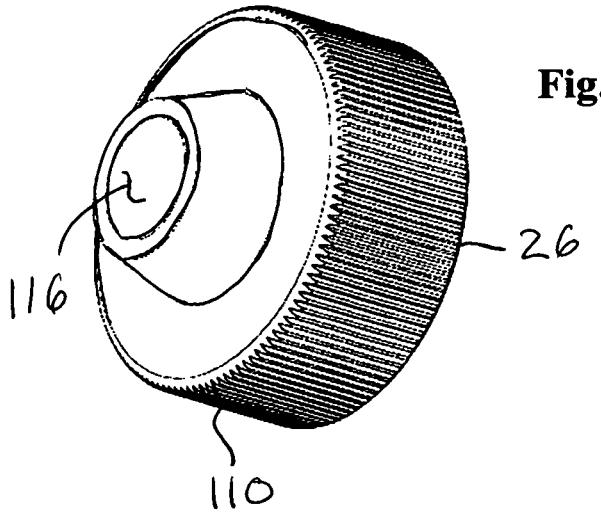
Fig. 11
Fig. 12
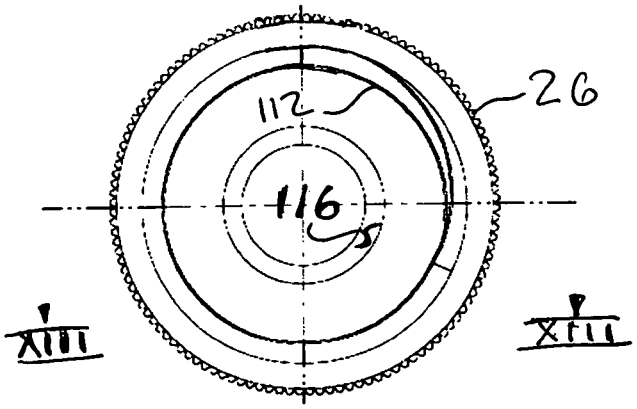
Fig. 13
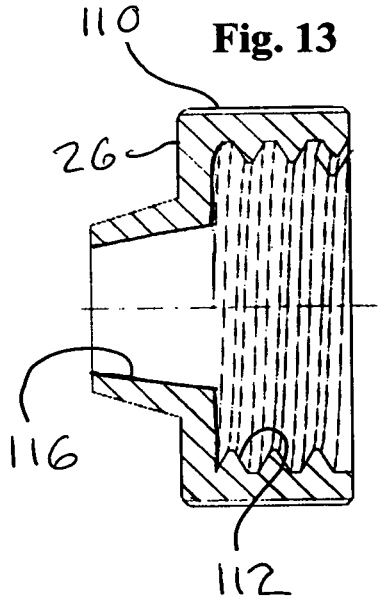

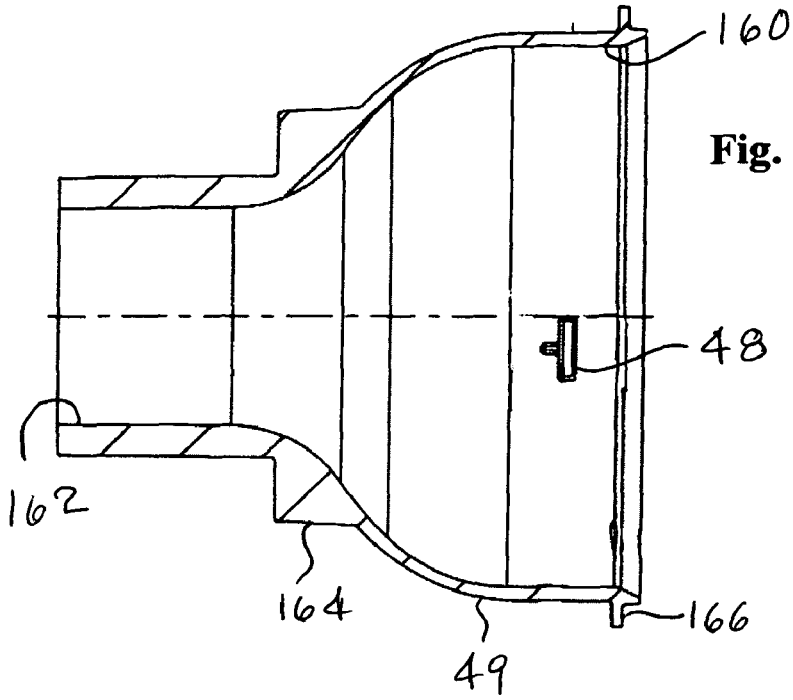
Fig. 48
Fig. 49
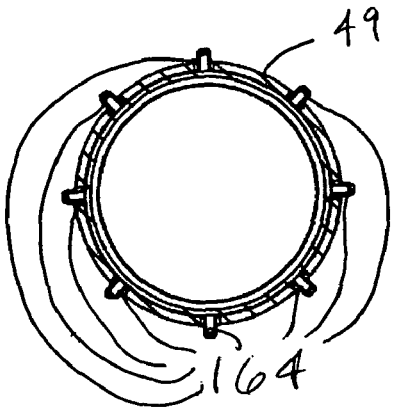
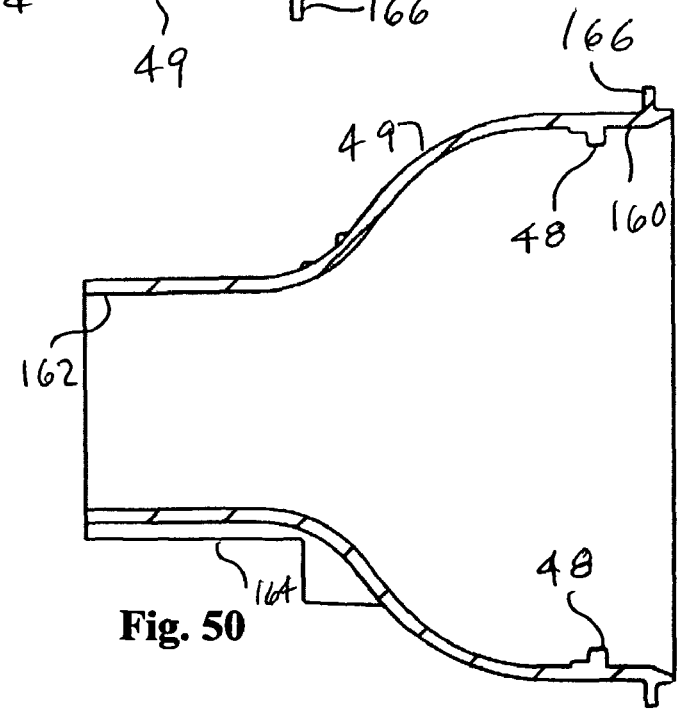
Fig. 50

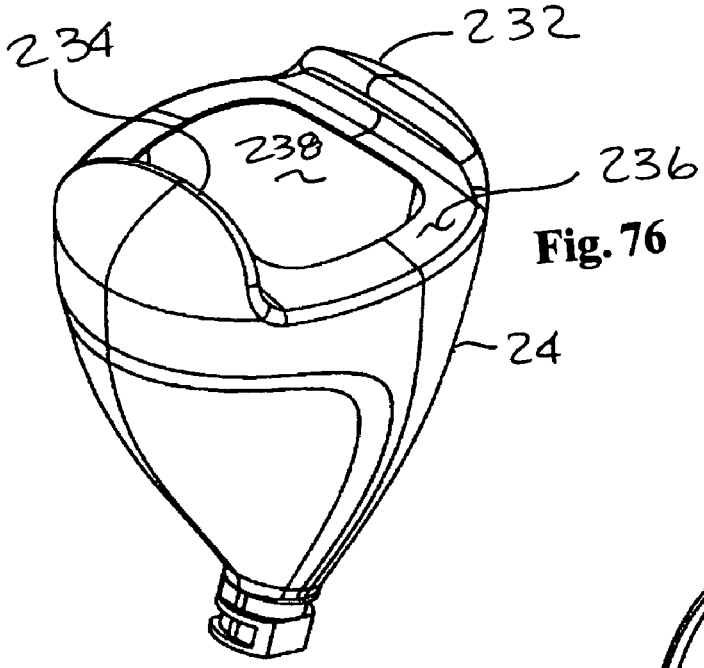
Fig. 76
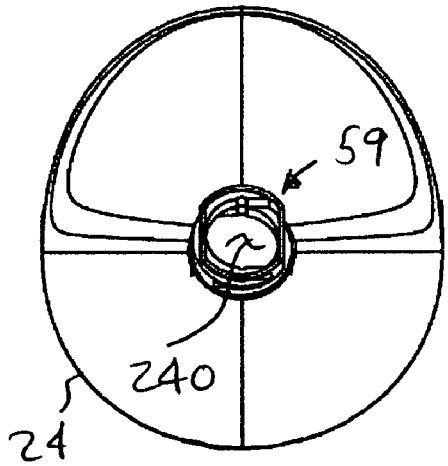
Fig. 77
Fig. 78
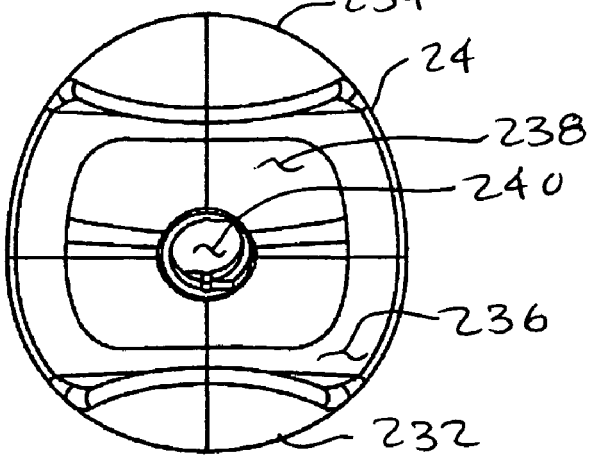

232
236
234
24
LXXXV 234
236
24

232
24
LXXXVI

TEXTURE SPRAYER

BACKGROUND OF THE INVENTION

This invention relates to the field of texture sprayers used to apply a texture coating to ceilings and the like. In the past, texture sprayers were in the form of either a hand-held pressurized can of material (for patching existing ceilings) or a relatively large floor-based pump with a hand held spray gun connected to the pump via one or more hoses, with a material hopper either on the pump or the gun. Typically floor-based units had a source of pressurized air remote from the gun, while the pressurized cans contained both the texture material and a pressurized gas to deliver it. As is readily apparent, the floor-based units were large and expensive, and while suitable for commercial use, such units were not attractive to consumers for those reasons. The pressurized cans were not suitable for anything other than patching existing textured surfaces, since such pressurize cans have very limited capacity, e.g. with time to total discharge measured in seconds and thus such units were not attractive to consumers desiring to apply texture to a substantial area.

BRIEF SUMMARY OF THE INVENTION

The present invention is a texture sprayer in the form of a completely self-contained, entirely hand-held unit that includes a hopper, spray gun, and blower to propel the material toward the surface to be coated.

In one aspect, the present invention includes a hand-held apparatus for spraying texture material having a body; a pressurized air source mounted on the body; a texture material hopper mounted on the body; and a texture delivery nozzle extending from the body for selectively spraying texture material from the hopper through a texture material passageway to a surface to be coated by propelling the texture material using pressurized air from the pressurized air source.

The invention may also include an air source connection structure between the pressurized air source and the body wherein the air source connection structure is operable to connect and disconnect the pressurized air source to and from the body without the use of tools, and may be in the form of a bayonet interlock between the pressurized air source and the body. In another aspect, the invention may further include a material connection structure between the texture material hopper and the body wherein the material connection structure is operable to connect and disconnect the texture material hopper to and from the body without the use of tools.

The hopper may be a generally cone-shaped structure having a conic axis and the material connection may be a rotatable connector having an axis of rotation to allow positioning of the conic axis of the cone-shaped structure at a location in a cone-shaped path such that the hopper may be rotated to a first position wherein the conic axis is directed generally vertically with the body and nozzle directed in a horizontal direction, and (alternatively) to a second position wherein the conic axis generally vertically when the body and nozzle are directed upward above the horizontal direction. The body may include a trigger selectively operable to open and close a texture material passageway between the texture material hopper and the texture delivery nozzle, and may further include a spring urging the trigger to close the texture material passageway. The body may have an air passageway between the pressurized air source and the texture delivery nozzle.

The present invention may also include a pistol grip and an arm rest for supporting the apparatus on a user's forearm when the pistol grip is grasped by the user, and the arm rest may include a pair of legs, such that the pistol grip and pair of legs provide a three point support for the apparatus when placed on a horizontal surface.

In another aspect, the texture delivery nozzle may include a frusto-conical sleeve having a nozzle cone axis defining a spray path axis and wherein the sleeve is movable along the nozzle cone axis to open and close the texture material passageway. The frusto-conical sleeve may have an elastomeric boot surrounding the sleeve adjacent at least a portion of the texture material passageway. The invention may also include a nozzle threaded on a forward part of the texture sprayer.

In another aspect, the present invention may be characterized as a method of cleaning a texture sprayer apparatus including the steps of manually disconnecting an electrically powered air source subassembly from a wetted parts subassembly of the texture sprayer without the use of tools; cleaning the wetted parts subassembly; and manually reassembling the electrically powered air source subassembly to the wetted parts subassembly without the use of tools. The method may further include manually disconnecting the hopper from the remainder of the wetted parts subassembly without the use of tools. The method may also include manually reconnecting the hopper to the remainder of the wetted parts subassembly without the use of tools after cleaning.

BRIEF DESCRIPTION OF THE SEVERAL VIEWS OF THE DRAWINGS

FIG. 11 is a perspective view of a nozzle useful in the practice of the present invention.

FIG. 12 is a front elevation view of the nozzle of FIG. 11.

FIG. 13 is a section view taken along line XIII-XIII of FIG. 12.

FIG. 48 is a section view taken along line XLVIII-XLVIII of FIG. 45.

FIG. 49 is a section view taken along line XLIX-XLIX of FIG. 45.

FIG. 50 is a section view taken along line L-L of FIG. 46.

FIG. 76 is a perspective view of the hopper useful in the practice of the present invention.

FIG. 77 is a bottom plan view of the hopper of FIG. 76.

FIG. 78 is a top plan view of the hopper of FIG. 76.

DETAILED DESCRIPTION OF THE INVENTION

Figure 1:
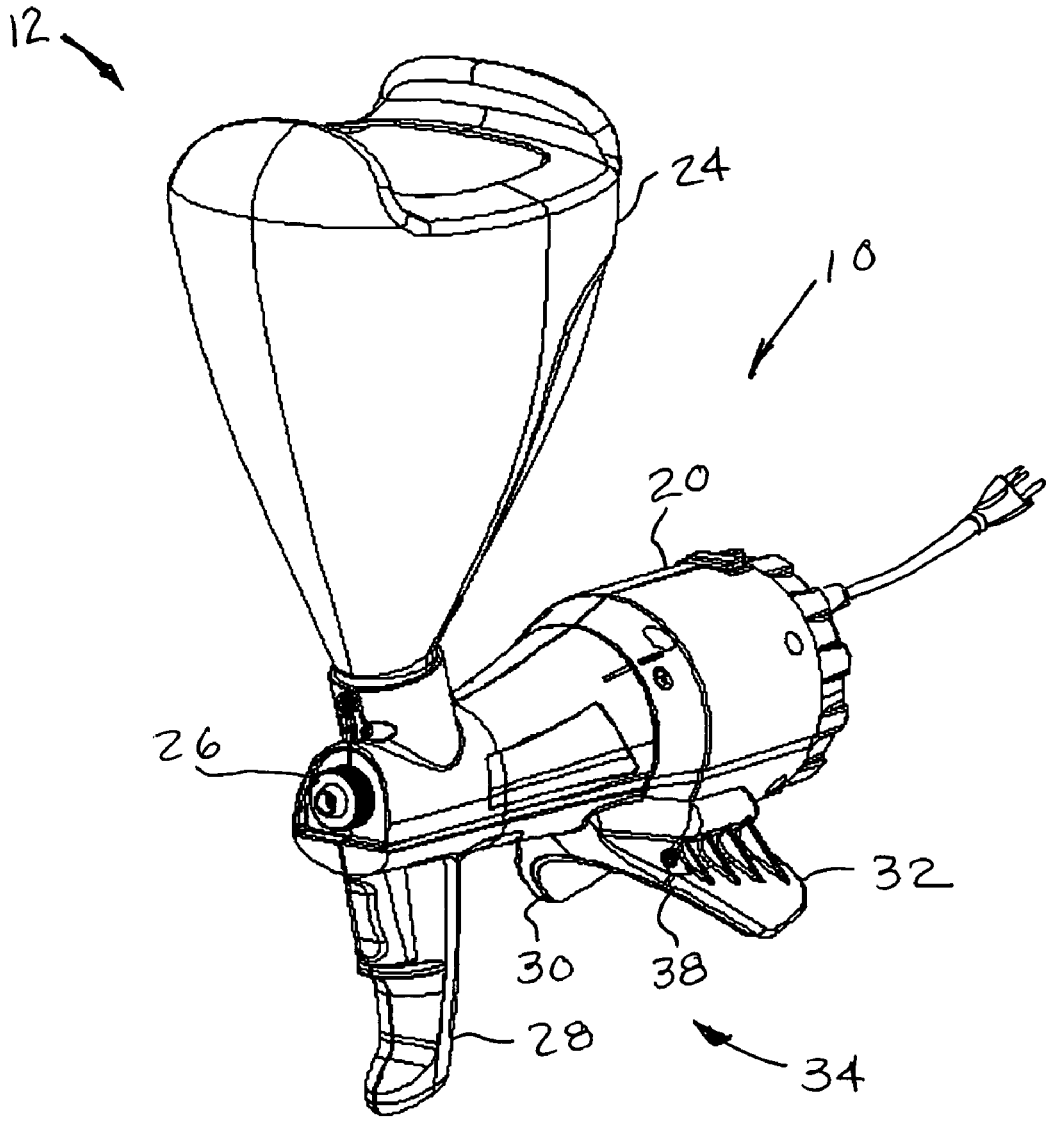
FIG. 1 is a perspective view of a first embodiment of a hand-held apparatus for spraying texture material.

Referring now to the drawings, and most particularly to FIGS. 1, 5, 6, 7 et seq. a first embodiment 10 of a texture sprayer 12 useful to carry out the present invention may be seen. A second embodiment 14 of the texture sprayer 12 may be seen in FIGS. 2, 3, and 4, with the difference between the first and second embodiments being that the second embodiment 14 has a larger diameter rearwardly located air source 16 and has a stirrup shaped handle 18 to assist a user in removal of the air source 20. The first embodiment 10 has a smaller diameter air source 20 and thus permits grasping the air source 20 directly for removal and installation. It is to be understood that the construction, use, operation and remaining features of the first and second embodiments 10 and 14 are essentially the same; because of this only the first embodiment 10 will be described in detail.

Figure 2:
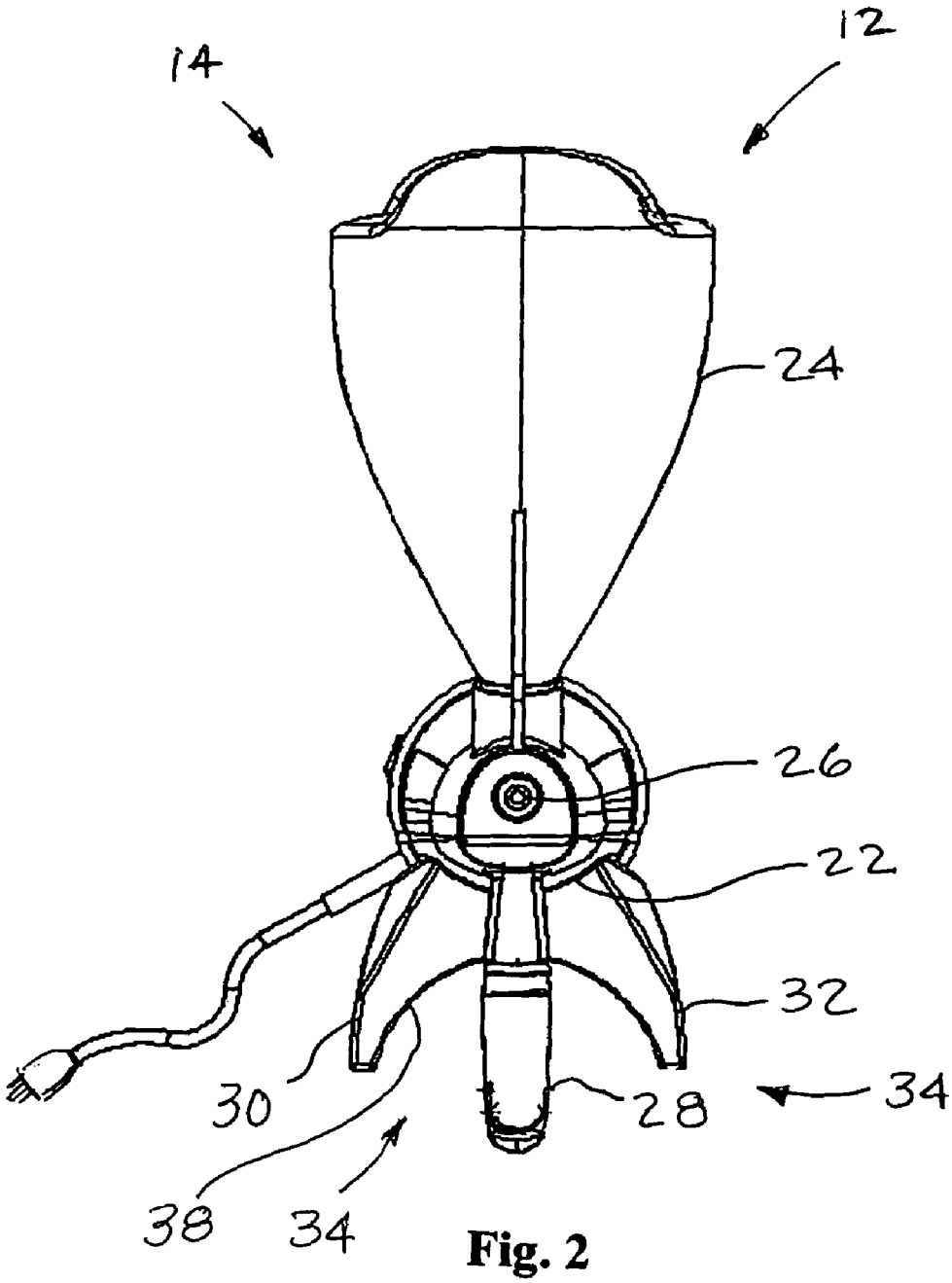
FIG. 2 is a front elevation view of the apparatus of FIG. 1.
Figure 3:
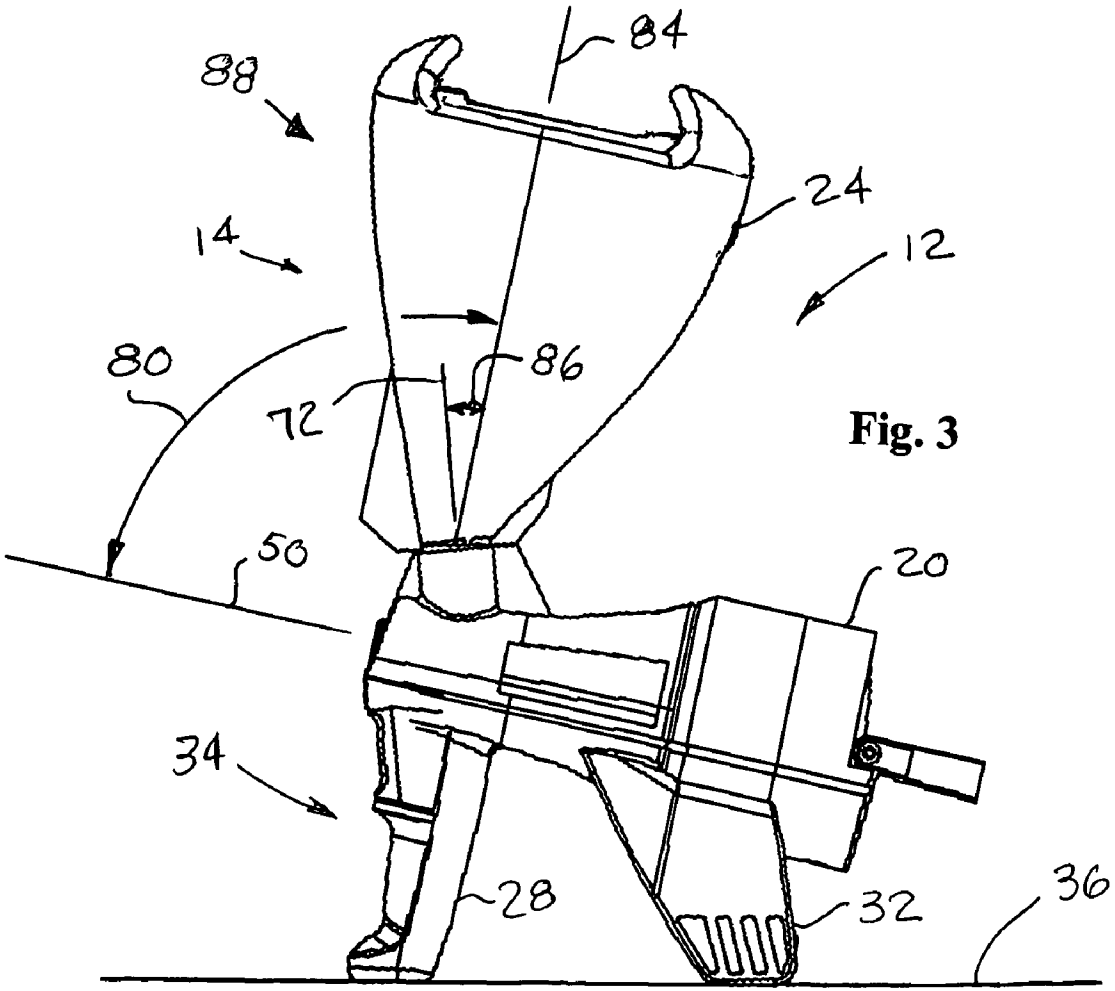
FIG. 3 is a side elevation view of the apparatus of FIGS. 1 and 2, shown resting on a horizontal surface such as a floor, with a hopper in a first position.

The texture sprayer of the present invention is a hand-held apparatus 12 for spraying texture material. The apparatus 12 has a body 22 and a pressurized air source 20 (or 16) removably mounted on the body. The texture sprayer 12 also has a texture material hopper 24 mounted on the body 22 and a texture delivery nozzle 26 extending from the body 22 for selectively spraying texture material from the hopper 24 through a texture material passageway interior of the body to a surface to be coated by propelling the texture material using pressurized air from the pressurized air source. Referring to FIGS. 2 and 3, the apparatus 12 has a forwardly located pistol grip 28 and a rearwardly located pair of legs 30, 32 forming a tripod type support structure 34 for the apparatus 10 such that the apparatus 10 may be placed on a horizontal surface such as a floor 36 and remain upright for filling the hopper 24. This feature is in contrast to prior art sprayers which typically either had a hopper that remained attached to equipment (typically a pump) supported on the floor during operation or had a hopper that remained attached to a hand-held gun that had, at most, a pistol grip, thus necessitating some external support to fill the hopper. With such a prior art arrangement, either two persons were needed to fill the hopper, with one holding the gun and hopper and the other pouring the material into the hopper, or else a single user was required to (precariously) balance the gun on the pistol grip by propping it against an external surface, for example, a wall, to fill the hopper, or else use one hand to hold the gun and hopper and the other hand to pour material into the hopper. The present invention, in this aspect, overcomes these shortcomings of the prior art by providing a stable supporting structure inherent in the hand-held texture sprayer itself, especially useful in providing a self-supporting feature for use while filling the hopper.

Figure 4:
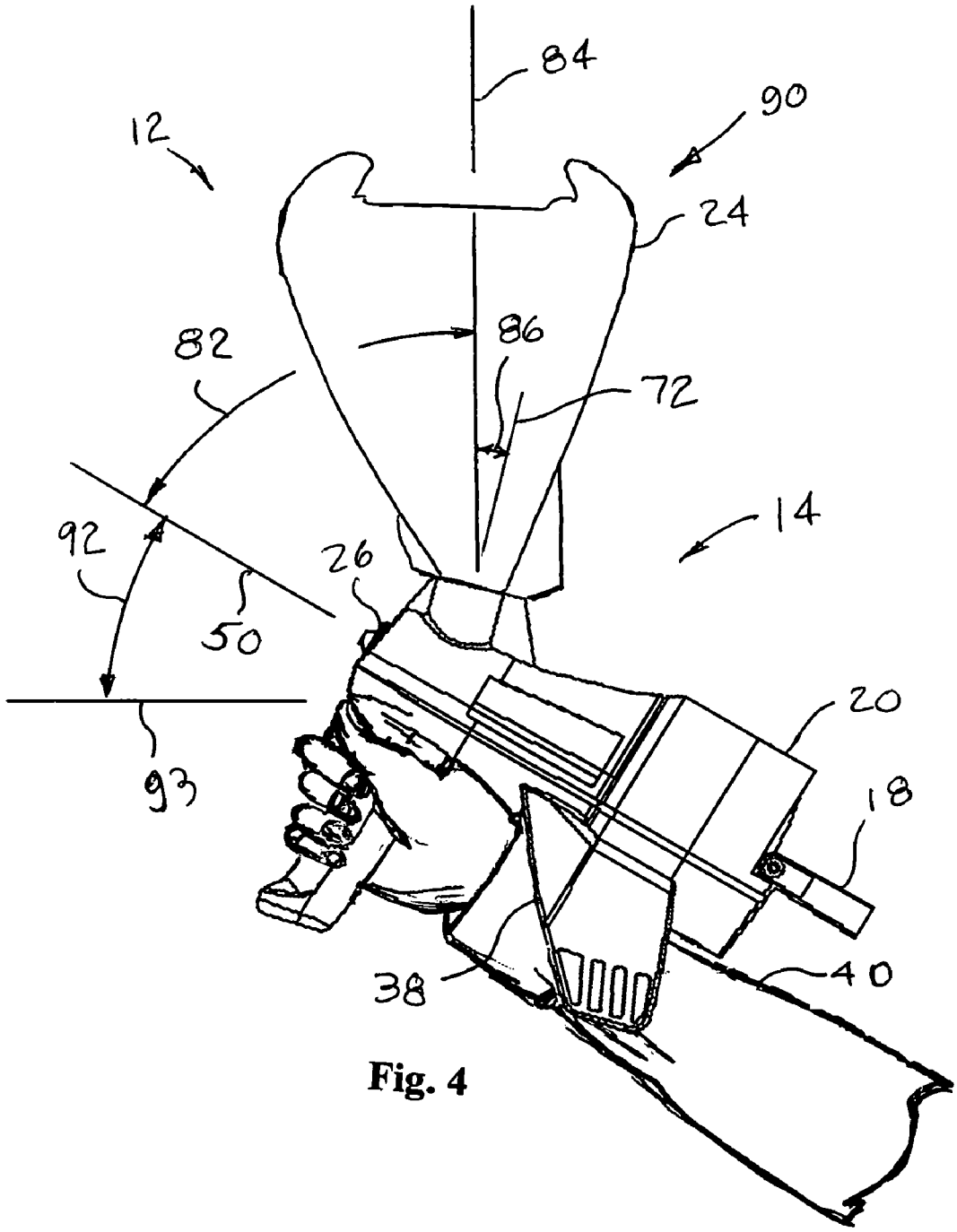
FIG. 4 is another side view of the apparatus of FIGS. 1-3, except shown supported by a hand and arm of an operator, with the hopper in a second position and with the apparatus angled upward to spray texture material on an overhead surface.
Figure 5:
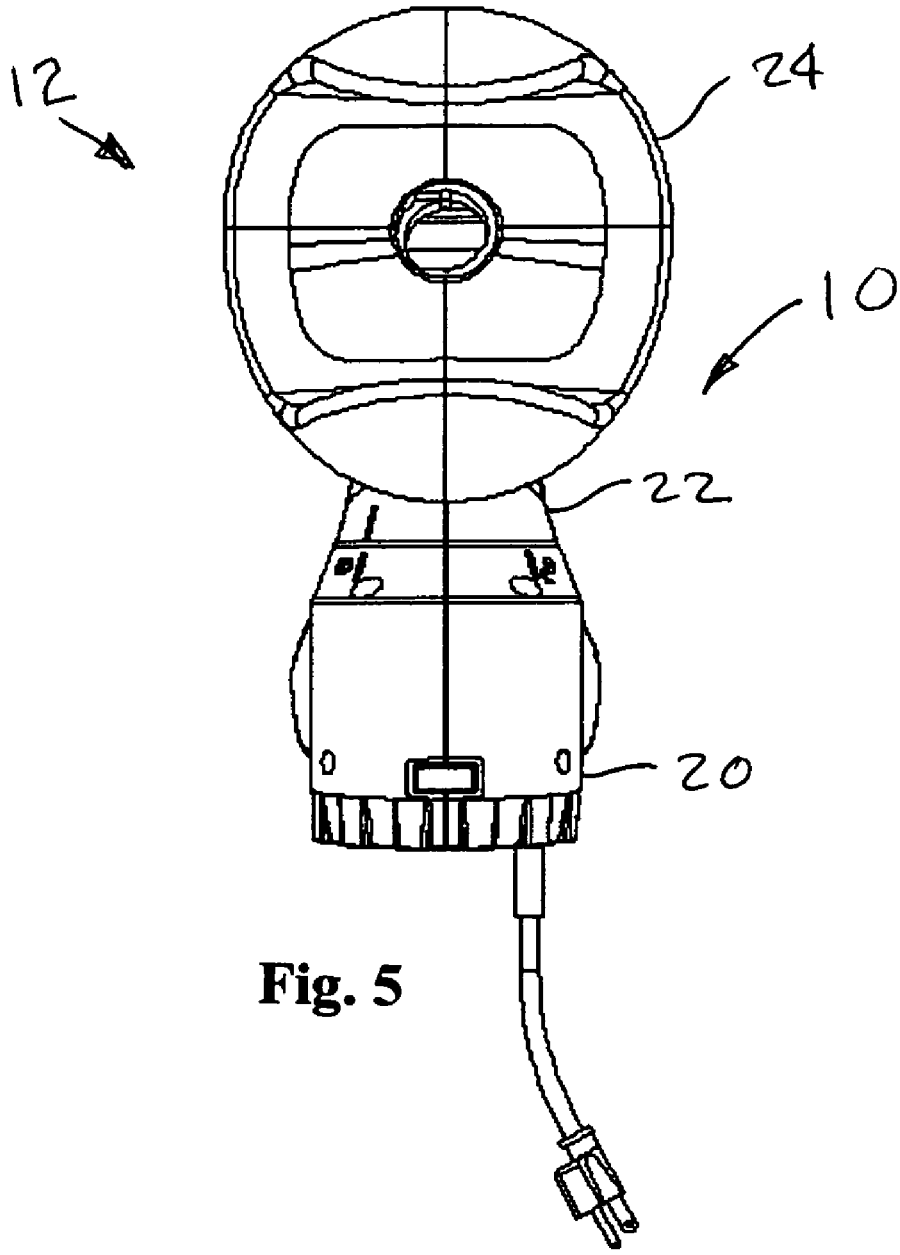
FIG. 5 is a top plan view of a second embodiment of the apparatus for spraying texture material useful in the practice of the present invention.
Figure 6:
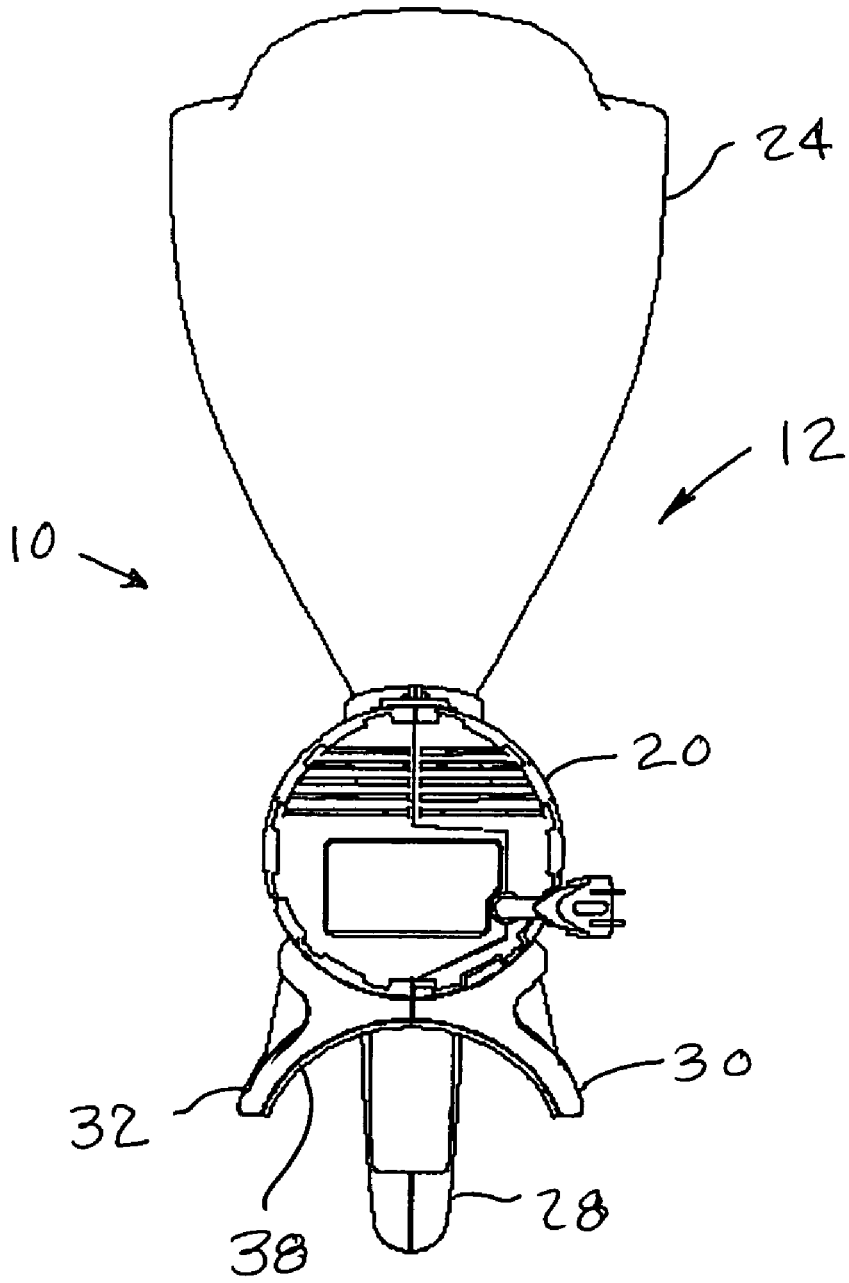
FIG. 6 is a rear elevation view of the apparatus of FIG. 5.

Additionally, the legs 30 and 32 in the hand-held texture sprayer or apparatus 12 may form an arm rest 38 supporting the apparatus 12 on a user's forearm 40 when the pistol grip 28 is grasped by the user, as may be seen in FIG. 4.

Figure 7:
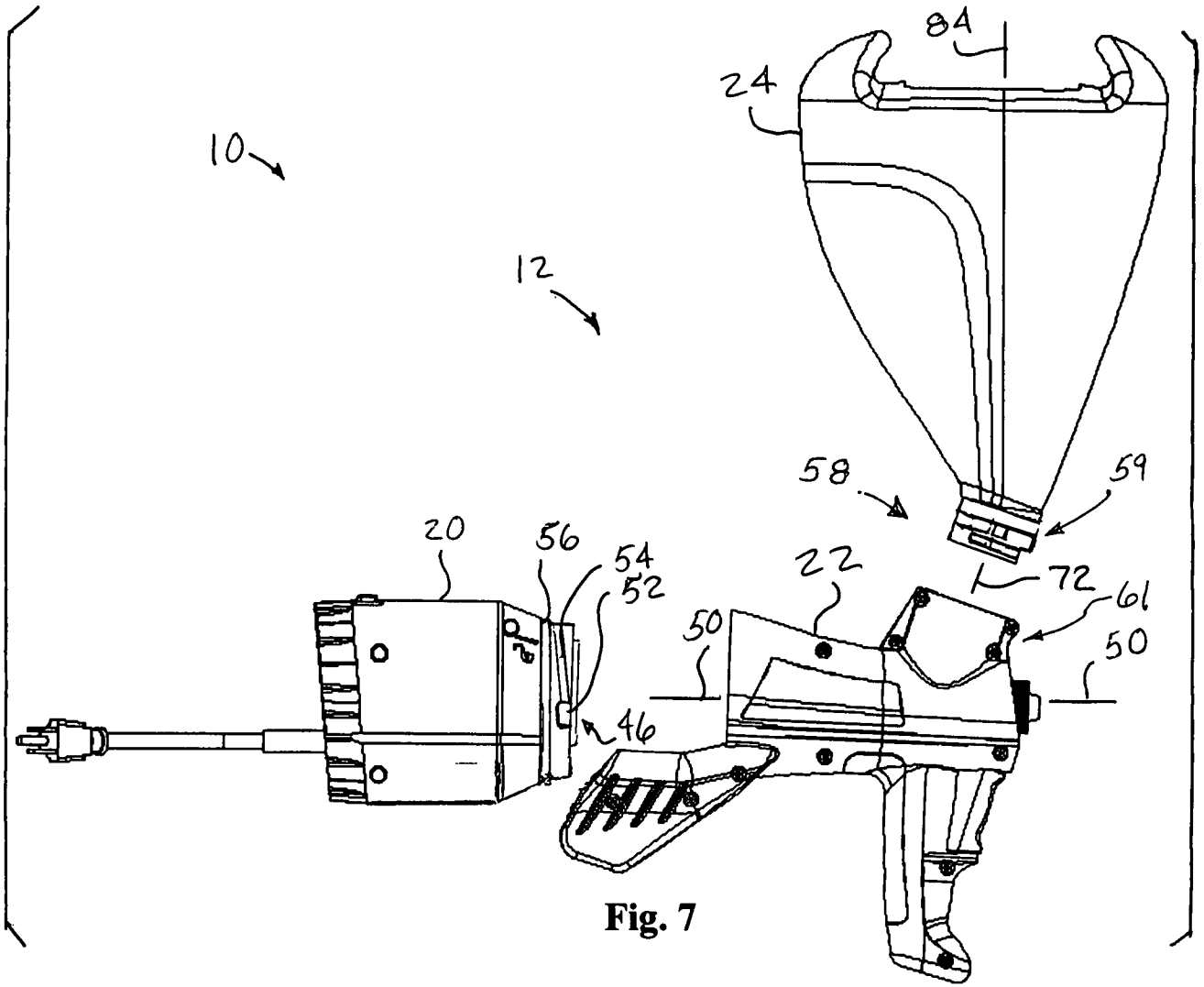
FIG. 7 is a side elevation view of the apparatus of FIGS. 5 and 6, with an air source and the hopper each disengaged from the remainder of the apparatus.
Figure 8:
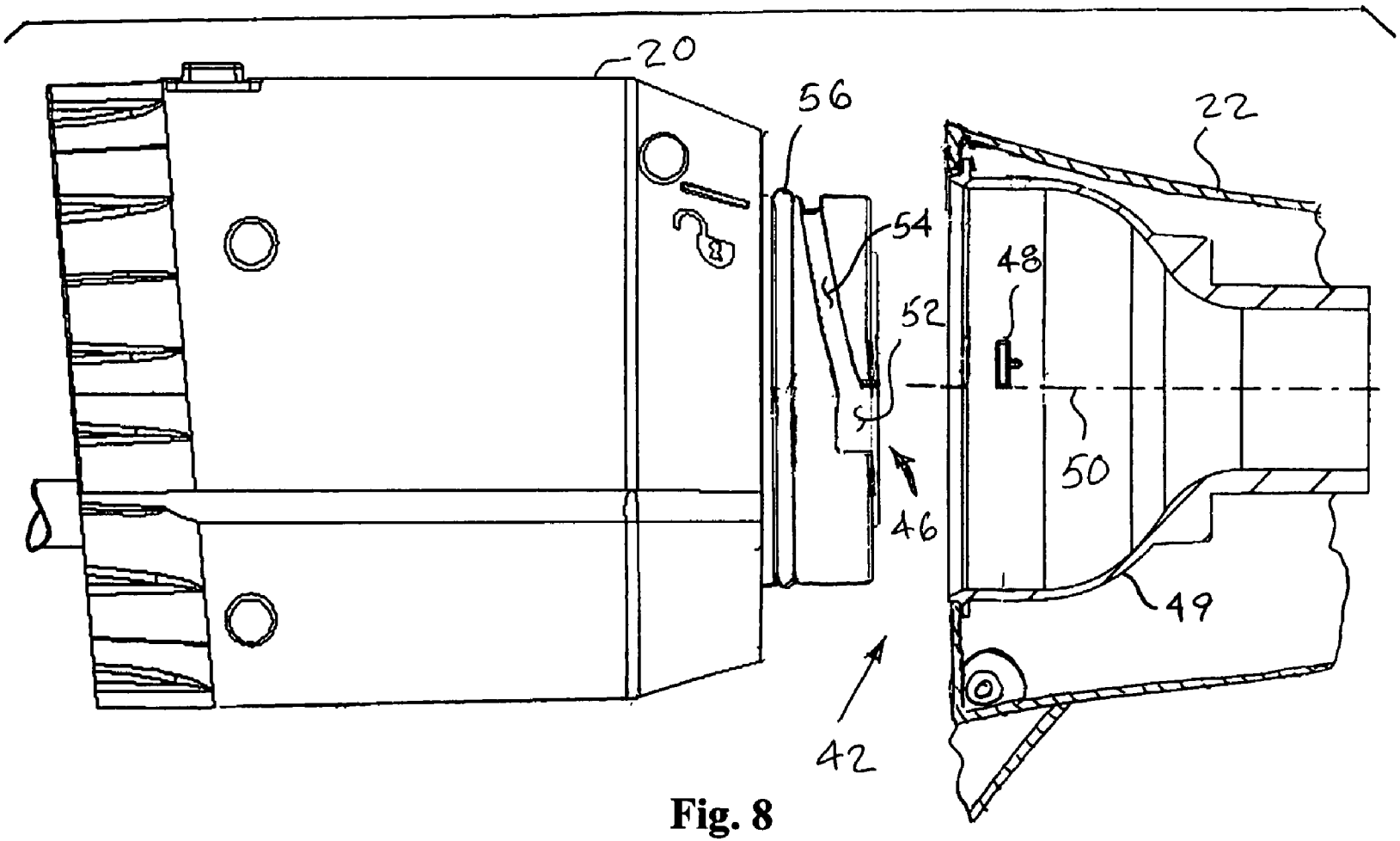
FIG. 8 is an enlarged fragmentary side view, partly in section, to illustrate details of a first manual connection feature of the present invention.
Figure 9:
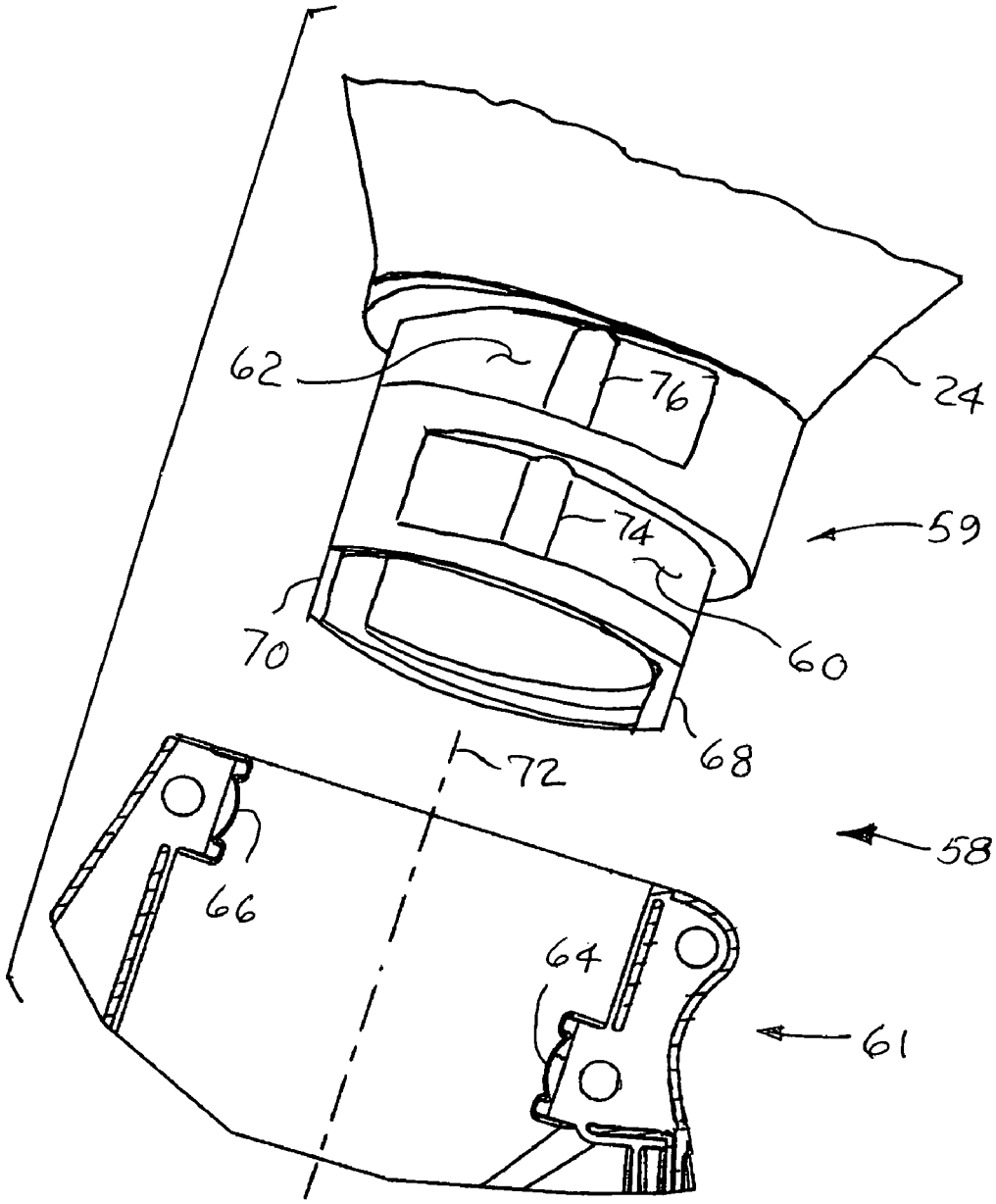
FIG. 9 is an enlarged fragmentary side view, partly in section, to illustrate details of a second manual connection feature of the present invention.

Referring now to FIGS. 7 and 8, the texture sprayer also includes an air source connection structure 42 located between the pressurized air source and the body wherein the air source connection structure is operable to connect and disconnect the pressurized air source to and from the body without the use of tools. The air source connection structure 42 may be in the form of a bayonet interlock 44 removably securing the pressurized air source 20 to the body 22. The bayonet interlock may include a recess 46 on the air source 20 and a protrusion 48 on the body 22. More particularly, the recess 46 is located on the exterior of the air source 22 and is engageable with the protrusion 48 located on an interior surface of a texture chassis 49, which is an internal part of the body 22. To assemble the air source 20 to the body 22, the air source 20 is manually moved axially along an axis 50 toward the body 22 with an opening 52 of the recess 46 aligned with the protrusion 48 until the protrusion 48 is engaged with the recess 46 at the opening 52. The air source 20 is then manually rotated with respect to the body 22, causing the protrusion to move into a helical channel 54 of the recess 46, drawing the air source 20 into close and secure. connection with the body 22. An O-ring 56 seals the air source 20 to the body 22. It is to be understood that the protrusion may be mounted on the air source and the recess formed in the body, if desired.

In another aspect, and now referring additionally to FIGS. 9, 85-88, and 91-100, the invention may further include a material connection structure 58 formed of a fitting 59 on the hopper 24 and a mating fitting 61 on the body 22. The material connection structure 58 is located between the texture material hopper 24 and the body 22. The material connection structure 58 is operable to connect and disconnect the texture material hopper 24 to and from the body 22 without the use of tools.

In one embodiment, illustrated in FIGS. 9 and 85-88, the fitting 59 of the material connection structure 58 includes eccentric surfaces 60, 62 on the hopper 24. The material connection structure 58 also includes a mating fitting 61 which includes offset, diametrically opposed projections 64, 66 on the body 22. The surface 60 engages the projection 64 and surface 62 engages the projection 66 when the hopper is fully engaged with the body 22. To attach the hopper 24 to the body 22, flats 68 and 70 are aligned with projections 64 and 66, and the hopper 24 is moved toward the body 22 along a cylinder axis 72. Once the hopper 24 is seated in the body 22, the hopper 24 may be rotated 90 degrees in either direction, to lock the hopper to the body by engaging surface 60 with projection 64 and simultaneously engaging surface 62 with projection 66. As the hopper 24 is rotated with respect to the body 22, one of a pair of first detents 74 will move past projection 64 and one of a pair of second detents 76 will move past projection 66, to secure the hopper 24 to the body 22.

In another embodiment, illustrated in FIGS. 91-96, the fitting 59 of the material connection structure 58 further includes an O-ring 78 that is received by a groove 79 on the hopper 24. The mating fitting 61 includes a lip 77 that covers the O-ring 78 and groove 79 when the hopper 24 is seated in the body 22.

In still another embodiment, illustrated in FIGS. 97-102, the fitting 59 on the hopper 24 includes a C-clip 246 received in a C-clip groove 256, a knob 248; an O-ring 258 received in an O-ring groove 260. The knob 248 includes a threaded surface 250 and may include a window 254. The mating fitting 61 includes a threaded surface 252 that is capable of engaging with the threaded surface 250 on the knob 248. The hopper 24 may be attached to the body 22 by first placing the O-ring 258 in the O-ring groove 260. If the knob 248 includes a window 254, the knob 248 may be threaded onto the mating fitting 61 via the threaded surfaces 250, 252 and the window 254 may be aligned with the C-clip groove 256. The C-clip 246 may then be inserted through the window 254 and received by the C-clip groove 256. Alternatively, the knob 248 may be lifted to expose the C-clip groove 256 on the fitting 59, and the C-clip 246 may be placed in the C-clip groove 256. This method may be particularly useful if the knob 248 lacks a window 254. The hopper 24 may then moved toward the body 22. Once the hopper 24 is seated in the body 22, the knob 248 may be threaded onto the mating fitting 61 via the threaded surfaces 250, 252.

In each embodiment, turning the hopper 24 in one direction will result in the hopper 24 tilted to a first angle 80 with respect to the axis 50, as shown in FIG. 3. Turning the hopper 24 in the opposite direction will result in the hopper 24 being tilted in to a second angle 82 with respect to the axis 50, as shown in FIG. 4. The first angle 80 is useful for filling the hopper and for directing a spray pattern of the texture sprayer along axis 50 from generally horizontal to angles below horizontal. The second angle 82 is useful for spraying at angles from generally horizontal up to generally vertical, and is particularly useful for spraying surfaces or portions of surfaces above the height of the nozzle of the texture sprayer as it is being used. It is to be understood, however that the sprayer 12 is stable and can be filled with the hopper 24 positioned at angle 82 as well as at angle 80.

The hopper 24 is preferably a generally cone-shaped structure having a conic axis 84 positioned at an angle with respect to the cylinder axis 72 of the material connection structure 58. The fitting 59 of the material connection structure 58 is preferably rotatable about axis 72 to allow positioning of the conic axis 84 of the cone-shaped structure at a location in a cone-shaped path such that the hopper may be rotated to a first position 88 (shown in FIG. 3) wherein the conic axis 84 is directed generally vertically when the body 22 and nozzle 26 directed in a horizontal direction along spray axis 50 (as may be seen in FIG. 7), and (alternatively) to a second position 90 (shown in FIG. 4) wherein the conic axis 84 is oriented generally vertically when the body 22 and nozzle 26 and spray axis 50 are directed upward above a horizontal reference 93, at an angle 92 of, for example, 30 degrees to the horizontal, which has been found to be a comfortable angle for positioning the forearm 40 while spraying an elevated surface.

Figure 10:
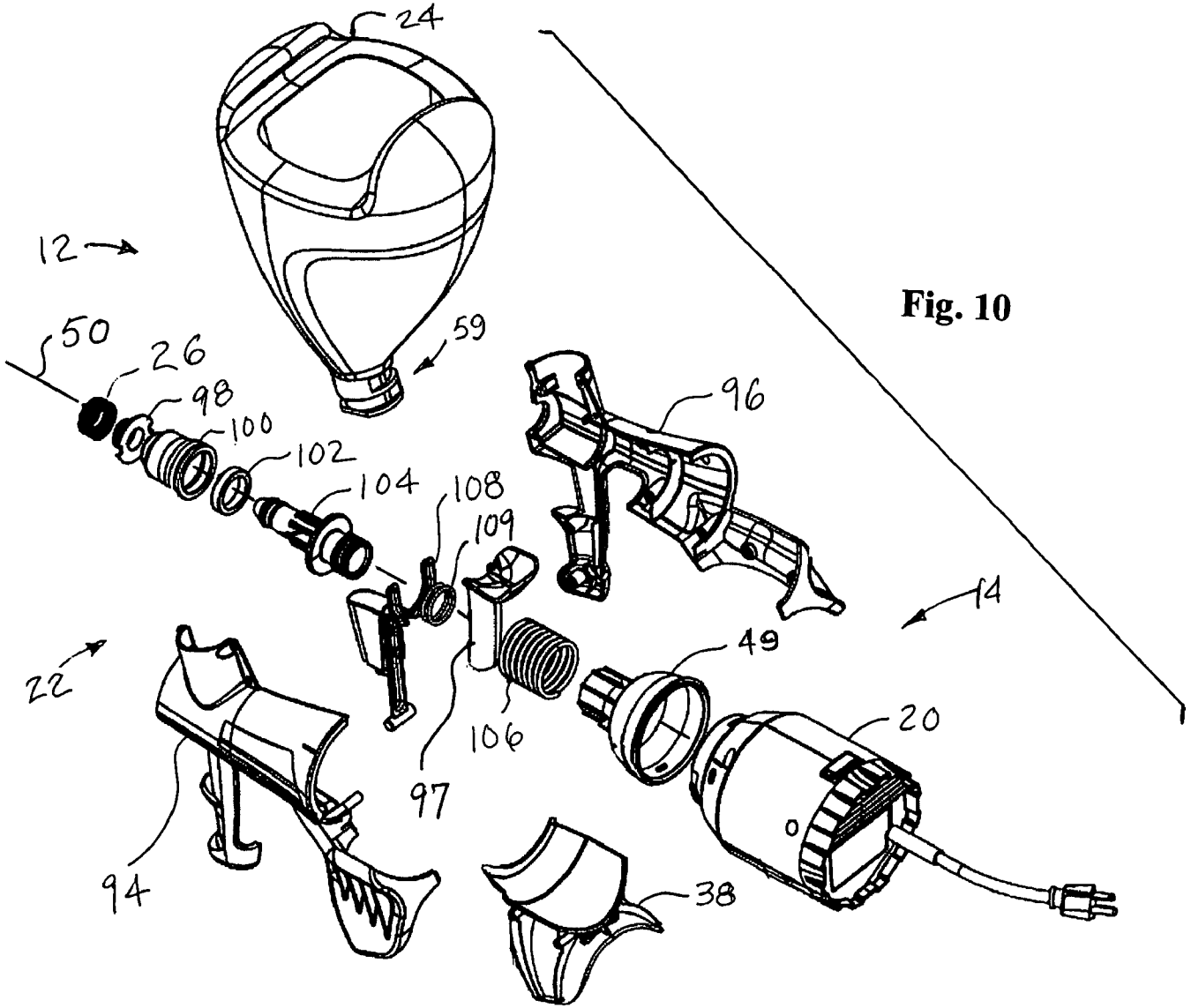
FIG. 10 is an exploded view of the apparatus of FIGS. 5-7.

Referring now also to FIG. 10, an exploded view of the main parts of the texture sprayer 12 of the present invention may be seen. The air source 20 and hopper 24 are shown along with parts of body 22. Body 22 includes left and right gun shell halves 94, 96, which together with a handle insert 97 form the pistol grip 28 and covering portions for the arm rest 38. The nozzle 26 is shown along with a nozzle plate 98, a boot 100 and a bushing 102. A plunger 104 is urged forward against the nozzle plate 98 by a spring 106 and is retractable away from the nozzle plate by a trigger assembly 108. A pair of O-rings 109 are received in grooves on the rear of plunger 104 to seal plunger against the chassis 49.

Figure 14:
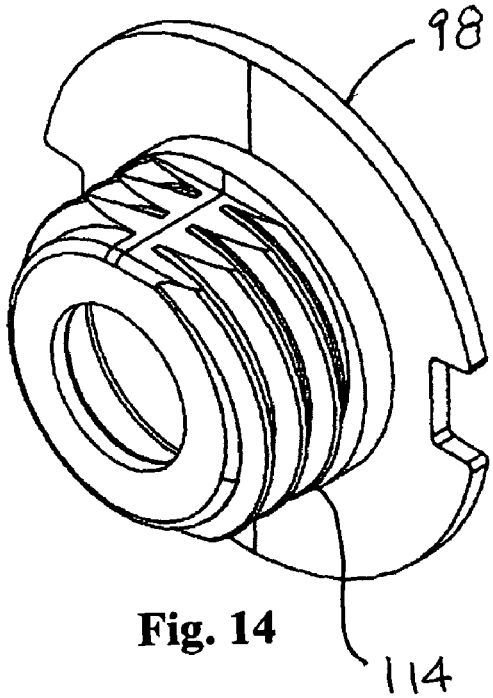
FIG. 14 is a perspective view of a nozzle plate useful in the practice of the present invention.
Figure 15:
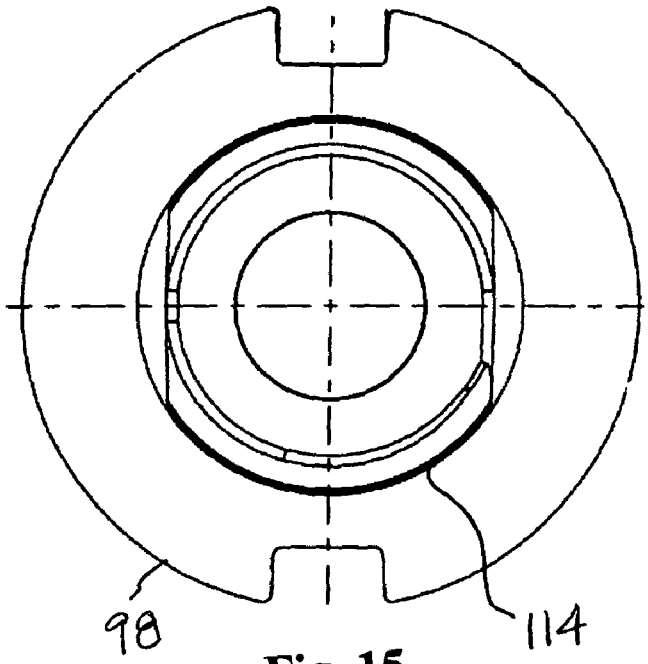
FIG. 15 is a rear elevation view of the nozzle plate of FIG. 14.
Figure 16:
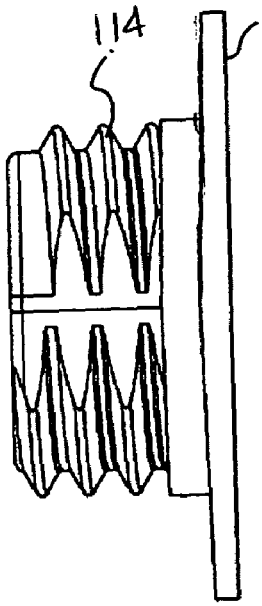
FIG. 16 is a first side view of the nozzle plate of FIG. 14.
Figure 17:
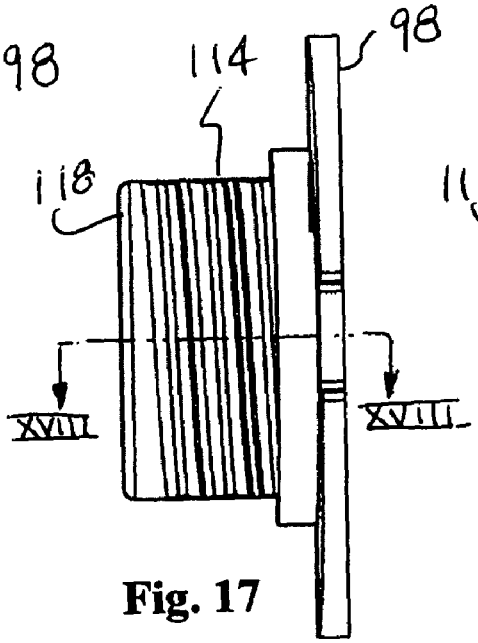
FIG. 17 is a second side view taken at 90 degrees from that of FIG. 16 of the nozzle plate of FIG. 14.
Figure 18:
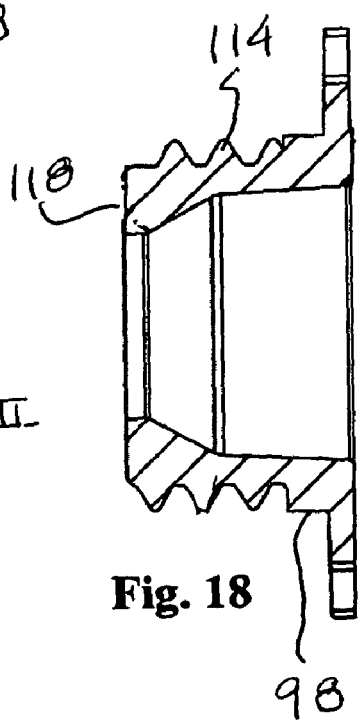
FIG. 18 is a section view of the nozzle plate taken along line XVIII-XVIII of FIG. 17.
Figure 19:
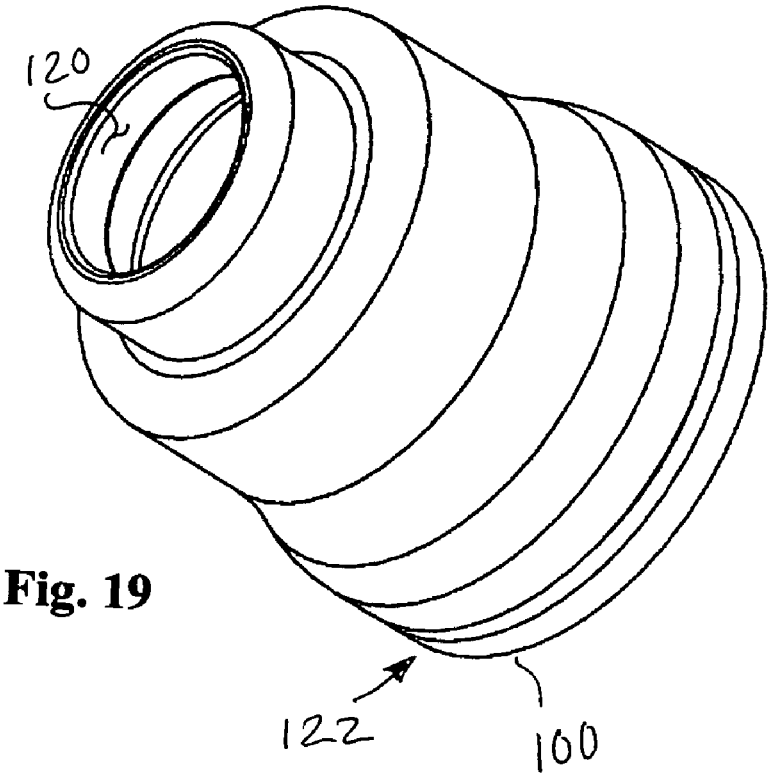
FIG. 19 is a perspective view of an elastomeric boot useful in the practice of the present invention.
Figure 20:
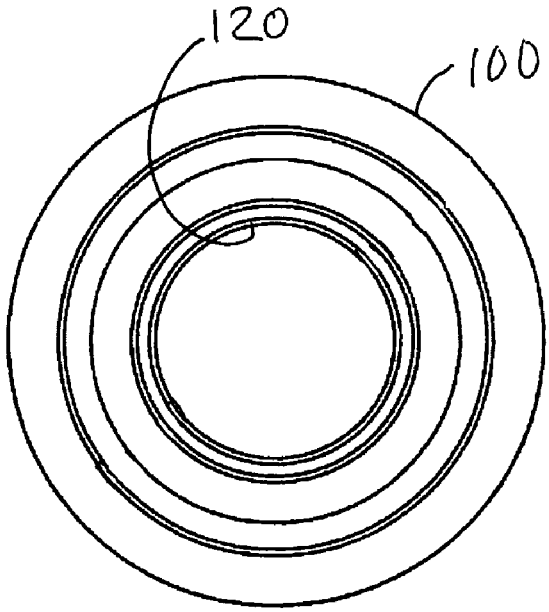
FIG. 20 is an end view of the boot of FIG. 19.
Figure 21:
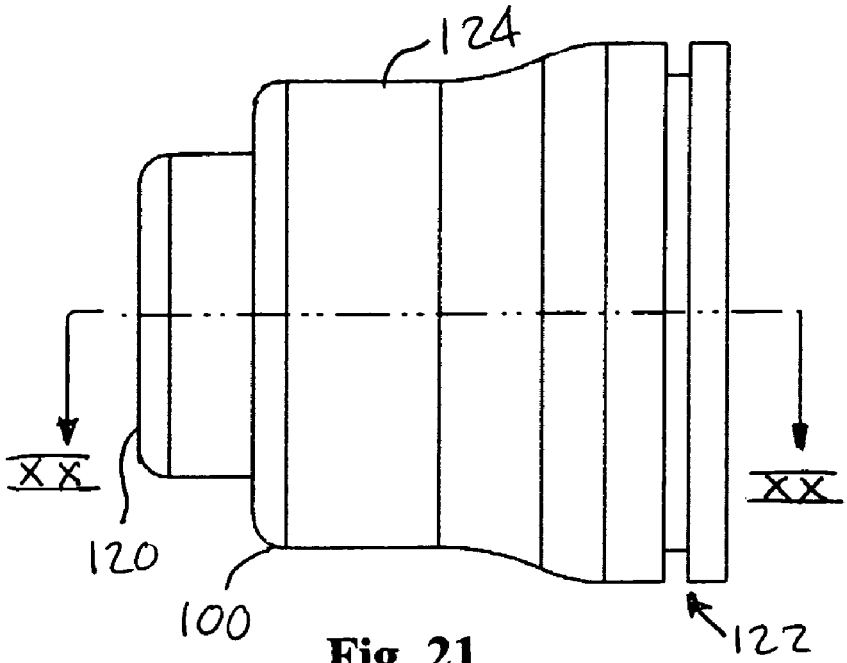
FIG. 21 is a side view of the boot of FIG. 19.
Figure 22:
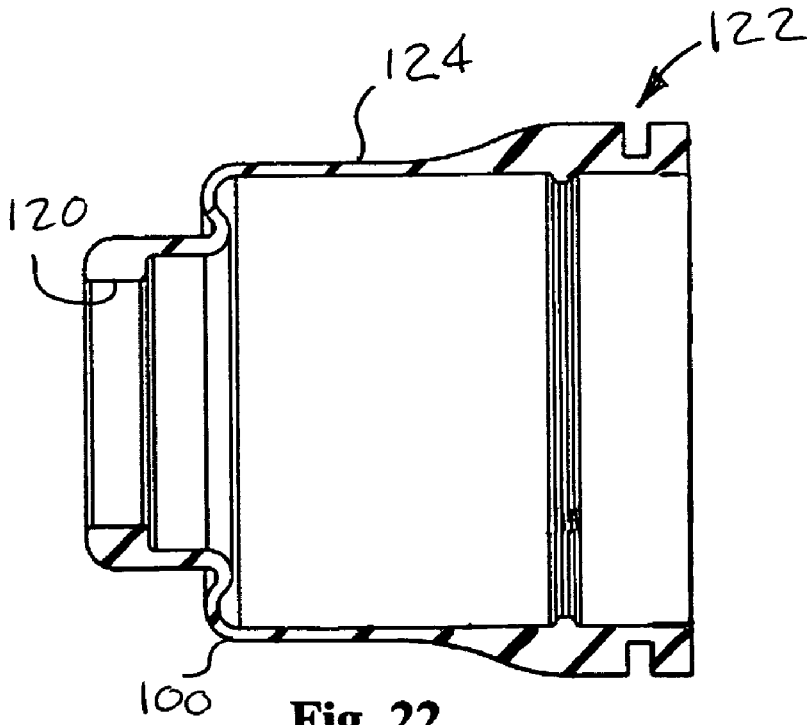
FIG. 22 is a section view taken along line XX-XX of FIG. 21.
Figure 23:
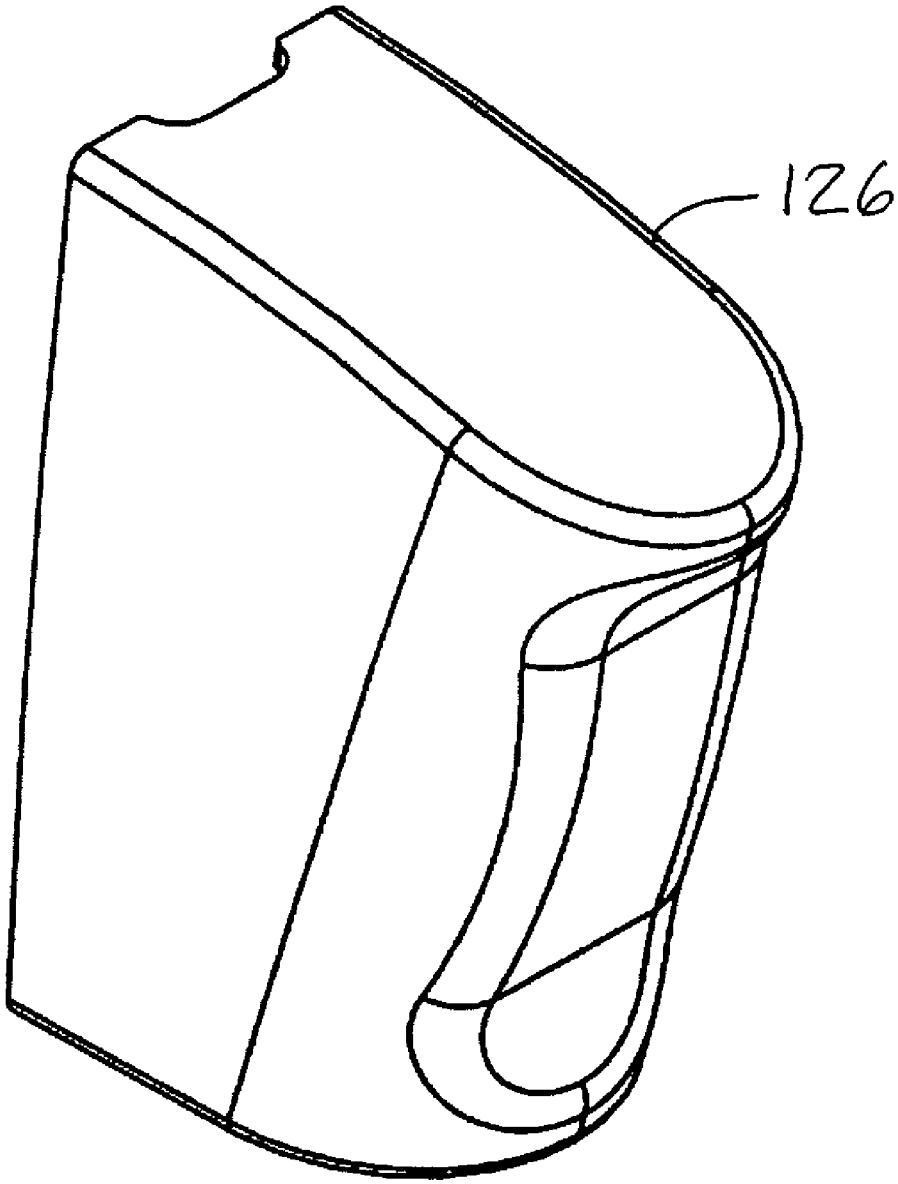
FIG. 23 is a perspective view of a trigger button useful in the practice of the present invention.
Figure 25:
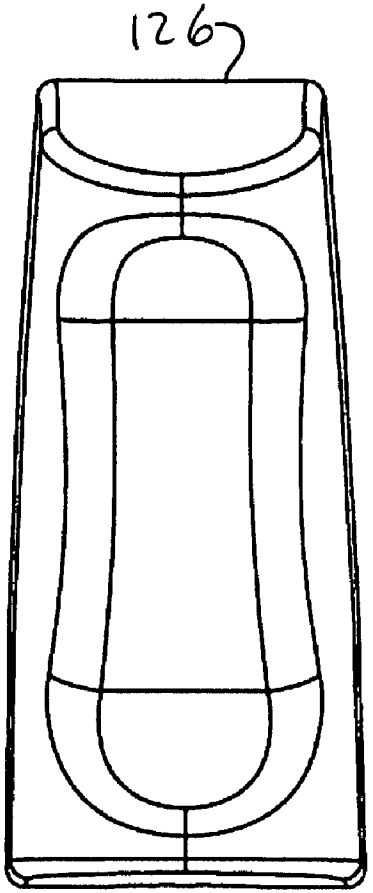
FIG. 25 is a front elevation view of the trigger button of FIG. 23.
Figure 24:
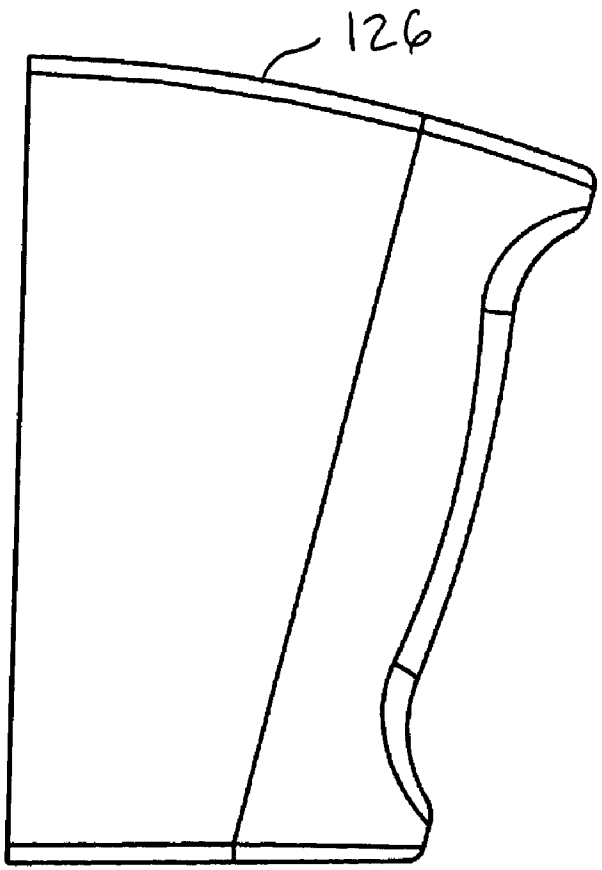
FIG. 24 is a side elevation view of the trigger button of FIG. 23.
Figure 27:
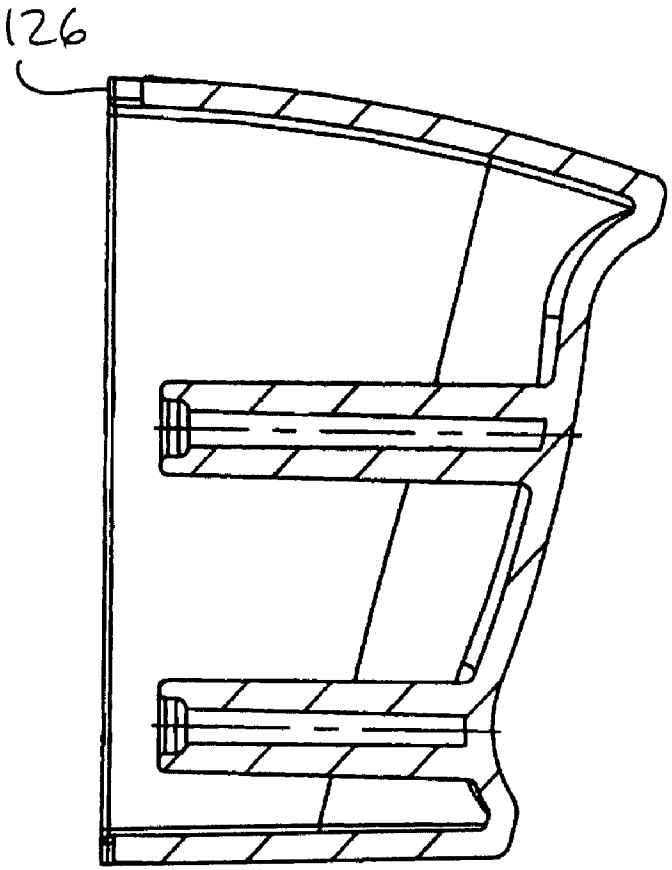
FIG. 27 is a section view taken along line XXVII-XXVII of FIG. 26.
Figure 26:
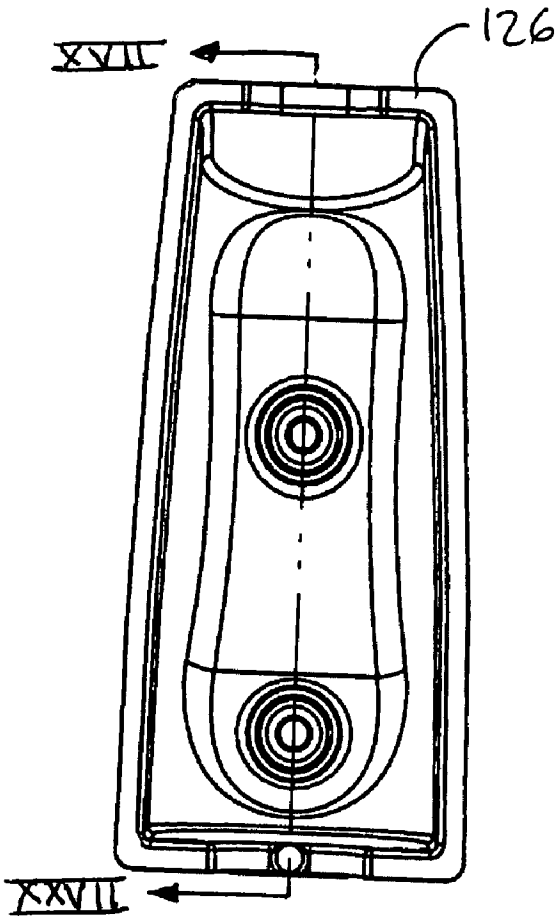
FIG. 26 is a rear elevation view of the trigger button of FIG. 23.
Figure 30:
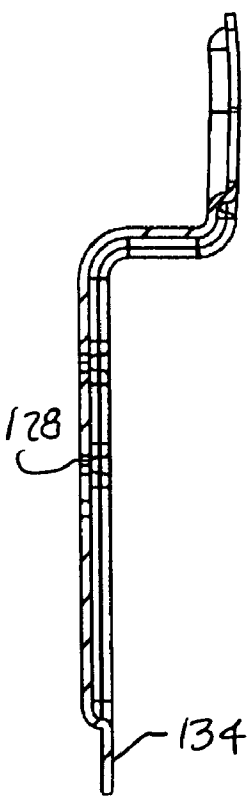
FIG. 30 is a section view along line XXX-XXX of FIG. 29.
Figure 29:
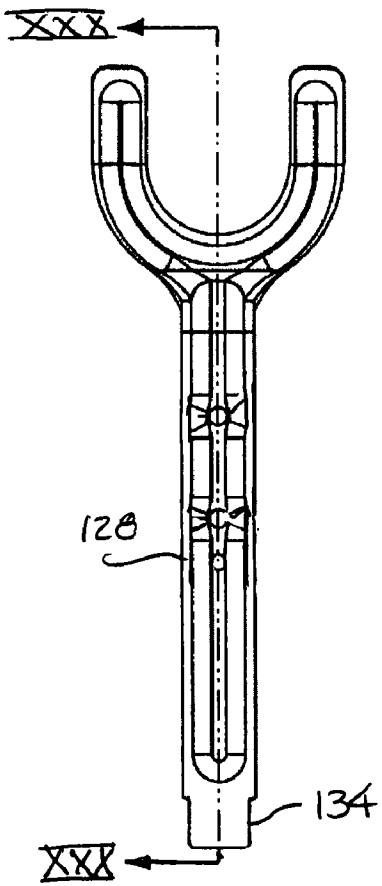
FIG. 29 is a front view of the trigger of FIG. 28.
Figure 28:
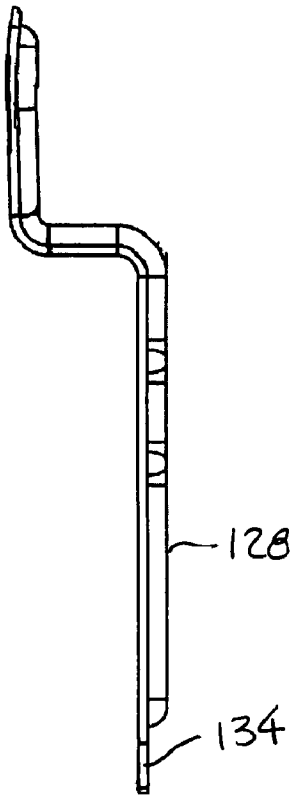
FIG. 28 is a side view of a trigger useful in the practice of the present invention.
Figure 32:
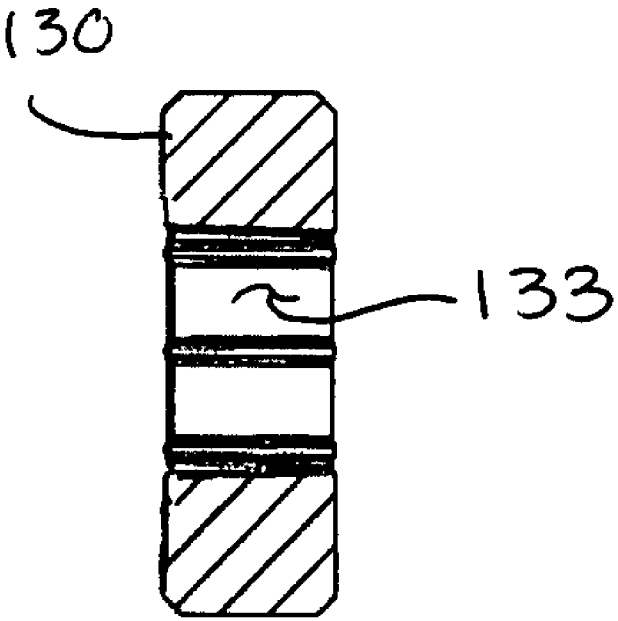
FIG. 32 is a section view taken along line XXXII-XXXII of FIG. 31.
Figure 31:
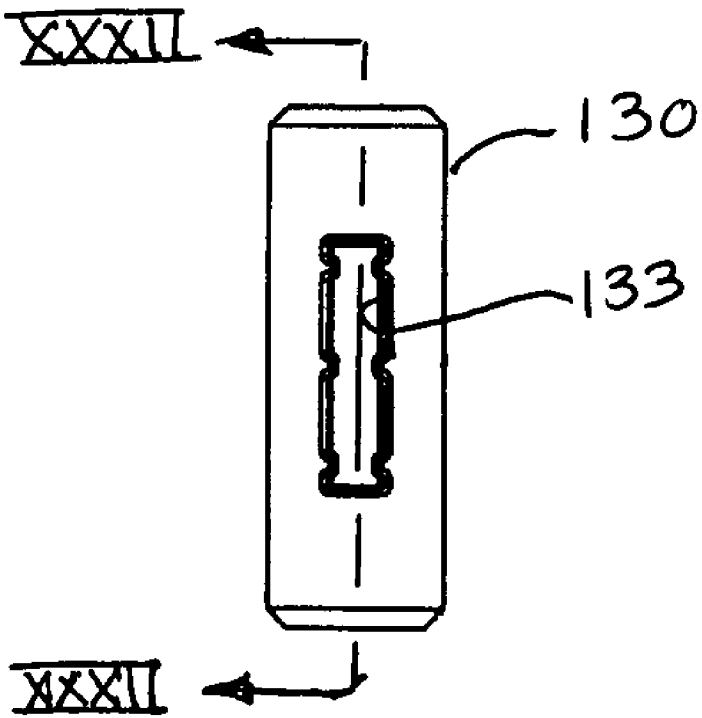
FIG. 31 is a side view of a trigger pivot useful in the practice of the present invention.
Figure 33:
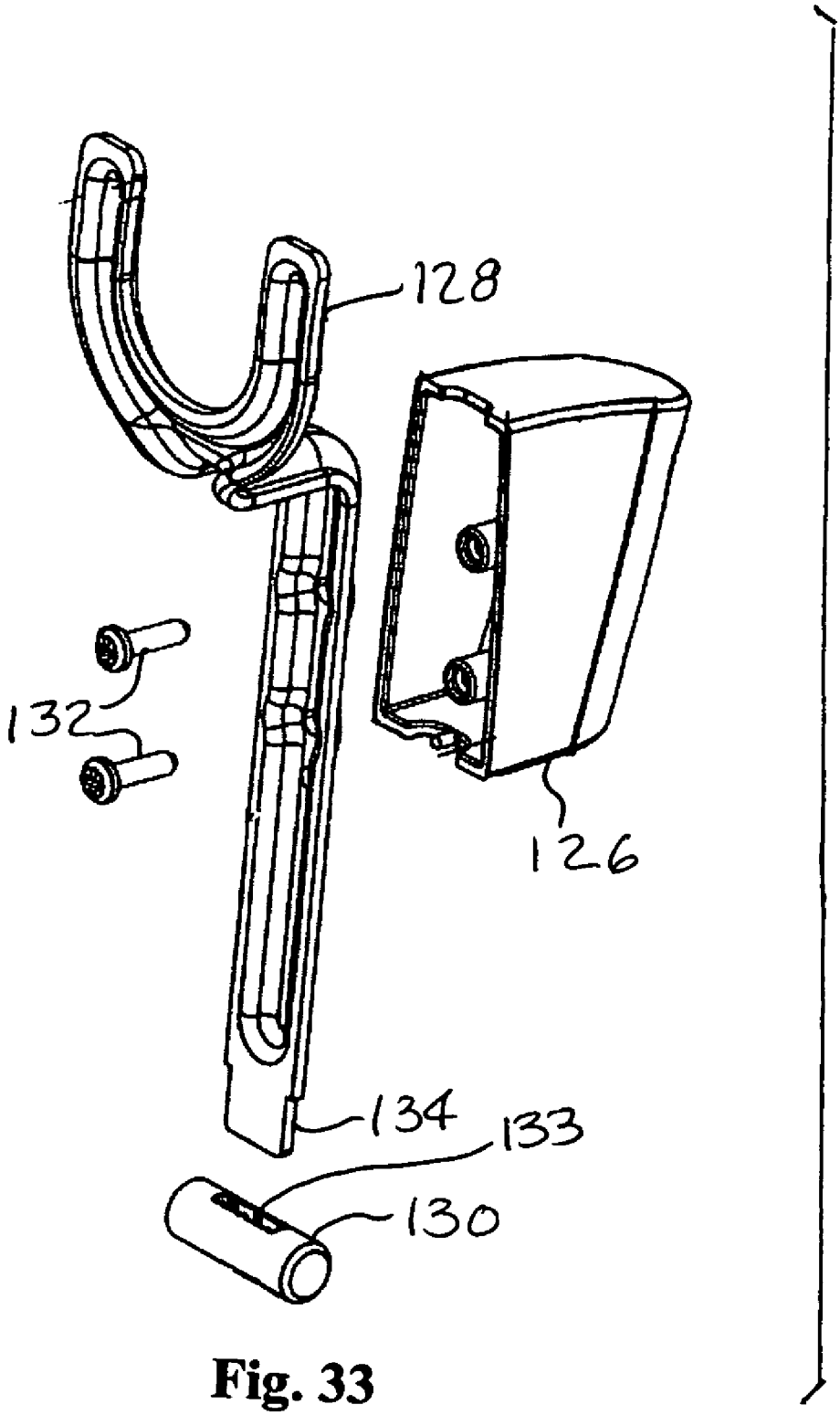
FIG. 33 is an exploded view of a trigger assembly useful in the practice of the present invention.
Figure 35:
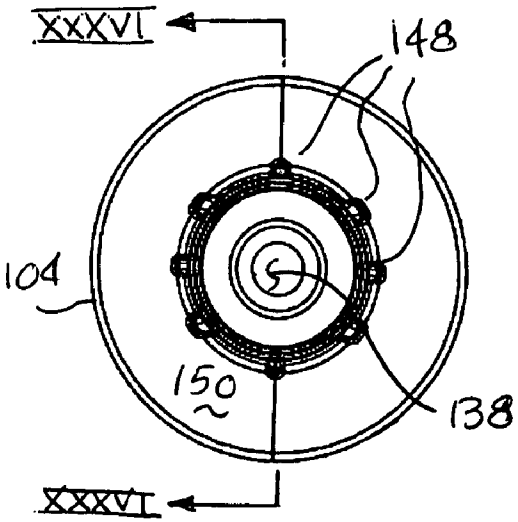
FIG. 35 is an end view of the plunger of FIG. 34.
Figure 34:
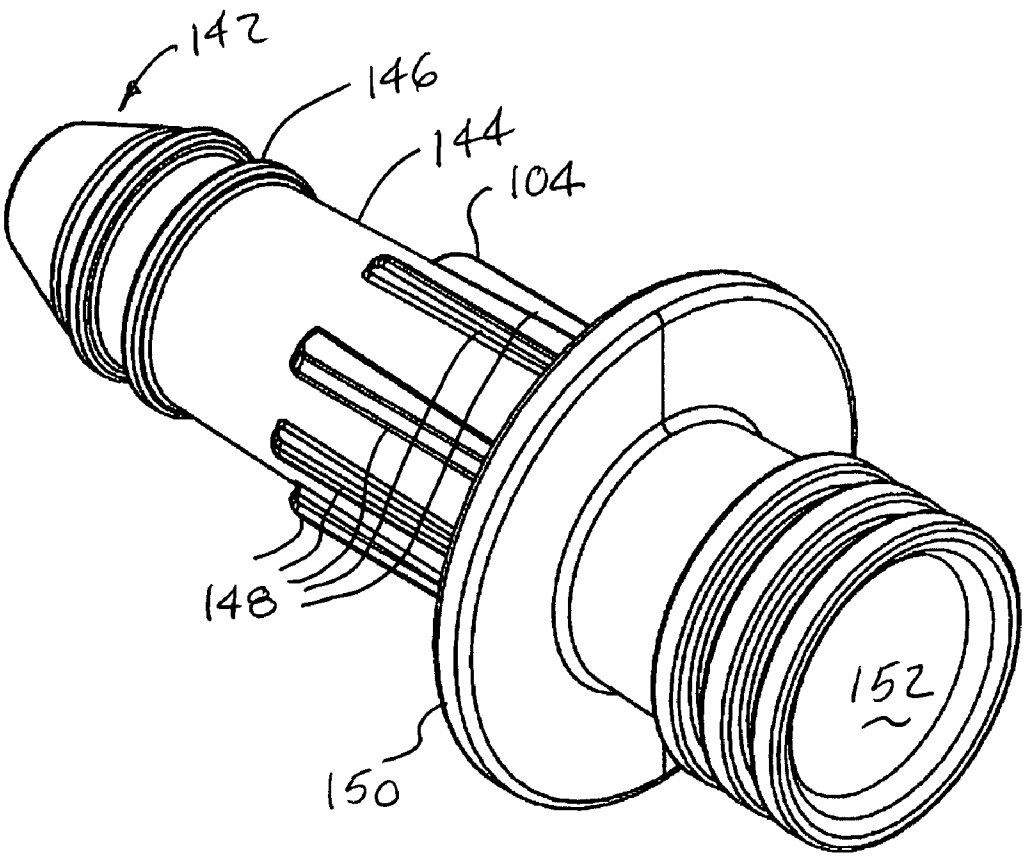
FIG. 34 is a perspective view of a plunger useful in the practice of the present invention.
Figure 37:
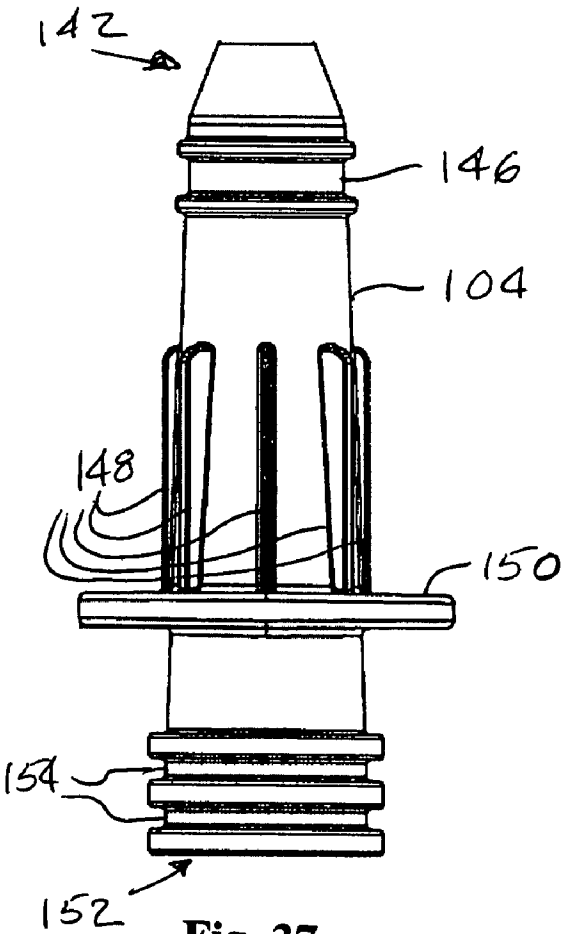
FIG. 37 is a side view of the plunger of FIG. 34.

Referring now to FIGS. 11, 12 and 13, various views of the nozzle 26 may be seen. In contrast to the prior art, the present invention has a removable nozzle threadably engaged at the front of the texture sprayer to permit convenient selection and installation of one nozzle from among a plurality of nozzles, each of which have a different sized aperture to control the spray pattern of the texture being applied by the texture sprayer. Nozzle 26 preferably has a cylindrical main body 110 having a set of internal threads 112 sized to mate with a set of external threads 114 on the nozzle plate 98 (see FIGS. 14). Nozzle 26 also preferably has a conical exit orifice 116. It is to be understood that the texture sprayer 12 of the present invention may be used with alternative nozzles, particularly with a range of nozzles, each with a different characteristic diameter for the exit orifice 116, and each of which have the same size threads 112 to fit the texture sprayer of the present invention. Each nozzle 26 may be formed of polypropylene or another suitable polymer material.

FIGS. 14-18 show various views of the nozzle plate 98. Nozzle plate 98 has a forwardly directed cylindrical element 118 carrying the external threads 114 sized to receive and threadably engage the threads 112 of each nozzle 26 to be used with the texture sprayer 12. Nozzle plate 98 also has a radially extending flange 120 integrally formed with the element 118. Flange 120 is preferably captured between right and left gun shell halves 94,96 to position the nozzle plate 98 in line with the plunger 104. The nozzle plate 98 receives and mates with a downstream end 142 of the plunger 104 when the plunger 104 is in a forward position, to shut off a material flow path for texture material from the hopper 24 to the nozzle 26. Nozzle plate 98 may be formed by molding or die casting any suitable polymeric material or metal. In one embodiment, the nozzle plate 98 is molded from nylon-6. In another embodiment, the nozzle plate 98 is formed using a precision die casting process for zinc material. One such source is Dynacast Inc., of 7810 Ballantyne Commons Parkway, Suite 200, Charlotte N.C. 28277.

Referring now to FIGS. 19-22, various views of the boot 100 may be seen. Boot 100 has a first end 120 sized to fit and seal against the plunger 104 (see FIG. 36) and a second end 122 sized to fit and seal against the assembled gun shell halves 94 and 96 (see FIG. 89). Boot 100 may be formed of natural or synthetic rubber with durometer of about 70. In between first and second ends 120-122 boot 100 preferably has a thin cylindrical wall 124. When installed between plunger 104 and the gun shell, boot 100 prevents contamination of moving parts (such as the spring 106 and trigger assembly 108) of the sprayer 12 by the texture material. Bushing 102, which may be formed of nylon, is received in the second end 122 of boot 100 to support the boot 100 and maintain the seal of the second end 122 of the boot 100 against the gun shell. Bushing 102 preferably has a clearance fit with plunger 104.

Figure 69:
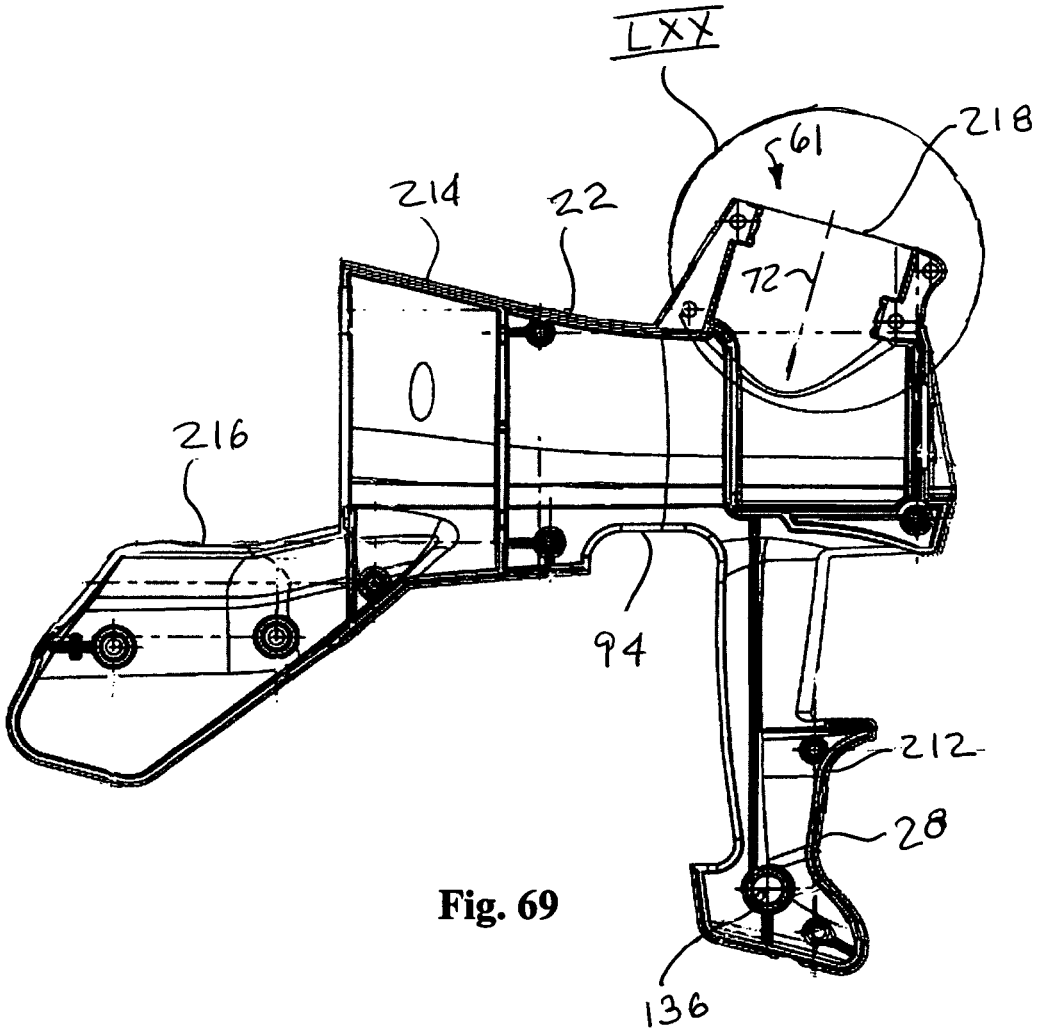
FIG. 69 is a side elevation view of the interior of the left turbine gun shell of FIG. 65.

Referring now to FIGS. 23-33, the various parts of the trigger assembly 108 may be seen. Trigger assembly 108 may include a trigger button 126, a trigger frame 128 and a trigger pivot 130 in the form of a slotted cylindrical member. Trigger assembly 108 may also include one or more conventional threaded fasteners 132 (such as self tapping screws) to retain the button 126 to the frame 128. Pivot 130 has a slot 133 to receive a tongue 134 of trigger frame 128 in an interference fit. Pivot 130 is preferably received in a pair of aligned cylindrical cavities 136 (see FIG. 69) in each of the gun shell halves 94, 96, more particularly, in the pistol grip 28. Button 126 and pivot 130 may each be formed of polypropylene and frame 128 may be formed of steel.

Figure 36:
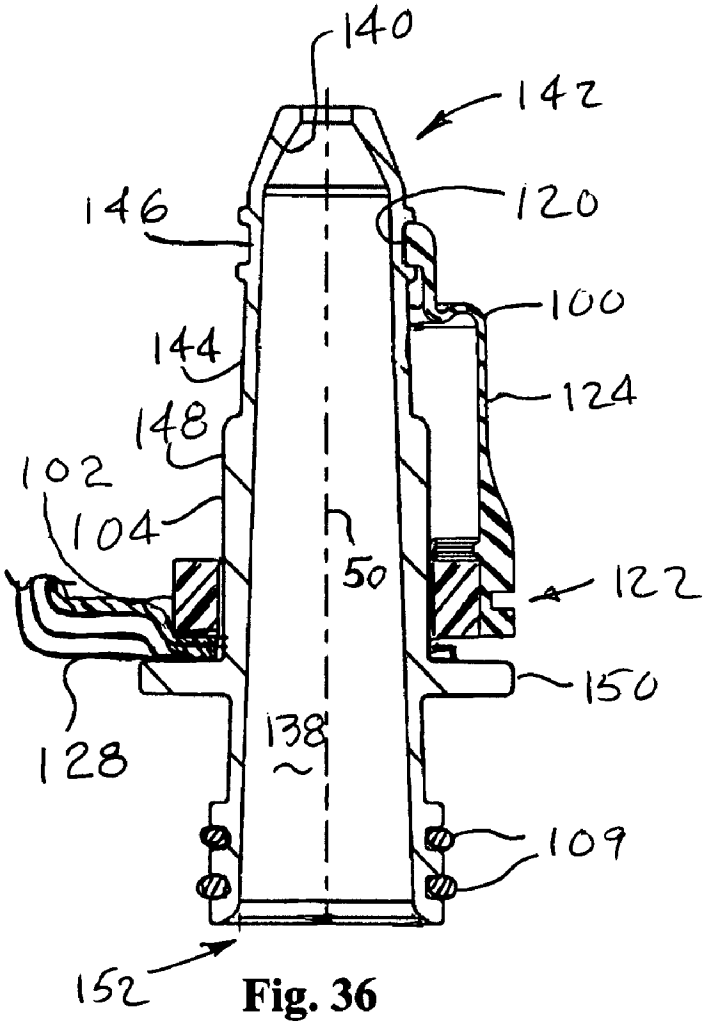
FIG. 36 is a section view along line XXXVI-XXXVI of FIG. 35, together with a half section view of the boot of FIG. 22 and a section view of a bushing and a portion of a trigger frame and a pair of O-rings mounted on the plunger to show the relationship of these parts in an assembled state.
Figure 40:
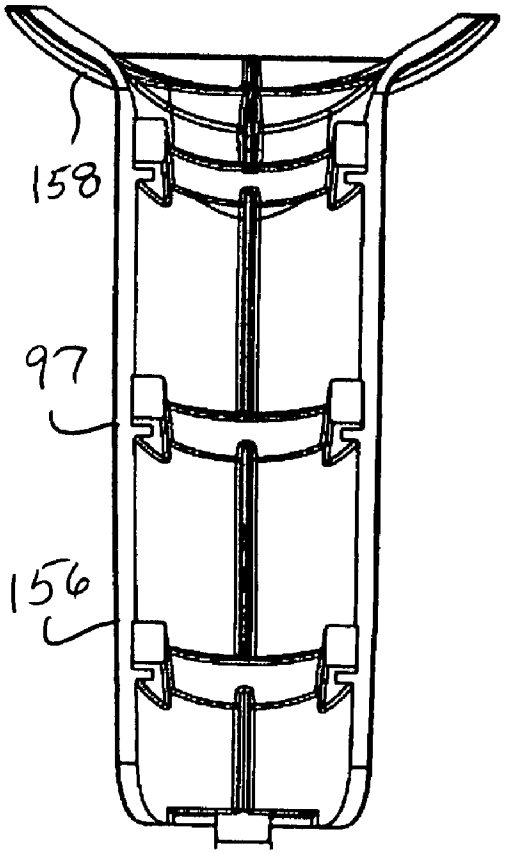
FIG. 40 is an elevation view of the interior of the trigger insert of FIG. 38.
Figure 39:
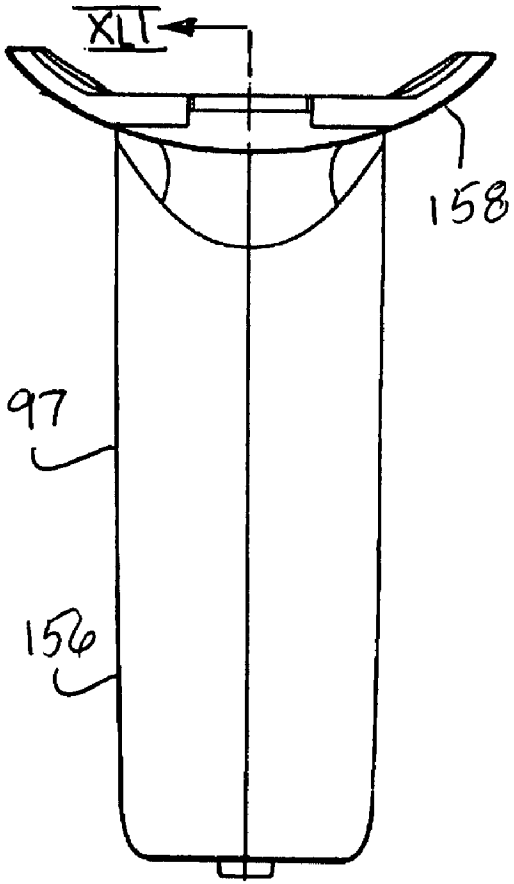
FIG. 39 is an elevation view of the exterior of the trigger insert of FIG. 38.
Figure 38:
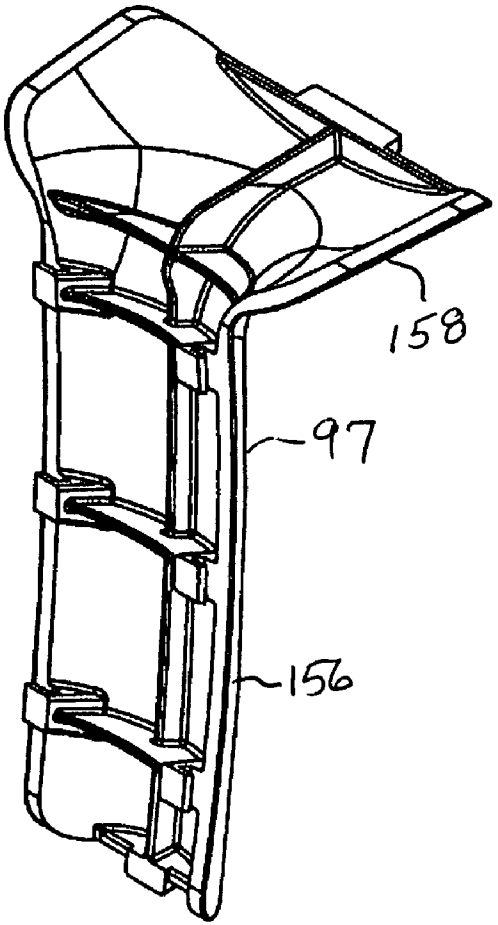
FIG. 38 is a perspective view of a trigger insert useful in the practice of the present invention.
Figure 42:
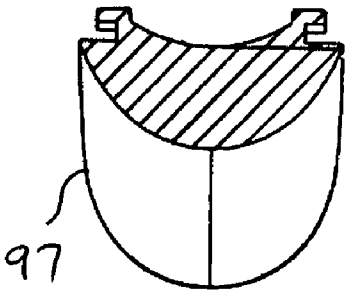
FIG. 42 is a section view taken along line XLII-XLII of FIG. 41.
Figure 43:
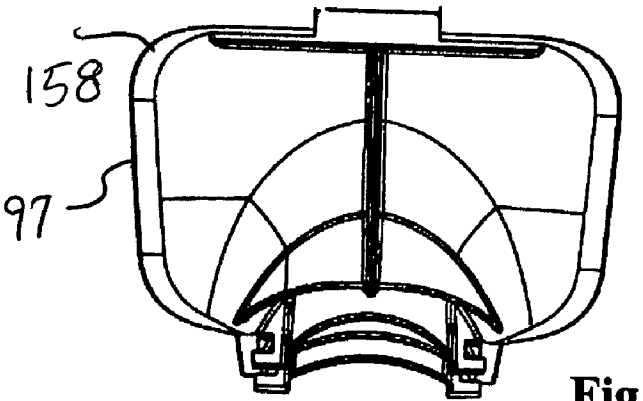
FIG. 43 is a top plan view of the interior of the trigger insert of FIG. 38.
Figure 41:
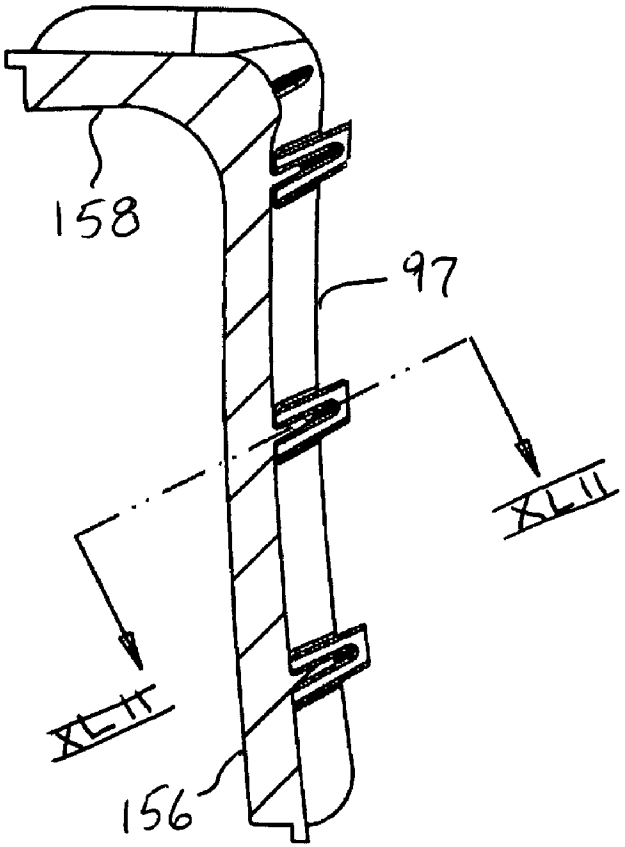
FIG. 41 is a section view taken along line XLI-XLI of FIG. 39.
Figure 44:
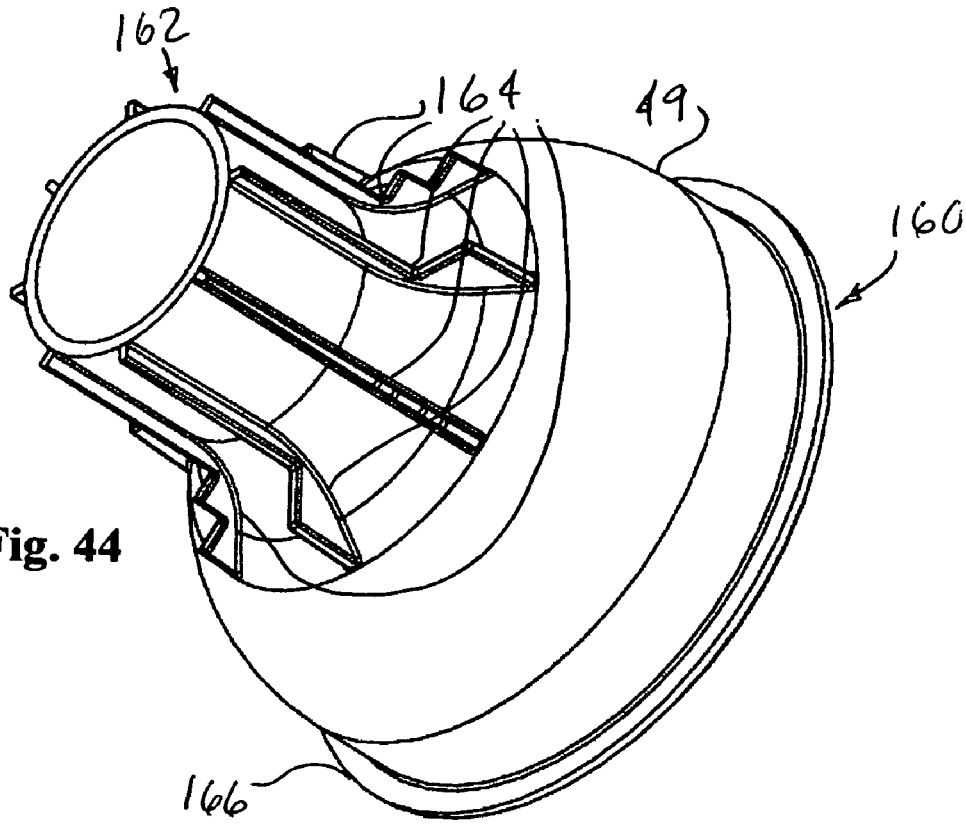
FIG. 44 is a perspective view of a chassis useful in the practice of the present invention.
Figure 45:
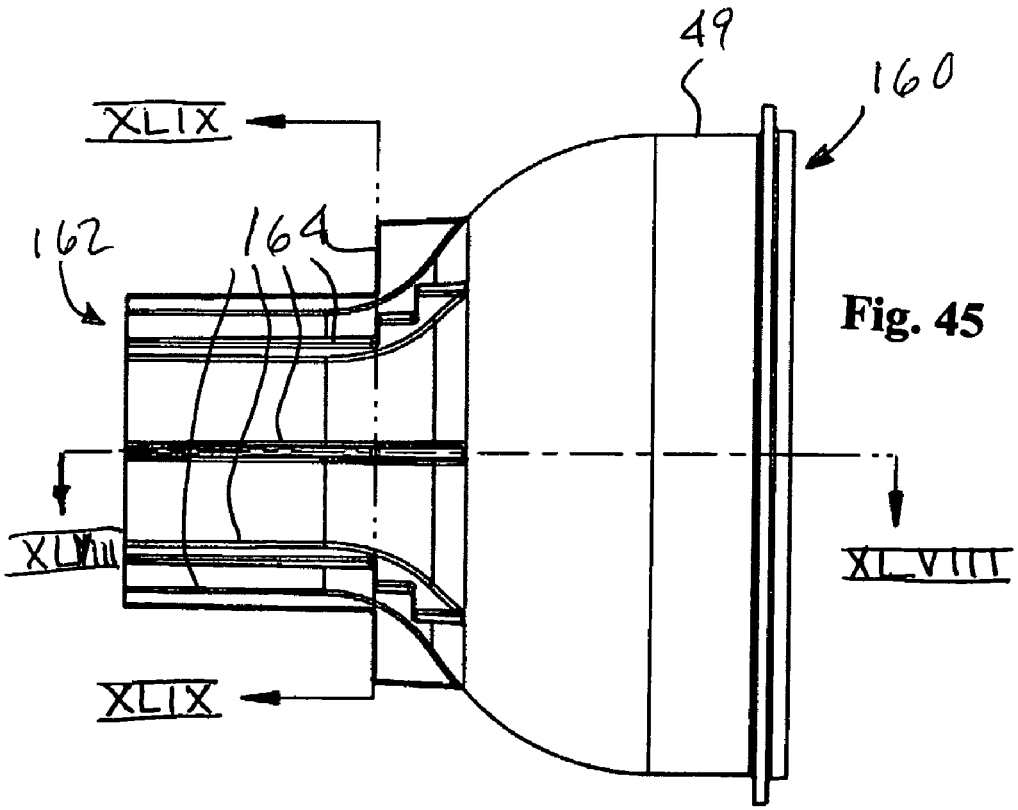
FIG. 45 is a side view of the chassis of FIG. 44.
Figure 46:
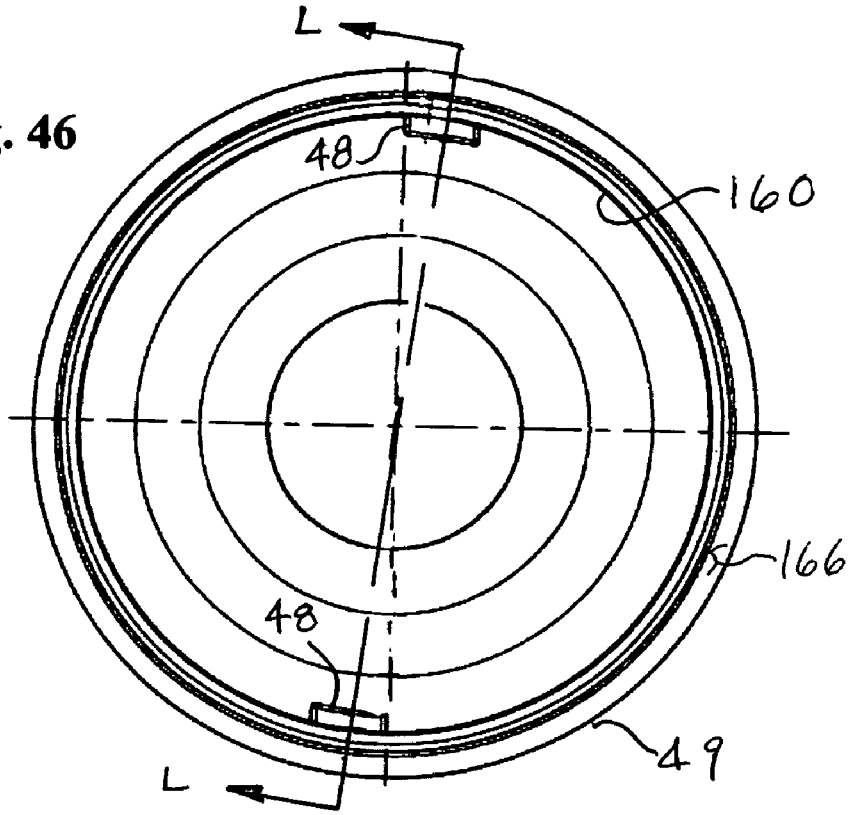
FIG. 46 is a first end view of the chassis of FIG. 44.
Figure 47:
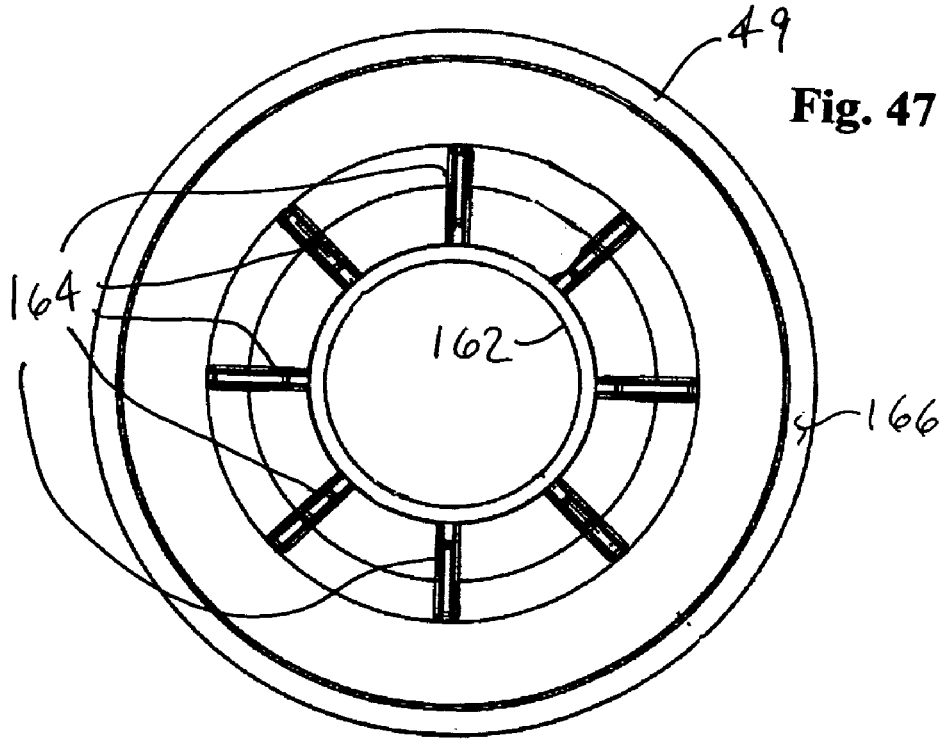
FIG. 47 is a second end view of the chassis of FIG. 44.

Referring now to FIGS. 34-37, various views of the plunger 104 may be seen. In FIG. 36, the plunger 104 is shown in cross section, together with a half section view of the boot 100 and a section view of the bushing 102 and a portion of the trigger frame 128 and the pair of O-rings 109 mounted on the plunger 104. Plunger 104 has a hollow through bore 138 with a conical tapered outlet 140 at a downstream end 142. Bore 138 provides a passageway for air from the air source 20 through the plunger to the nozzle 26. Plunger 104 also has a tapered cylindrical sidewall 144 with a circumferential groove 146 and axially oriented ribs 148. Plunger 104 also has a radially extending flange 150 and an upstream end 152 having a pair of grooves 154 to receive O-rings 109. Plunger 104 may be formed of nylon 6/6 or other suitable polymer material.

Referring now to FIGS. 38-43, various views of the handle insert 97 may be seen. Handle insert 97 may be formed of polypropylene and is shaped to complete the pistol grip 28 by providing a back surface therefore. Forming handle insert 97 as a separate piece allows the back surface of the pistol grip to be of a contrasting color to the remainder of the pistol grip 28. Handle insert 97 preferably has a generally elongated, relatively narrow vertical portion 156 and a wider, generally horizontal portion 158.

Referring now to FIGS. 44-50, various views of the texture chassis 49 may be seen. Chassis 49 is a generally funnel shaped part to control and direct air exiting the air source 20 to the plunger 104. Chassis 49 has a relatively larger upstream end 160 with the pair of protrusions 48 extending radially inward near the upstream end 160 to engage the recesses 46 in the air source 20, as may also be seen. in FIG. 8. Chassis 49 has a relatively smaller downstream end 162 sized to receive the upstream end 152 of the plunger 104, with O-rings 109 providing a relatively air tight seal between chassis 49 and plunger 104 regardless of the axial position of plunger 104 with respect to chassis 49. Chassis 49 also has axial ribs 164 and a circumferential flange 166 to stiffen chassis 49 and to positively locate chassis 49 in the gun shell halves 94 and 96. Ribs 164 also provide a guiding and reaction surfaces for spring 106. Chassis 49 may be formed of nylon.

Figure 51:
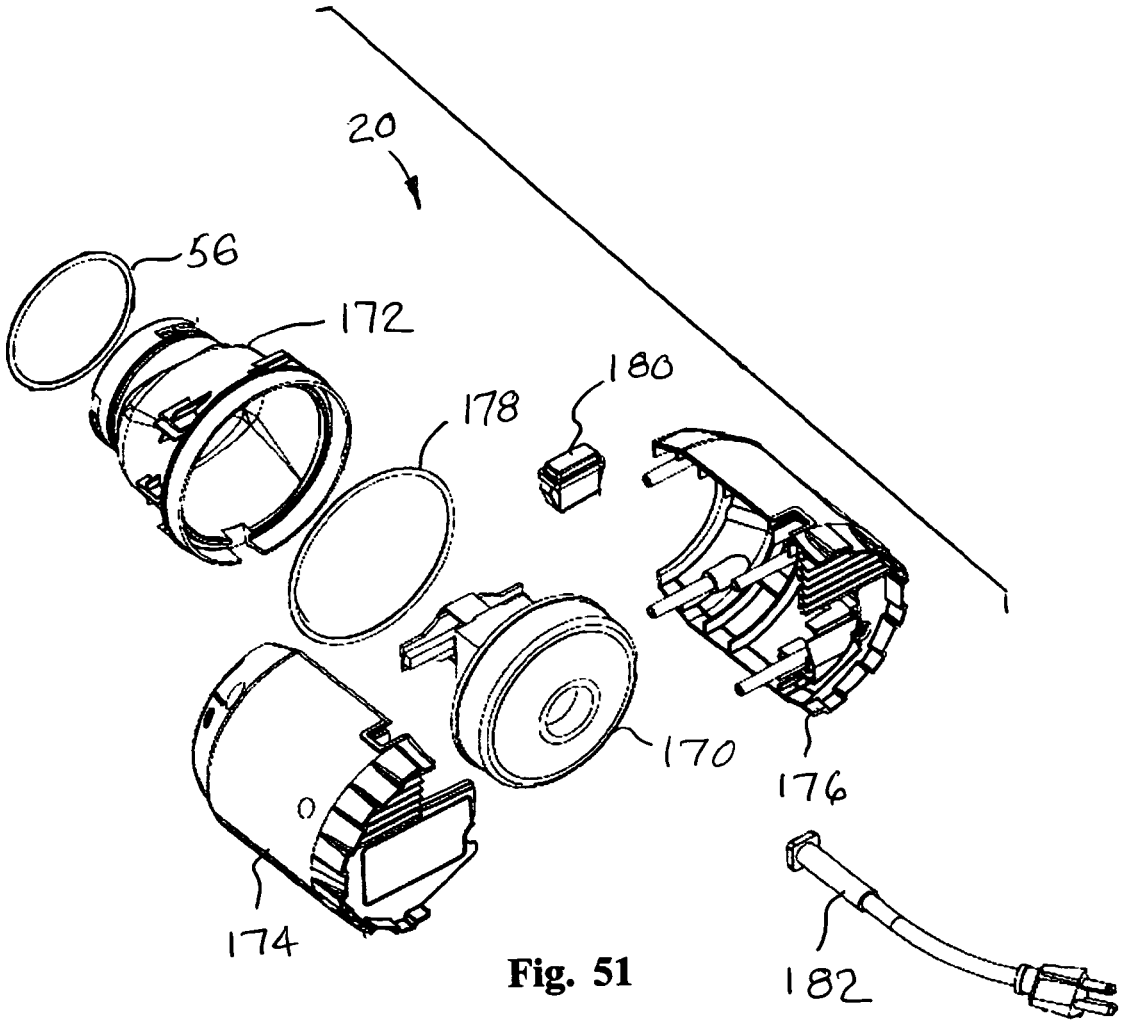
FIG. 51 is an exploded view of a turbine assembly useful in the practice of the present invention.
Figure 52:
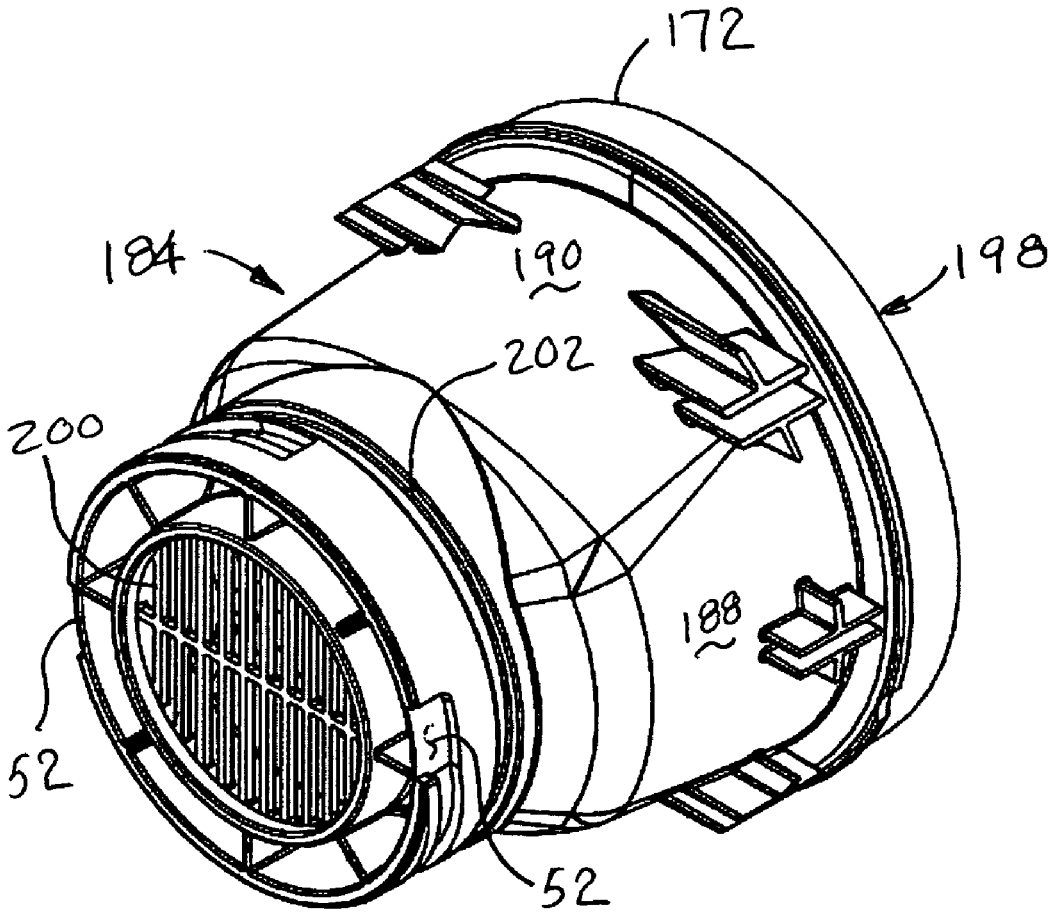
FIG. 52 is a perspective view of a main turbine housing useful in the practice of the present invention.
Figure 54:
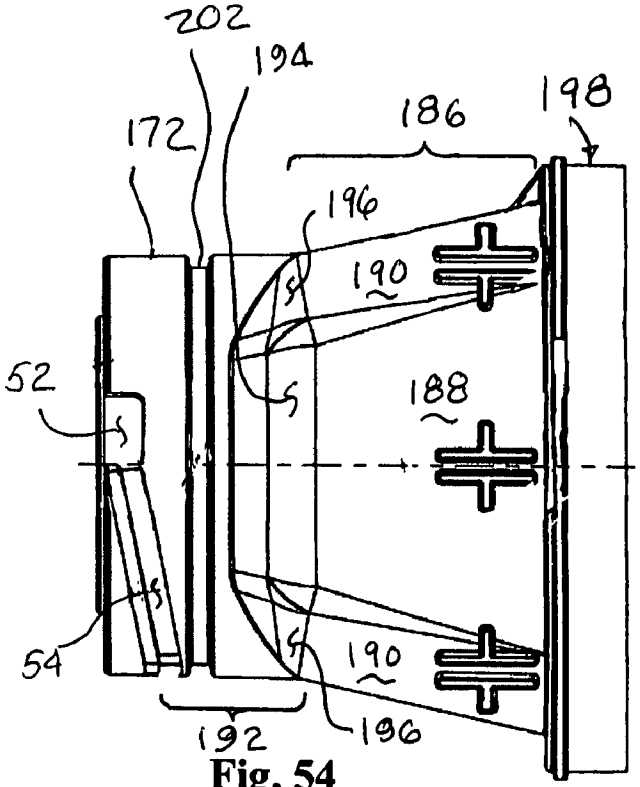
FIG. 54 is a side view of the main turbine housing of FIG. 52.
Figure 53:
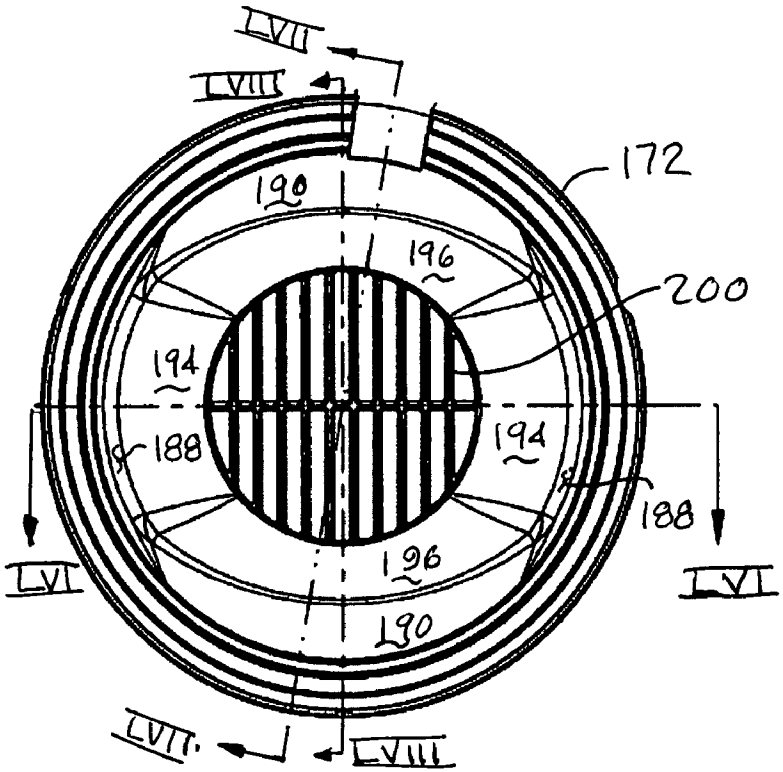
FIG. 53 is an end view of the main turbine housing of FIG. 52.
Figure 56:
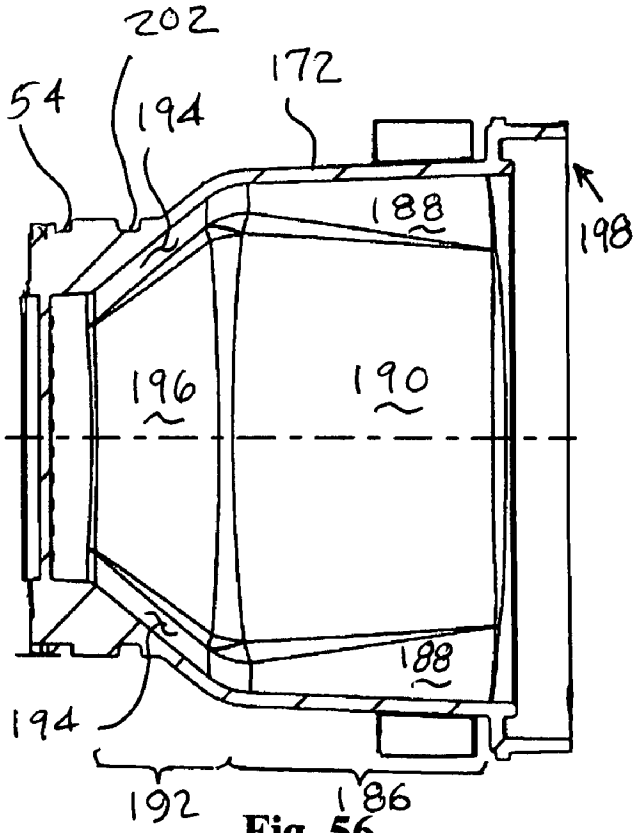
FIG. 56 is a section view along line LVI-LVI of FIG. 53.
Figure 55:
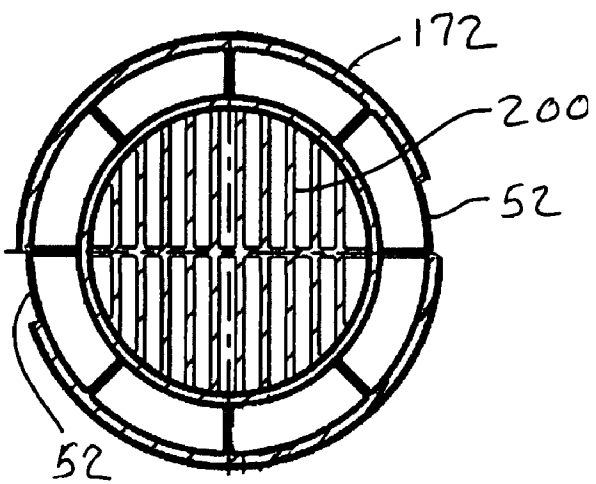
FIG. 55 is a section view along line LV-LV of FIG. 58.
Figure 58:
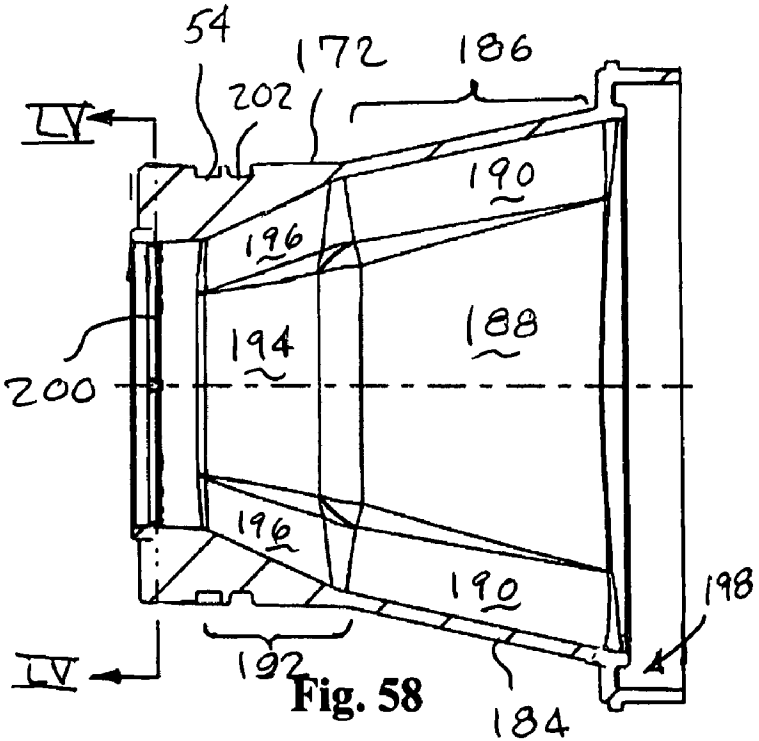
FIG. 58 is a section view along line LVIII-LVIII of FIG. 53.
Figure 57:
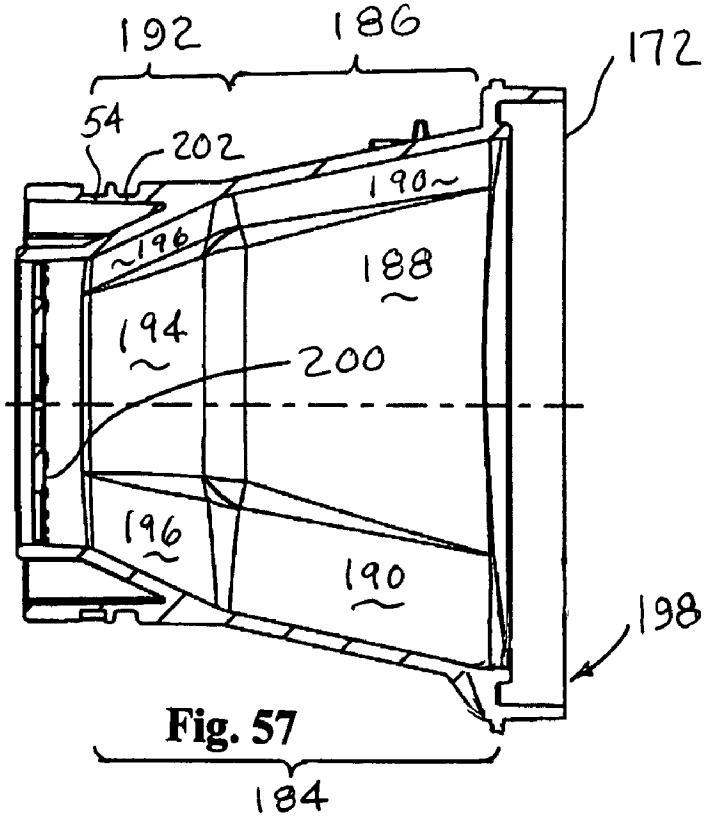
FIG. 57 is a section view along line LVII-LVII of FIG. 53.

Referring now to FIGS. 51-64, and most particularly to FIG. 51, various views of the parts of the air source 20 may be seen. Air source 20 preferably includes a turbine 170. Air source 20 may also include a main turbine housing 172, and left and right turbine covers 174, 176. Air source may also include O-ring 56, located on the outside forward end of the main turbine housing (see FIGS. 7 and 8) and another O-ring 178 to seal the turbine 170 to the main turbine housing 172. Air source 20 may additionally include an ON-OFF switch 180 and a power cord 182. It is to be understood that wiring between the cord 182, switch 180 and turbine 170 has been omitted from FIG. 51 to aid in the illustration of parts shown, and includes conventional electrical connections between those parts, as is well known, with the switch in series between the cord 182 and a motor of the turbine 170.

Referring now most particularly to FIGS. 52-58, various views of the main turbine housing 172 may be seen. Housing 172 has a somewhat faceted conical side wall 184, with a first axial section 186 made up of first and second circumferential segment pairs 188, 190 and a second axial section 192, with third and fourth circumferential segment pairs 194, 196. Housing 172 has a stepped inlet 198 sized and positioned to receive the O-ring 178 and turbine 170, and a grill 200 forming a porous outlet wall to allow air flow therethrough. Grill 200 also prevents a user's fingers from entering the main turbine housing 172 when the air source is removed from the body 22 of the sprayer 12. Housing 172 also has a circumferential groove 202 to receive and retain O-ring 56. Housing 172 may be made of a suitable relatively rigid polymer such as polypropylene.

Figure 59:
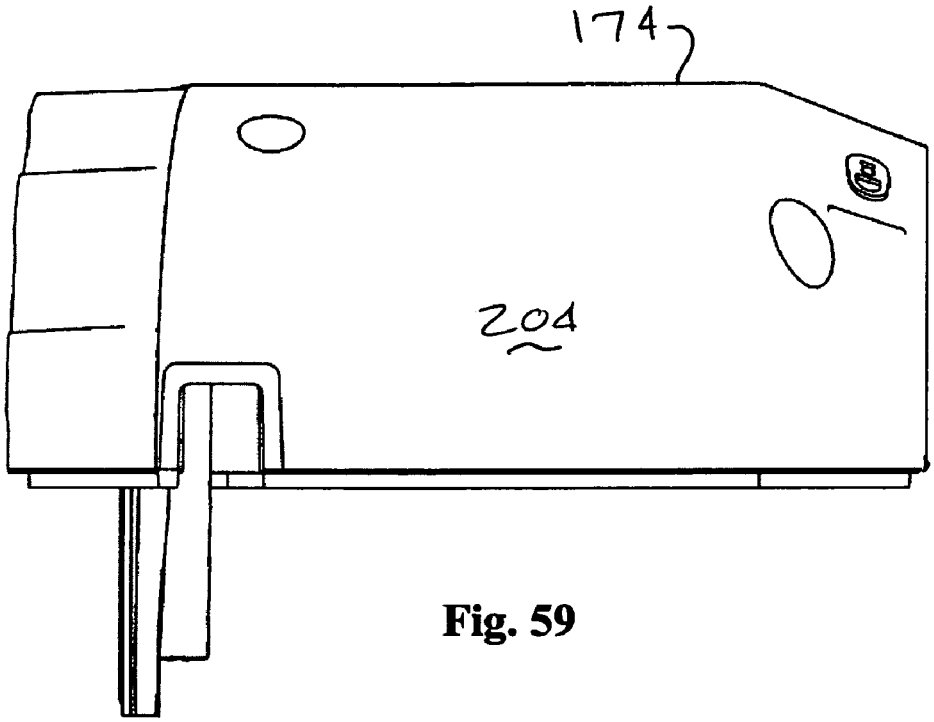
FIG. 59 is a top view of a left turbine cover useful in the practice of the present invention.
Figure 60:
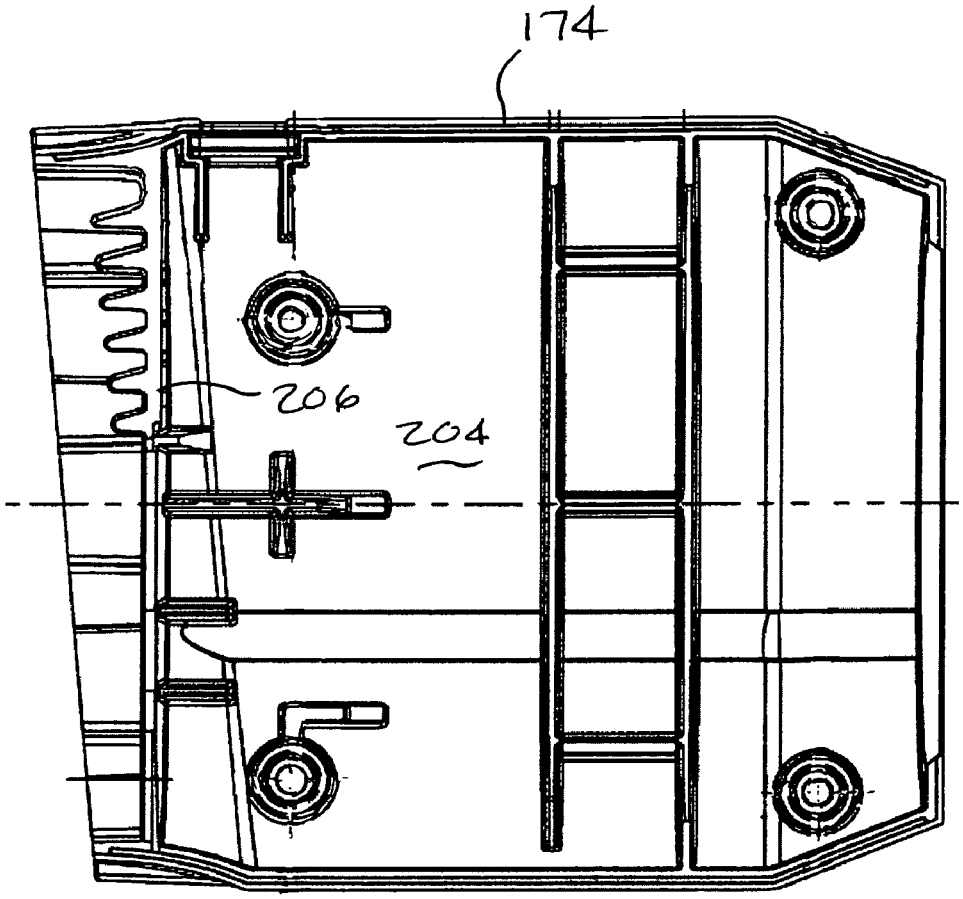
FIG. 60 is a side elevation view of the interior of the left turbine cover of FIG. 59.
Figure 61:
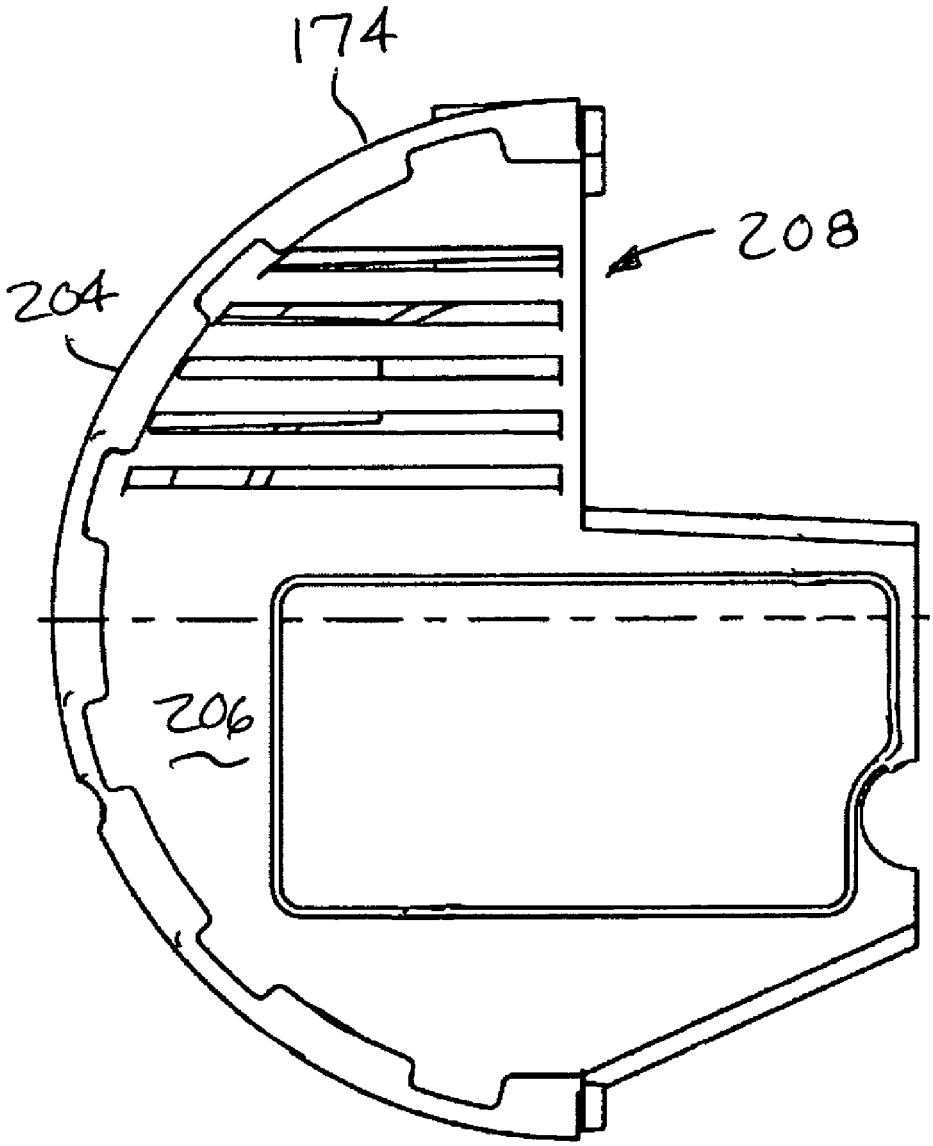
FIG. 61 is a rear elevation view of the left turbine cover of FIG. 59.
Figure 62:
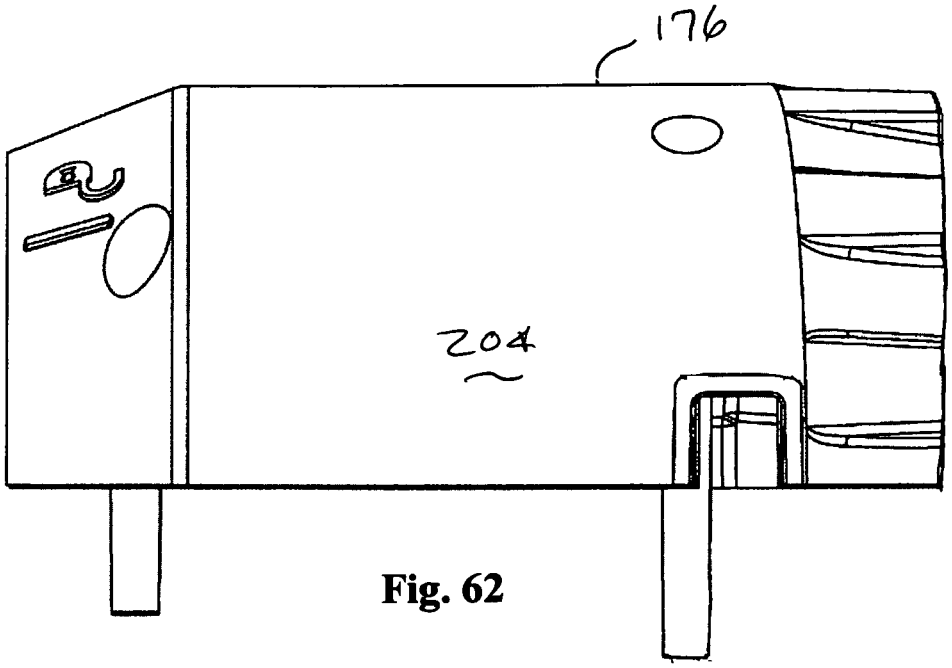
FIG. 62 is a top view of a right turbine cover useful in the practice of the present invention.
Figure 63:
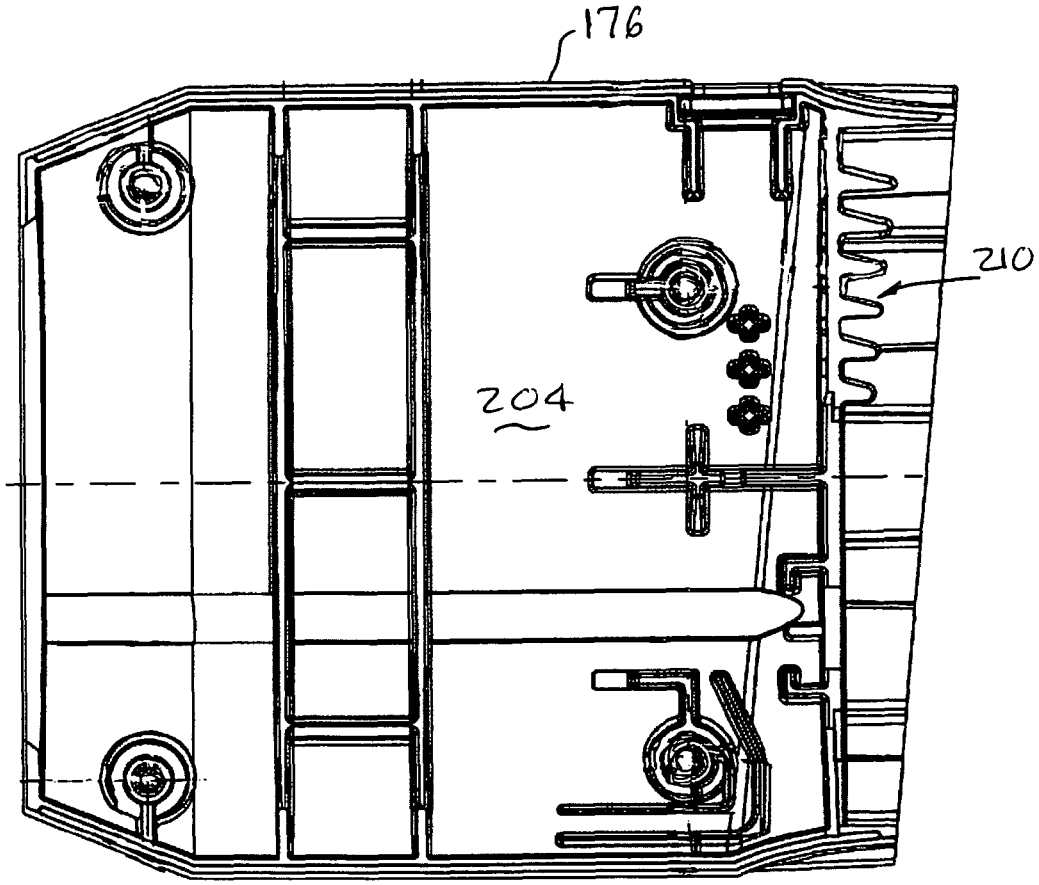
FIG. 63 is a side elevation view of the interior of the right turbine cover of FIG. 62.
Figure 64:
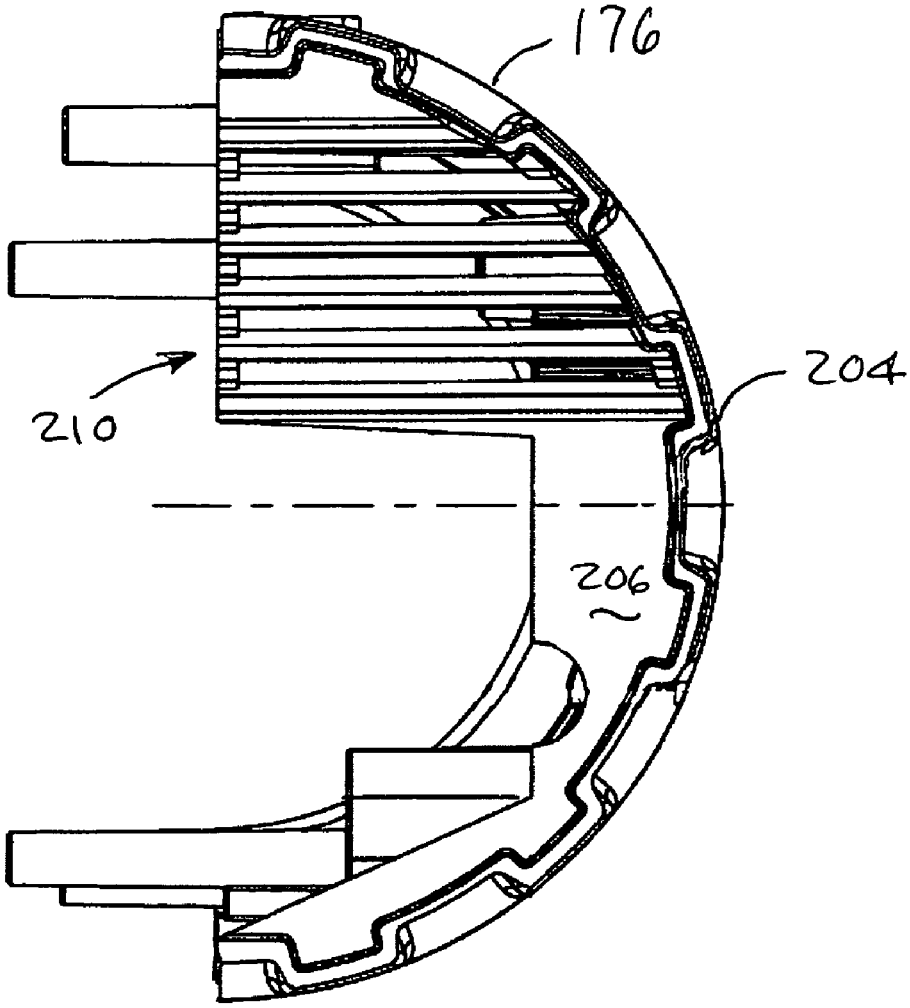
FIG. 64 is a rear elevation view of the right turbine cover of FIG. 62.

Referring now to FIGS. 59-64, various views of the left and right turbine covers 174, 176 may be seen. The left turbine cover 174 is shown in FIGS. 59-61, and the right turbine cover 176 is shown in FIGS. 62-64. Covers 174 and 176 together provide a generally cylindrical sidewall 204, and a recessed rear wall 206 having louvers 208 and 210 to admit air to the turbine 170. Covers 174 and 176 may be made of a suitable relatively rigid polymer such as polypropylene.

Referring now to FIGS. 65-70, various views and details of the left gun shell half 94 may be seen. It is to be understood that the right gun shell half 96 corresponds to the left gun shell half, such that the two halves 94 and 96 together form at least a portion of the body 22 of the sprayer 12. Left gun shell half 94 includes a pistol grip portion 212 connected to a main housing portion 214, which in turn is connected to an arm rest portion 216. Main housing portion 214 also includes a texture material inlet portion 218. Pistol grip portion 212 together with a mating portion from the right gun shell half 96 and the handle insert forms the pistol grip 28. Main housing portion 214 together with a mating portion from the right gun shell half 96 provides a housing and support for the nozzle plate 98 and chassis 49. Arm rest portion 216 together with a mating portion from the right gun shell half 96 and an arm rest insert 220 (see FIG. 71) form the arm rest 38. Texture material inlet portion 218 together with a mating portion from the right gun shell half 96 and fitting 59 of the hopper 24 forms the material connection structure 58.

Figure 65:
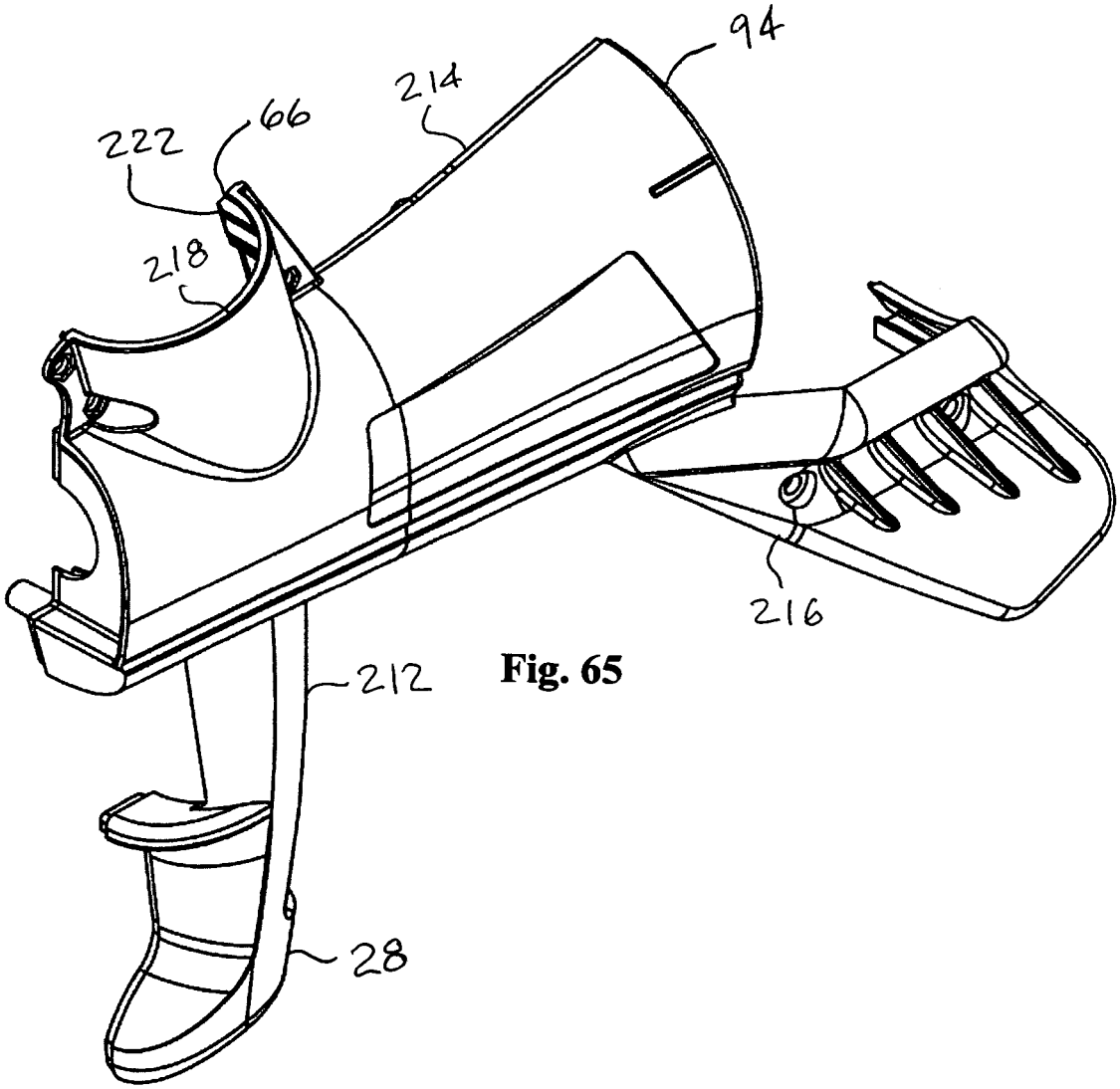
FIG. 65 is a perspective view of a left turbine gun shell useful in the practice of the present invention.
Figure 67:
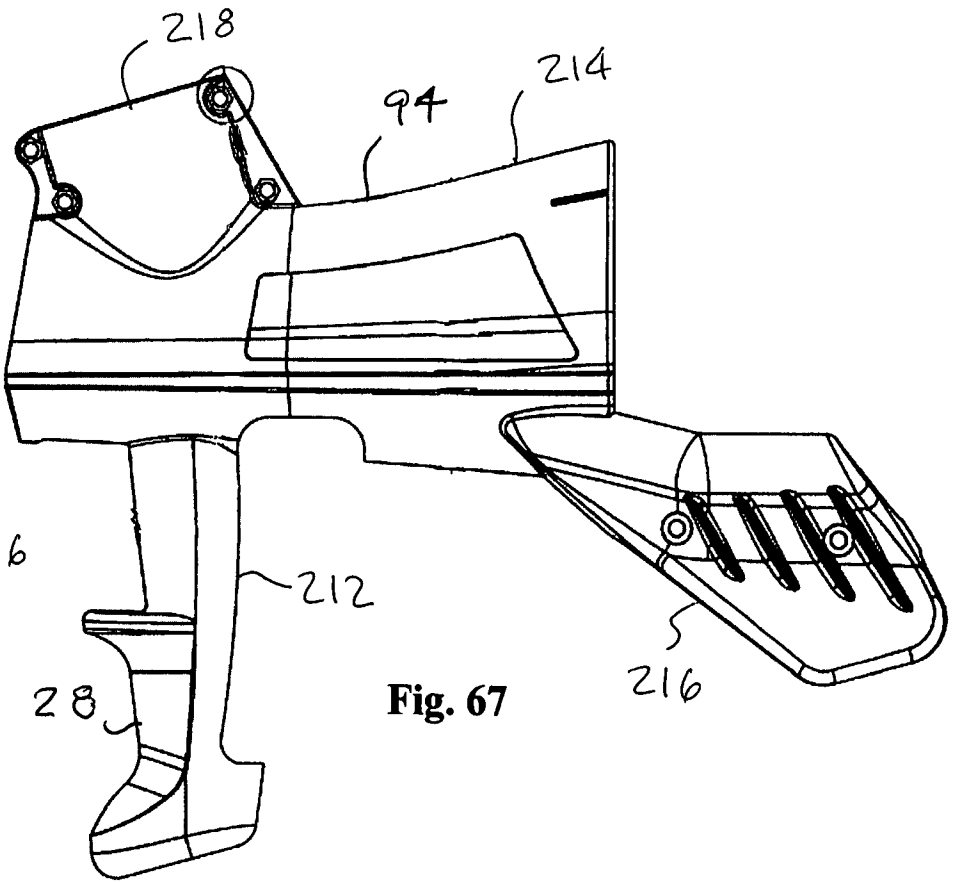
FIG. 67 is a side elevation view of the exterior of the left turbine gun shell of FIG. 65.
Figure 66:
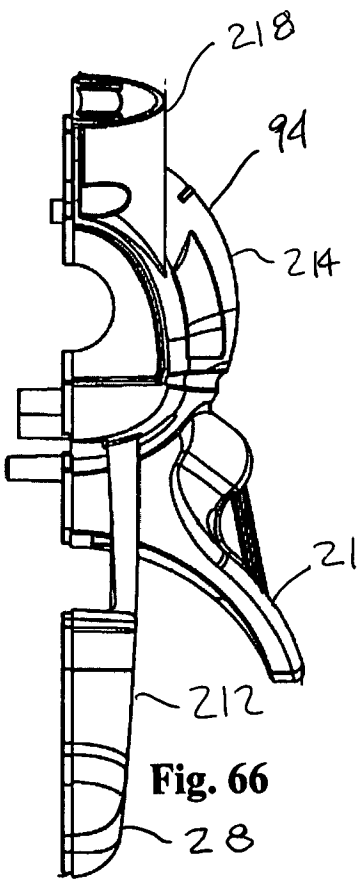
FIG. 66 is a front elevation view of the left turbine gun shell of FIG. 65.
Figure 68:
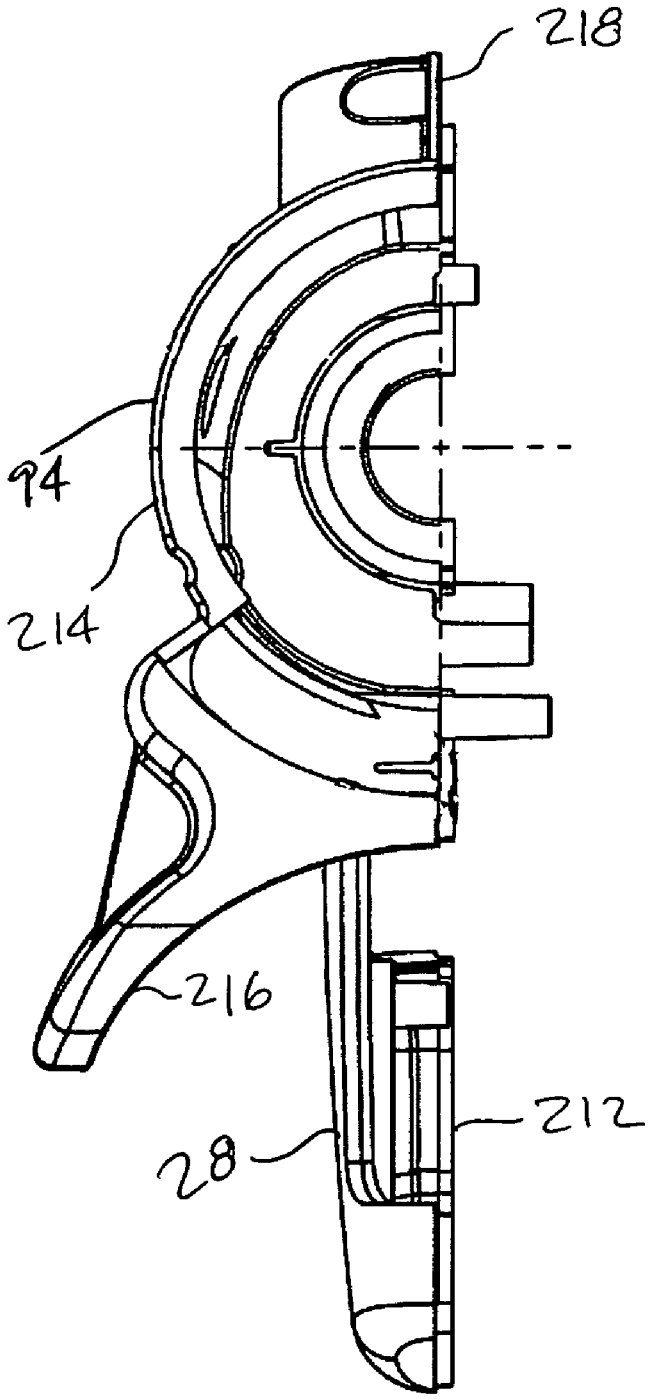
FIG. 68 is a rear elevation view of the left turbine gun shell of FIG. 65.
Figure 70:
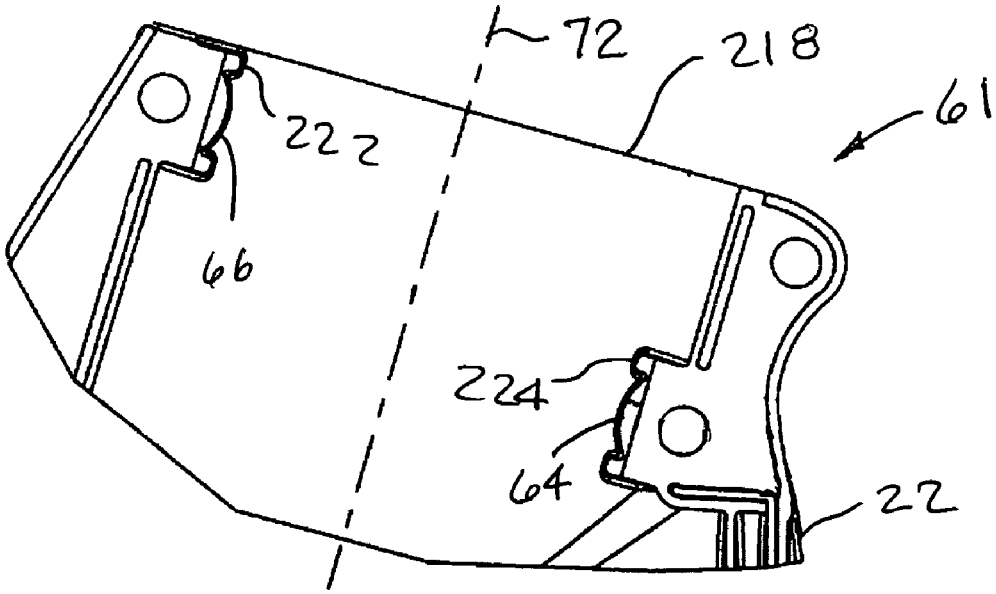
FIG. 70 is an enlarged view of detail LXX of FIG. 69.
Figure 71:
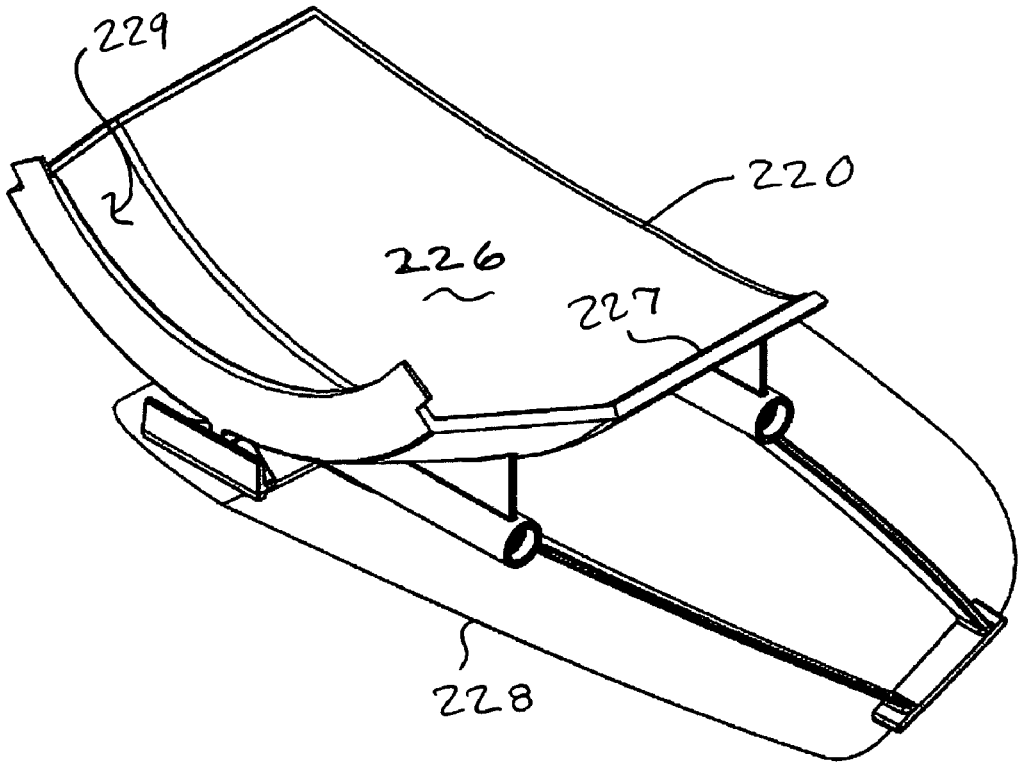
FIG. 71 is a perspective view of an arm insert useful in the practice of the present invention.
Figure 72:
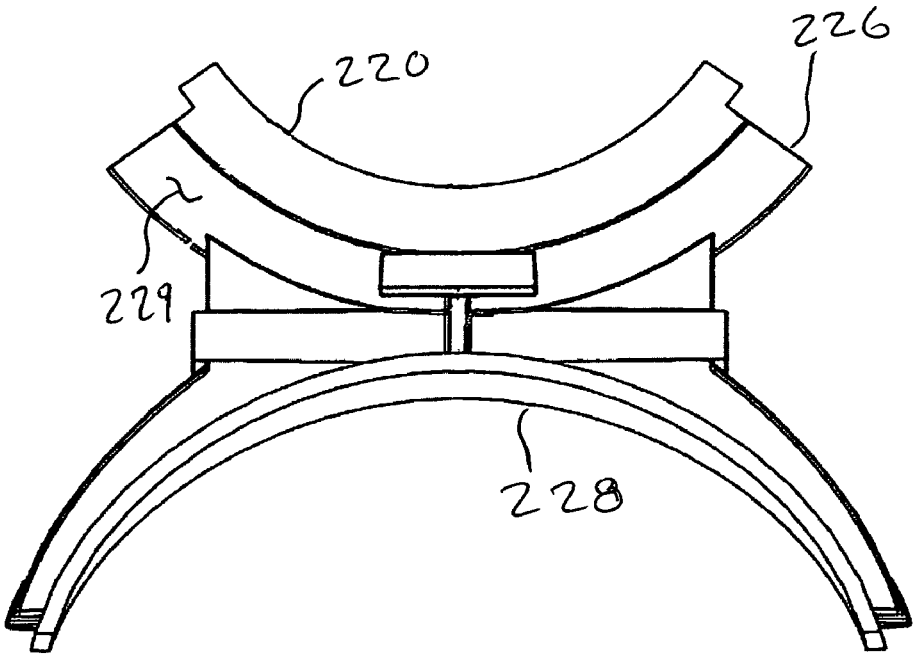
FIG. 72 is a front elevation view of the arm insert of FIG. 71.
Figure 73:
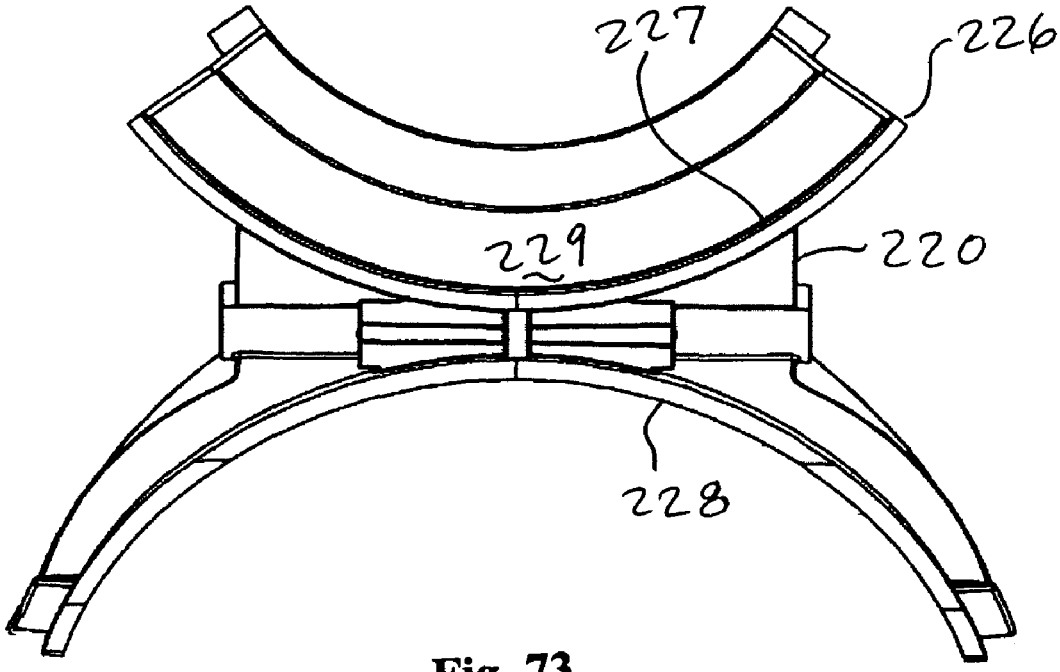
FIG. 73 is a rear elevation view of the arm insert of FIG. 71.
Figure 74:
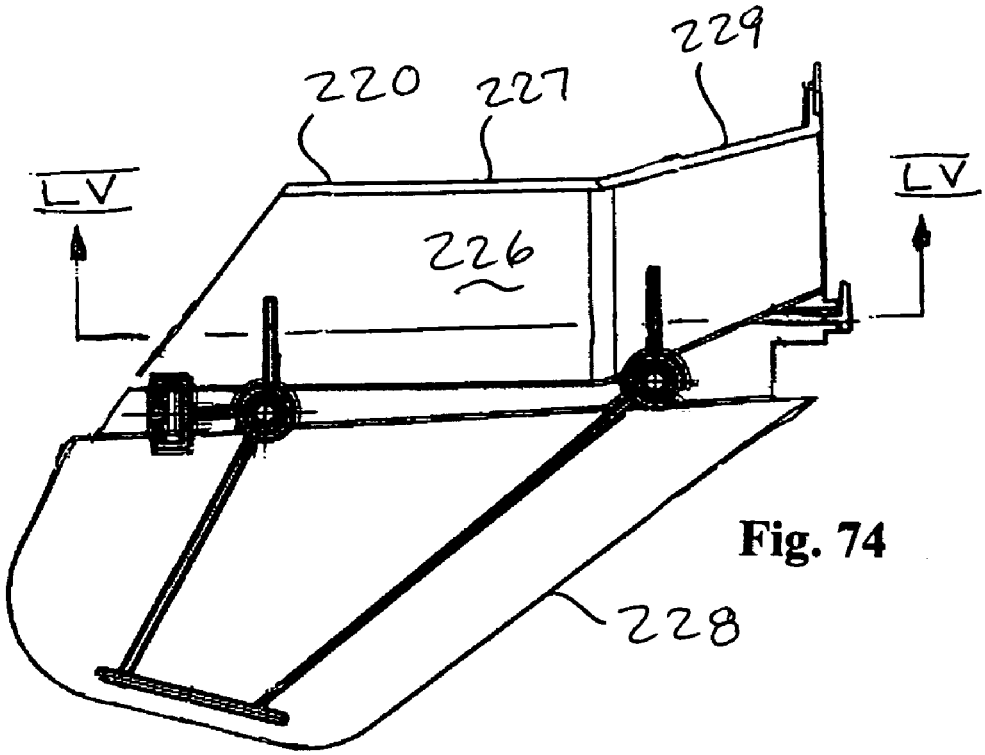
FIG. 74 is a side elevation view of the arm insert of FIG. 71.
Figure 75:
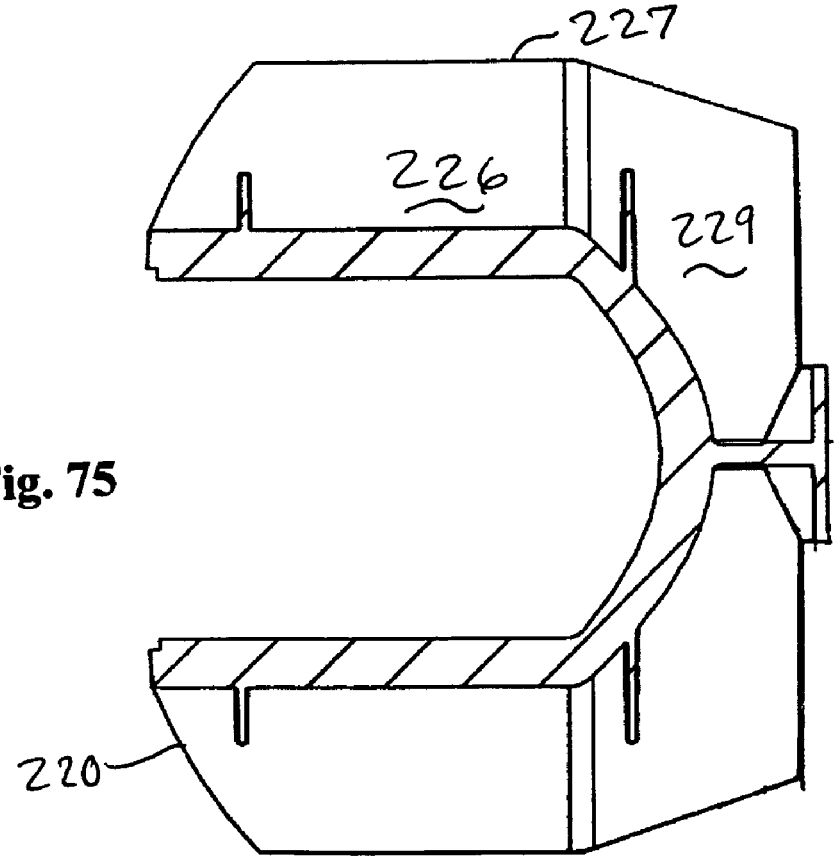
FIG. 75 is a section view taken along line LV-LV of FIG. 74.
Figure 81:
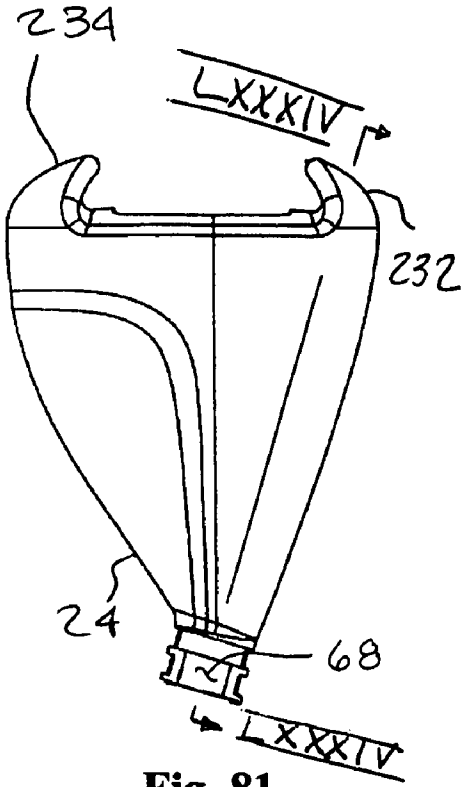
FIG. 81 is a second side elevation view of the hopper of FIG. 76.
Figure 80:
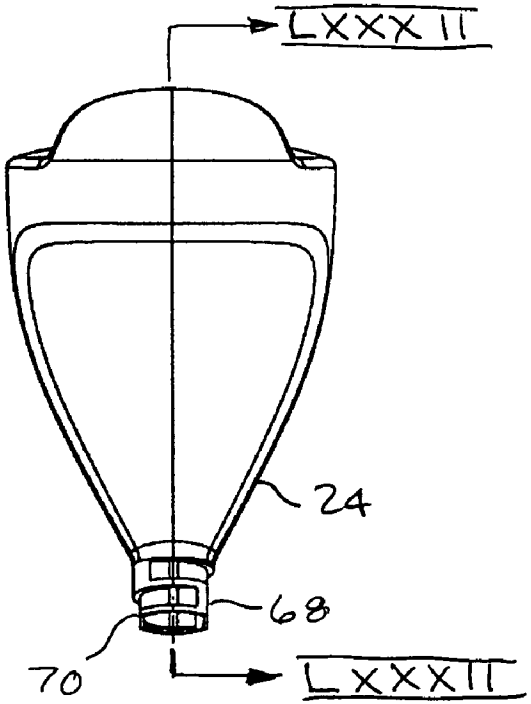
FIG. 80 is a rear elevation view of the hopper of FIG. 76.
Figure 79:
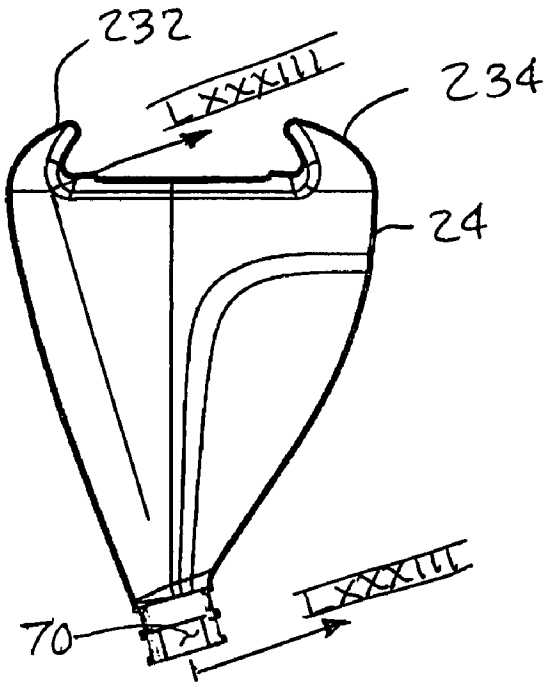
FIG. 79 is a first side elevation view of the hopper of FIG. 76.
Figures 82, 83, 84:
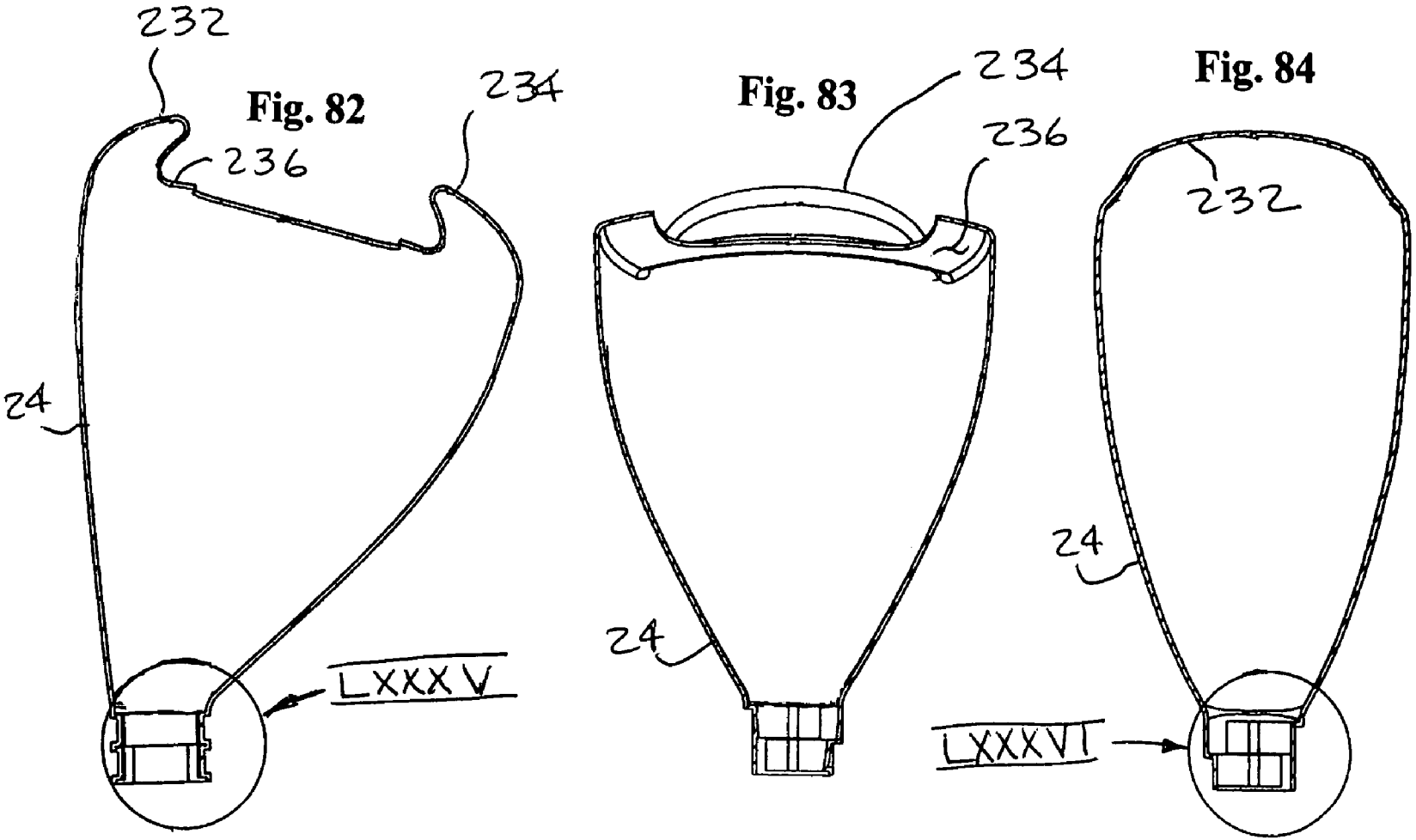
FIG. 82 is a section view taken along line LXXXII-LXXXII of FIG. 80.
FIG. 83 is a section view taken along line LXXXIII-LXXXIII of FIG. 79.
FIG. 84 is a section view taken along line LXXXIV-LXXXIV of FIG. 81.
Figure 85:
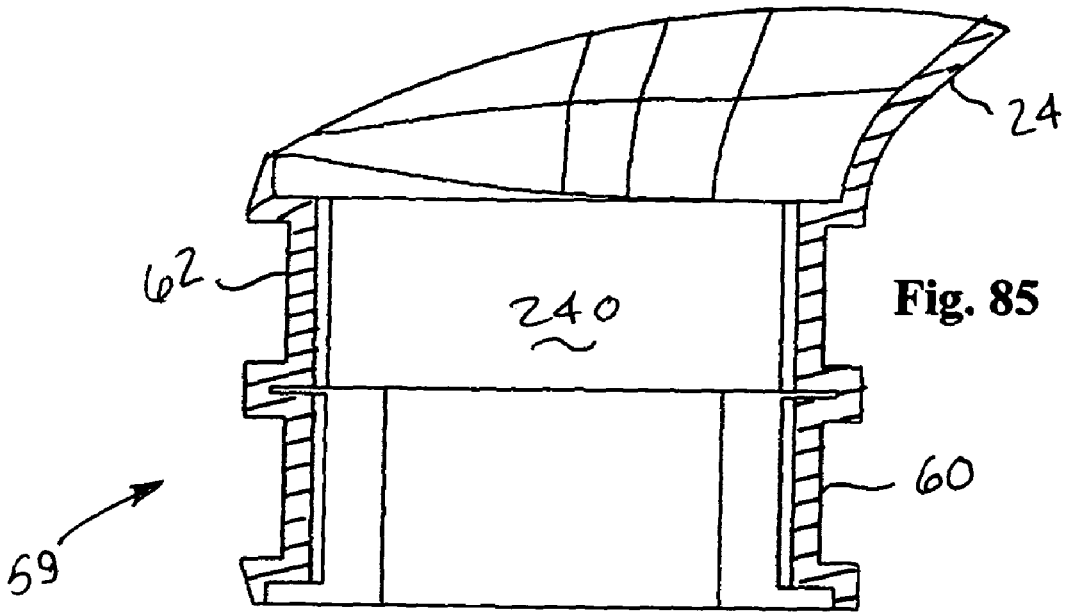
FIG. 85 is an enlarged view of detail LXXXV of FIG. 82.
Figure 86:
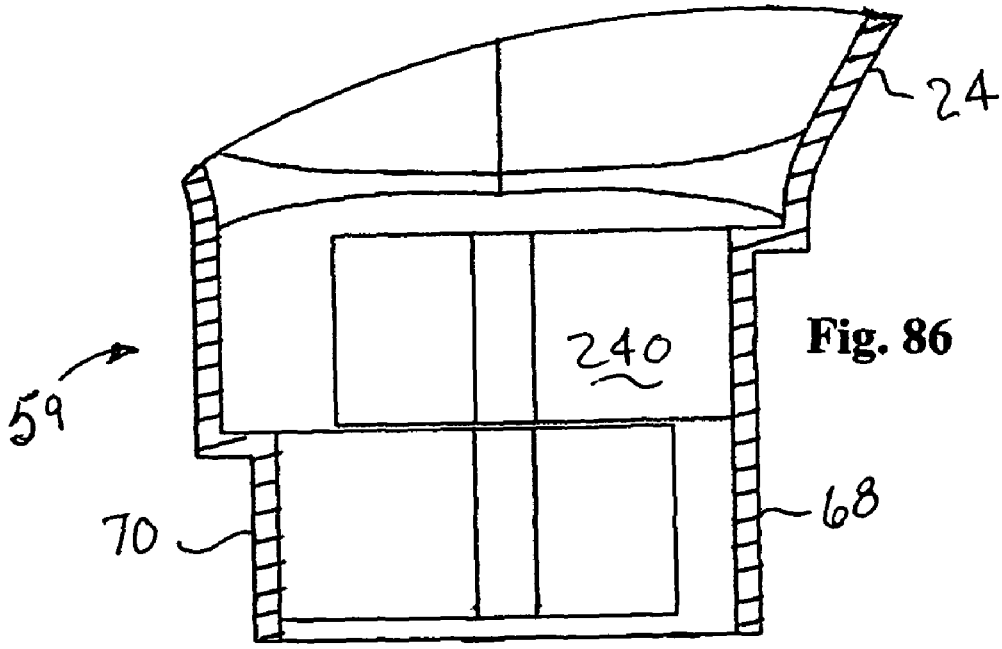
FIG. 86 is an enlarged view of detail LXXXVI of FIG. 84.
Figure 87:
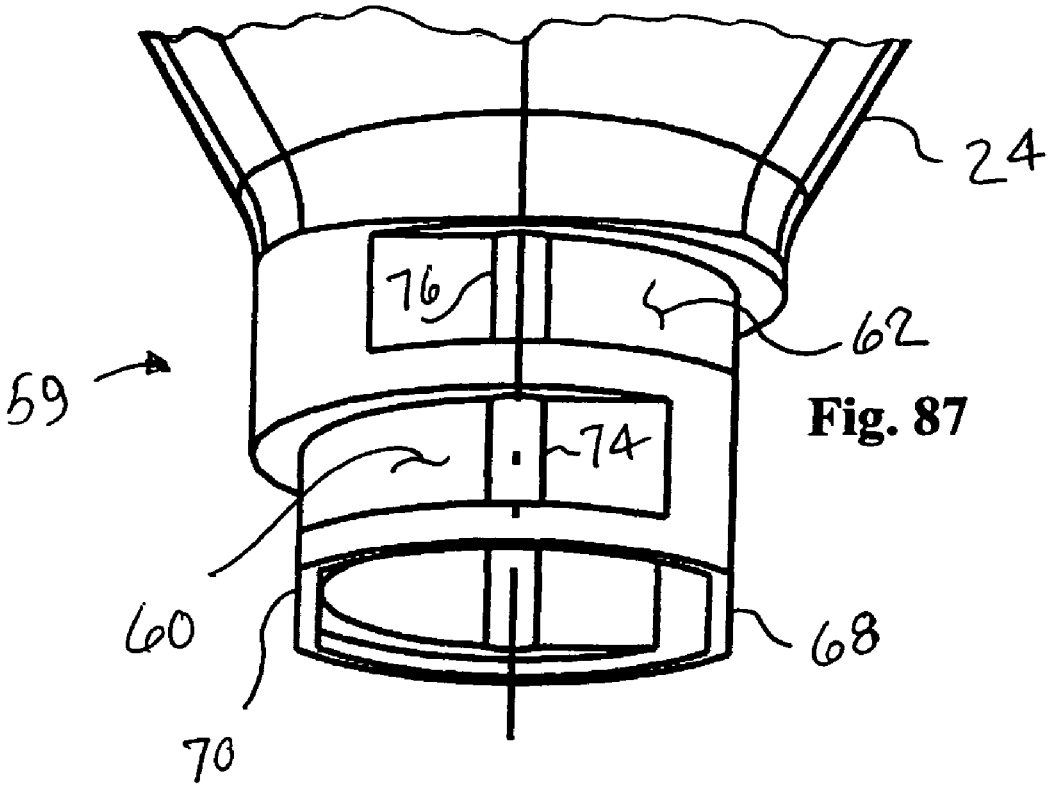
FIG. 87 is an enlarged fragmentary perspective view of a coupling end of the hopper of FIG. 76.
Figure 88:
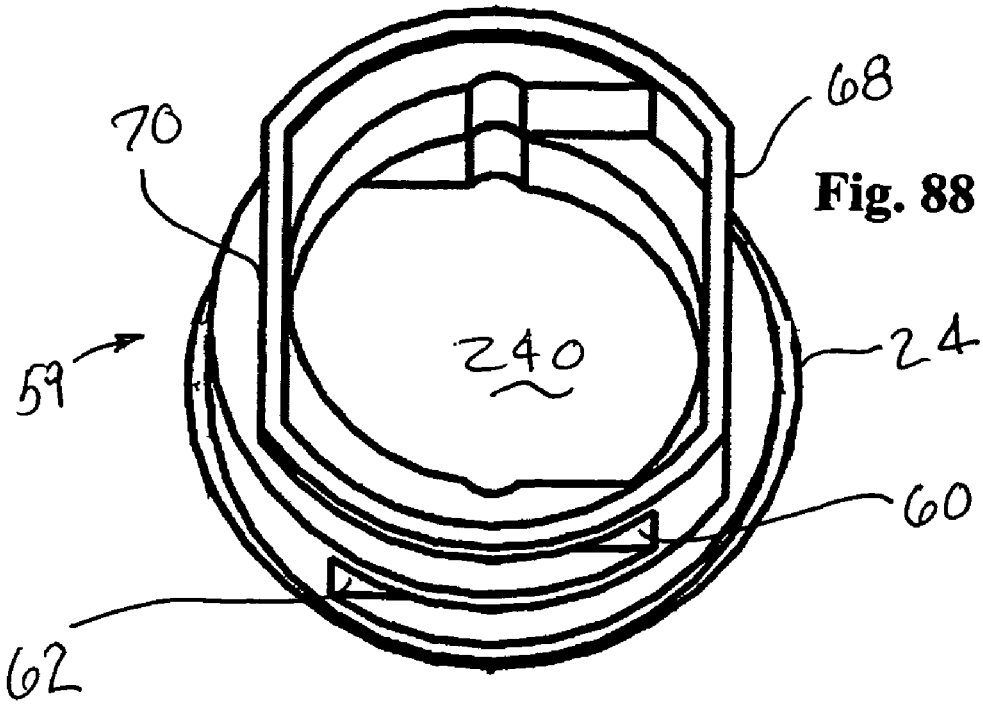
FIG. 88 is an enlarged view of the coupling end of the hopper from FIG. 77.

Referring most particularly to FIGS. 65 and 70 as well as referring again to FIG. 9, the texture material inlet portion 218 includes the first and second projections 64 and 66. From FIG. 65 it can be seen that the second projection 66 (together with a mating extension in the right gun shell half) will form an upper flat surface 222 extending across a throat of the fitting 61 forming the body-side portion of the material connection structure 58. The first projection 64 forms a similar flat surface 224 diametrically opposite and offset lower along axis 72. These upper and lower flat surfaces 222 and 224 will mate with and allow passage of fitting 59 (on the hopper 24) into fitting 61 (on the body 22) when the flat 68 is aligned with lower flat surface 224 and flat 70 is aligned with upper flat surface 222. After insertion axially along axis 72, the hopper 24 is preferably rotated either clockwise or counter clockwise with respect to the body 22 to lock the hopper in one of the positions shown in FIGS. 3 or 4. Right and left gun shell halves 94, 96 may preferably be formed of polypropylene.

Referring now to FIGS. 71-75, the arm rest insert 220 may be seen in various views. Insert 220 may also be formed of polypropylene and provides an option to have contrasting colors between the arm rest portion 216 and the arm rest insert 220. Insert 220 may have an arcuate upper portion 226 with a cylindrical segment 227 to nest with and support the cylindrical sidewall 204 of the air source 16, (and a conical segment 229 to nest with the conical end of sidewall 204) when air source 16 is installed in the texture sprayer. Insert 220 also may include an arcuate lower surface 228 for the legs 30 and 32 of the arm rest 38.

Referring now to FIGS. 76-88, various views and features of the hopper 24 may be seen. Hopper 24 may be made of a high density polyethylene such as is available under the trademark Marlex, type HHM 5502, from the Chevron Phillips Chemical Company. The hopper 24 preferably has an asymmetrical fore and aft cone profile and cross section and a symmetrical tapered transverse cone profile and cross section. A pair of enlarged protuberances 232, 234 are formed in the fore and aft regions of a top surface 236 of the hopper 24. A large aperture 238 is formed in the top surface 236 to permit loading the hopper with texture material, and the fitting 59, located at the bottom of the hopper 24, is hollow with a small aperture 240 to enable delivery of texture material contained in the hopper 24 to the texture sprayer 12 as needed during texture spraying.

Figure 89:
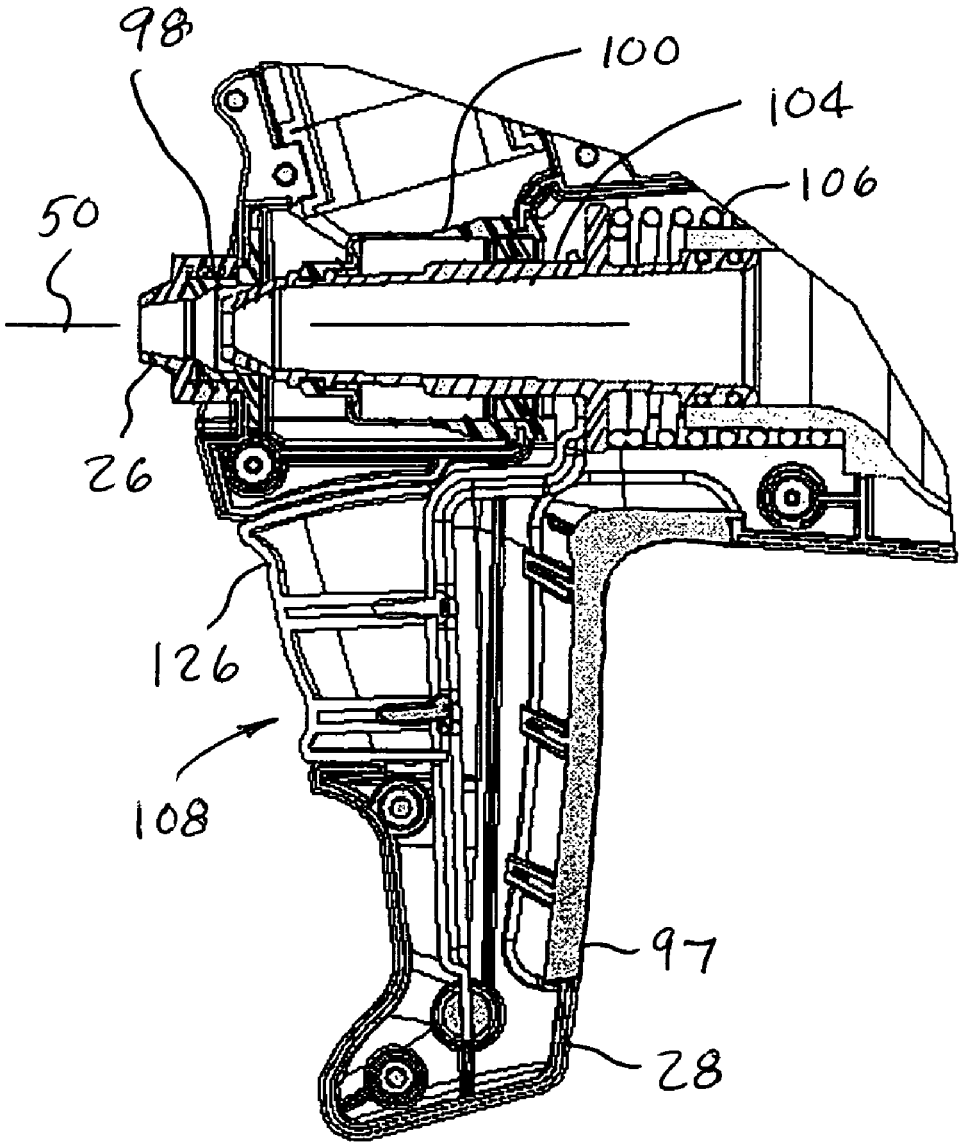
FIG. 89 is a fragmentary section view of the texture apparatus of the present invention shown in a first position with the trigger released and illustrating a non-spraying condition.
Figure 90:
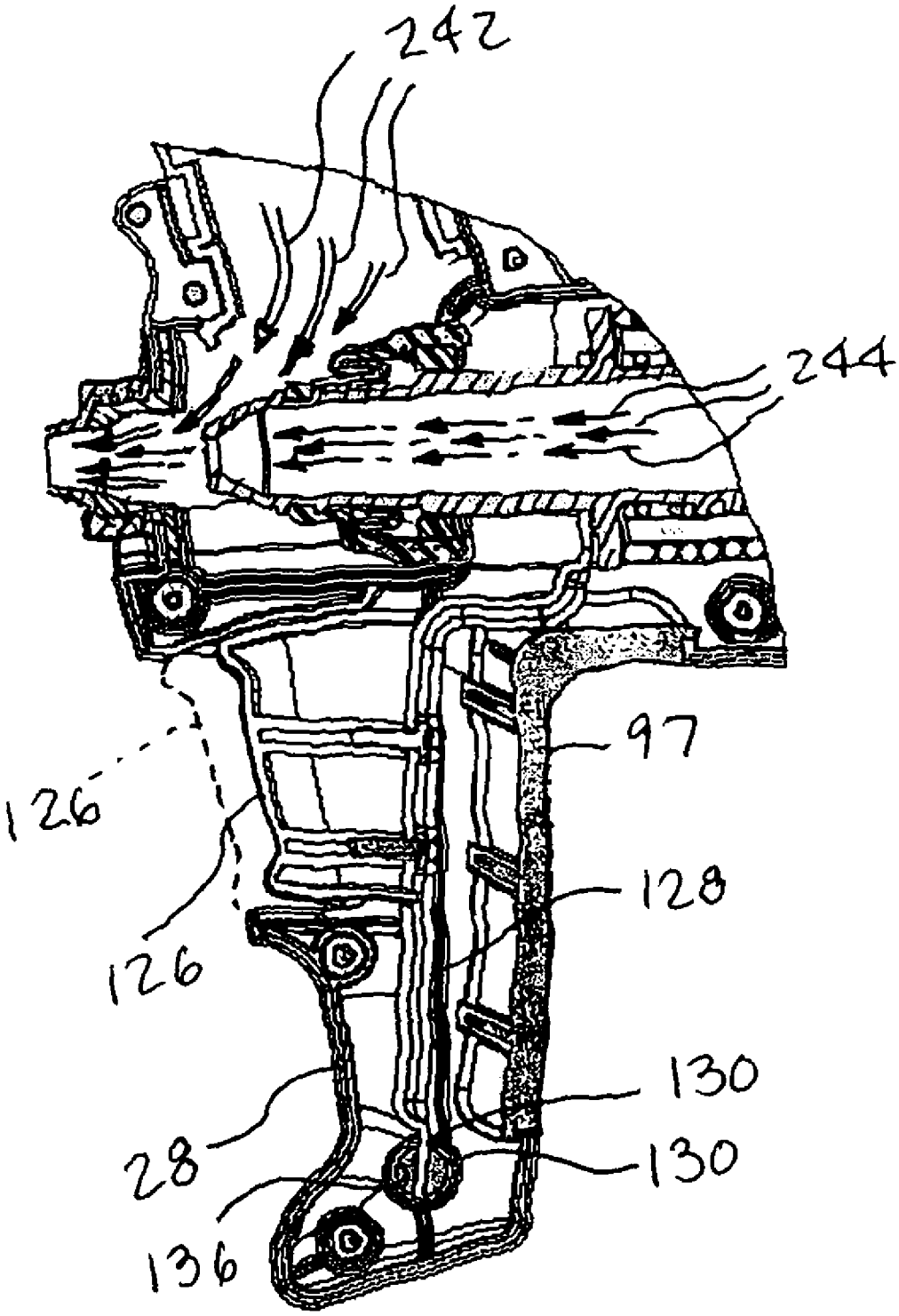
FIG. 90 is a fragmentary section view similar to that of FIG. 89, except showing a second position for parts with the trigger actuated and illustrating a texture spraying condition.
Figure 91:
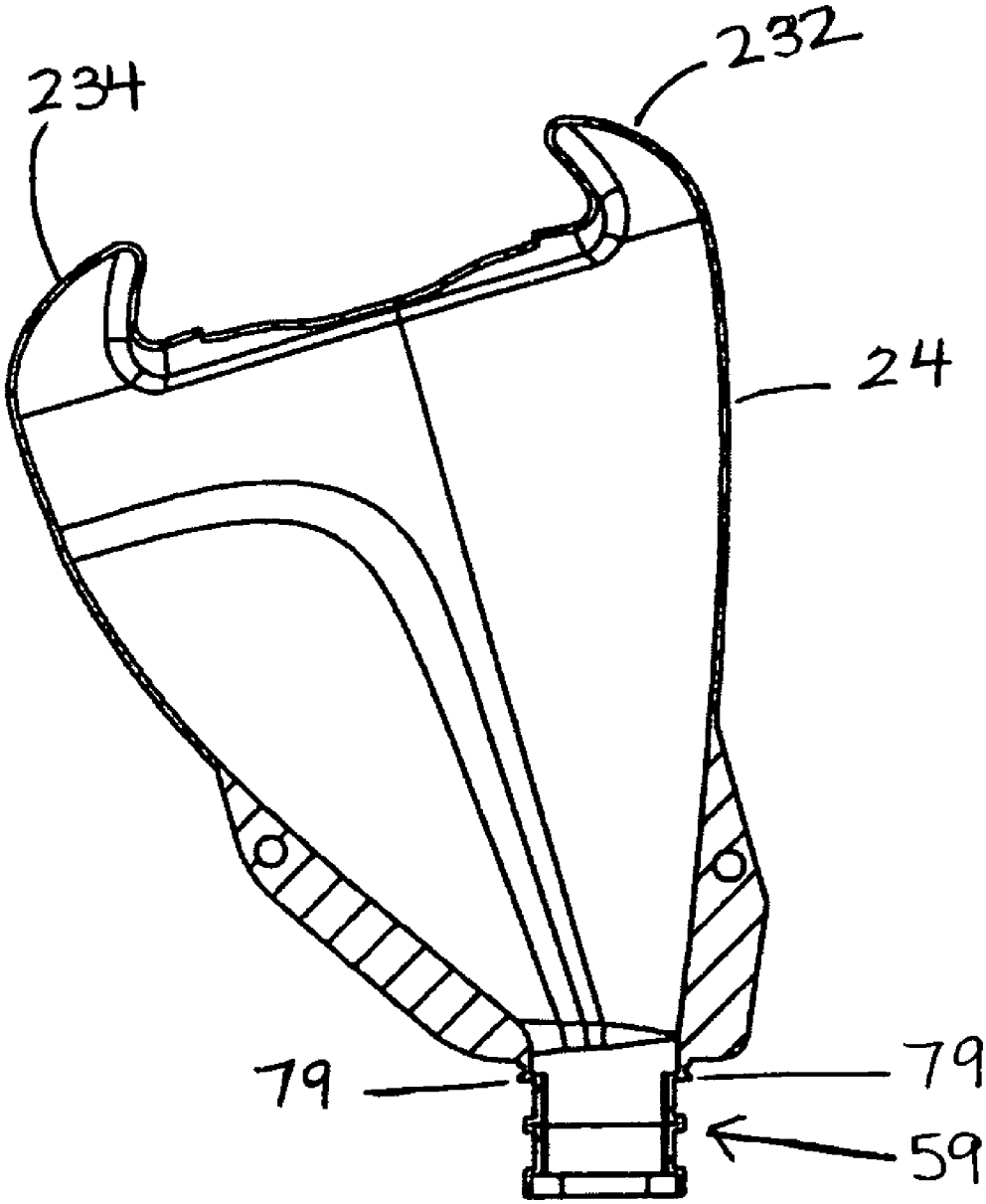
FIG. 91 is a sectional side view of one embodiment of the hopper useful in the practice of the present invention.
Figure 92:
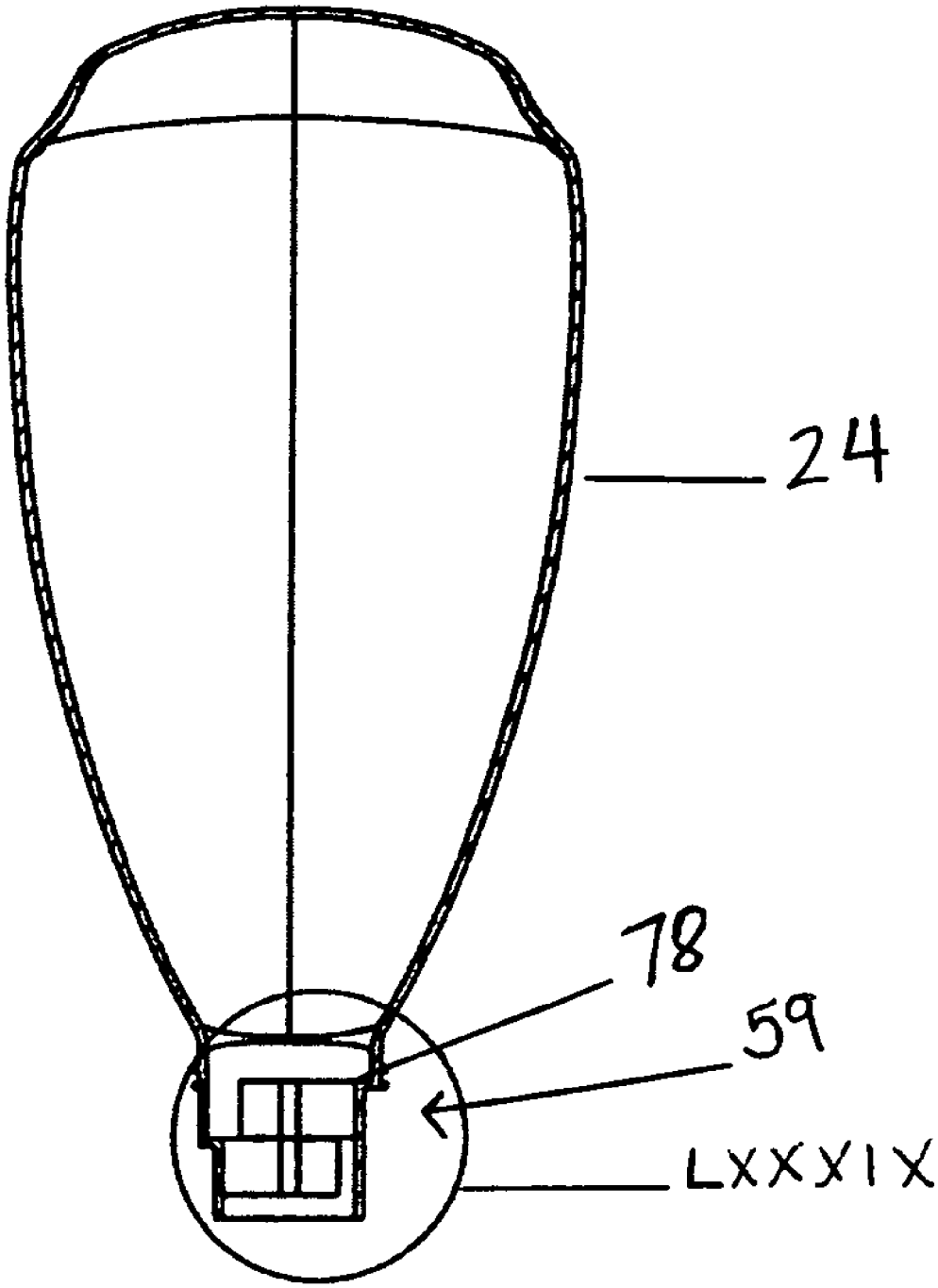
FIG. 92 is a sectional rear view of the hopper of FIG. 91 with an O-ring.
Figure 93:
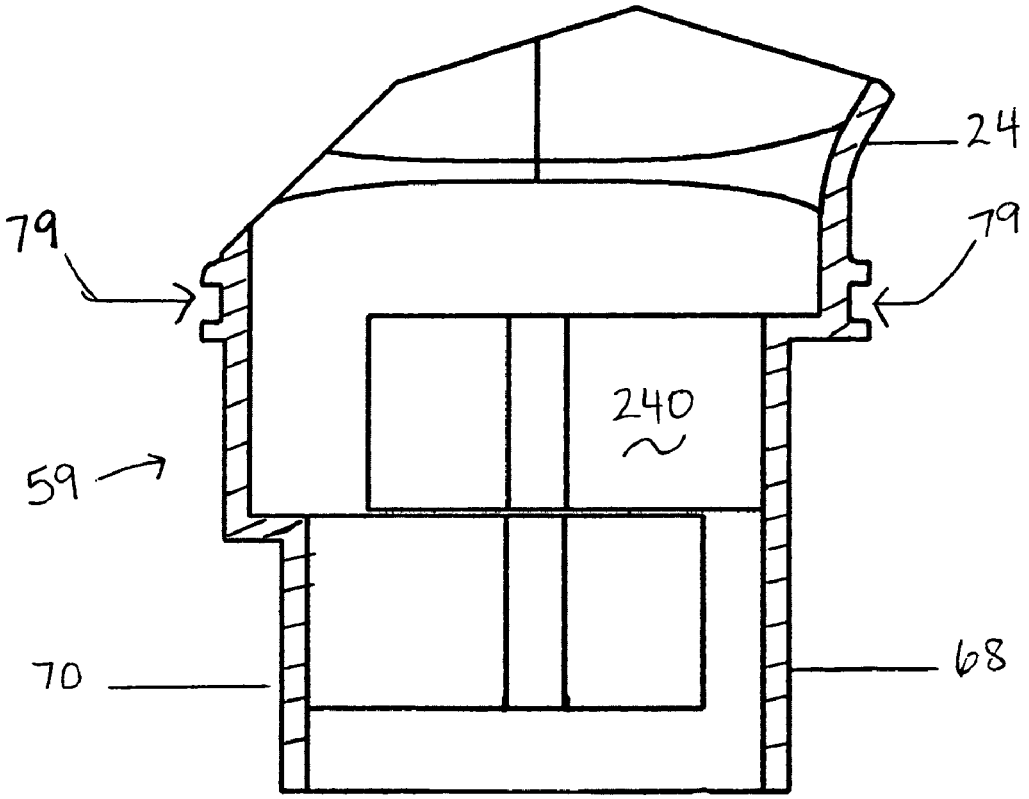
FIG. 93 is an enlarged view of detail LXXXIX of FIG. 92.
Figure 94:
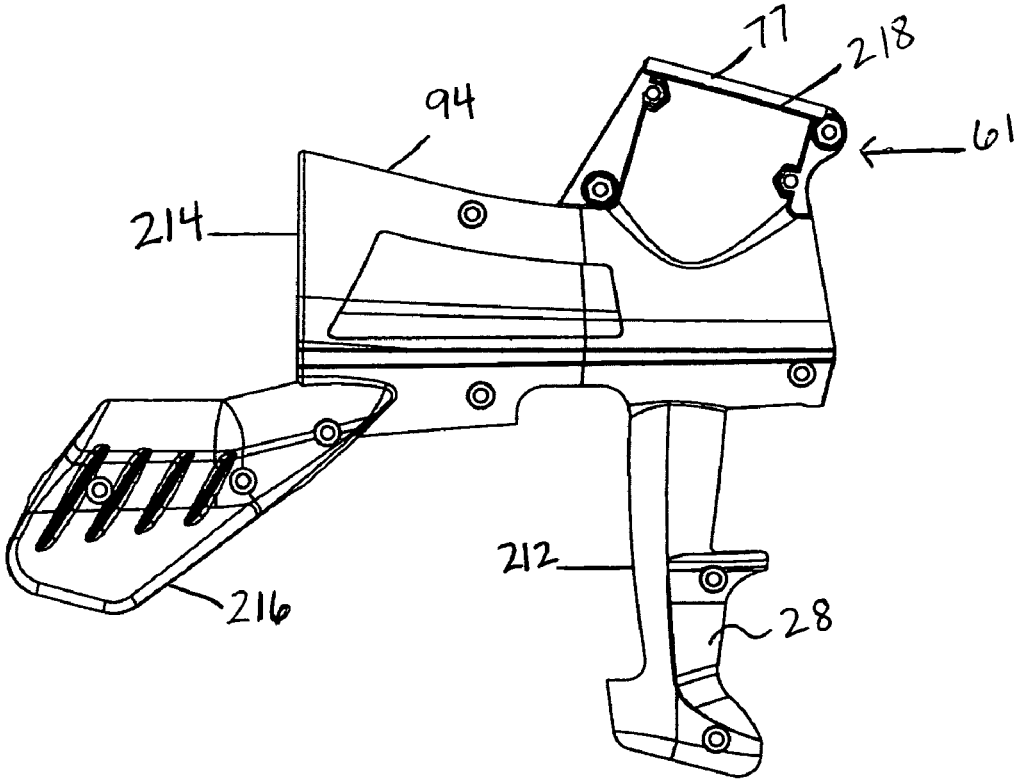
FIG. 94 is a side elevation view of the exterior of a right turbine gun shell.
Figure 95:
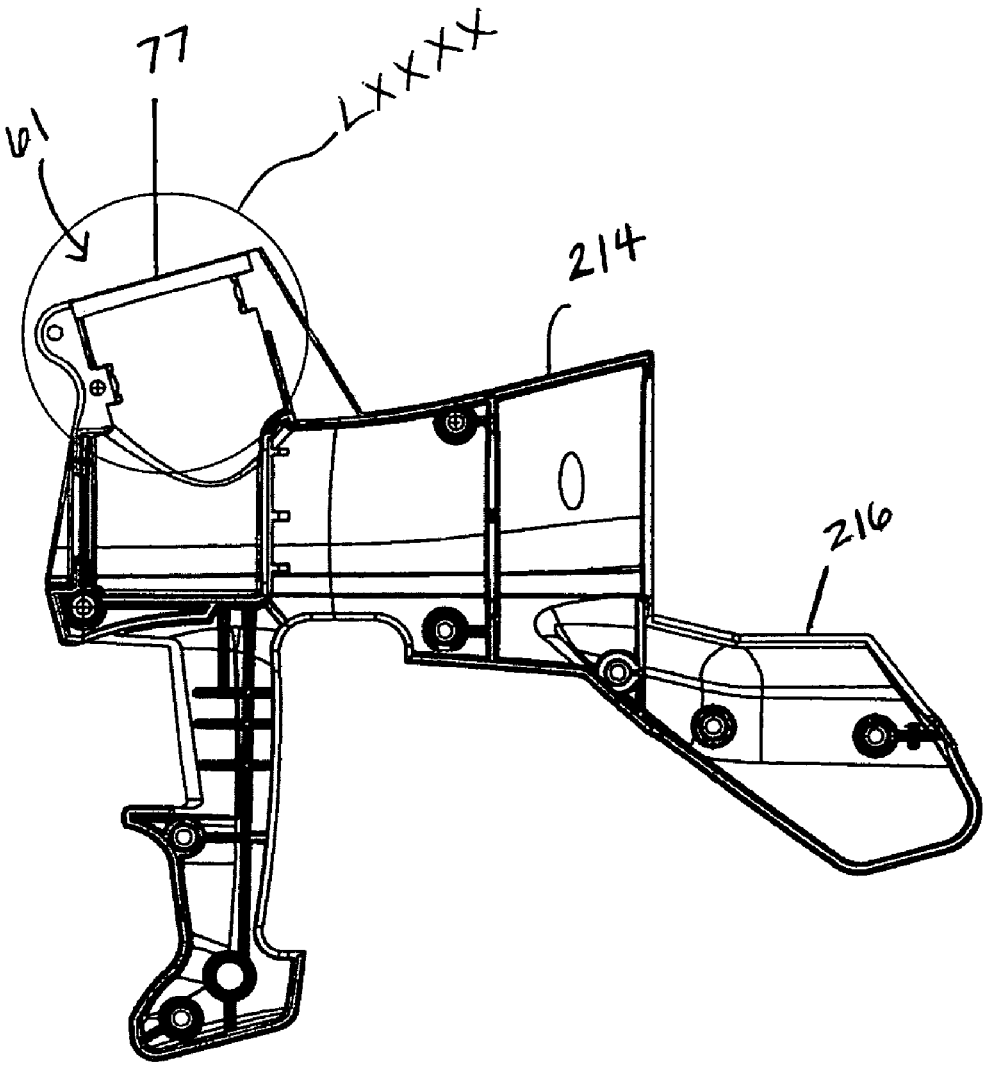
FIG. 95 is a side elevation view of the interior of the right turbine gun shell of FIG. 94.
Figure 96:
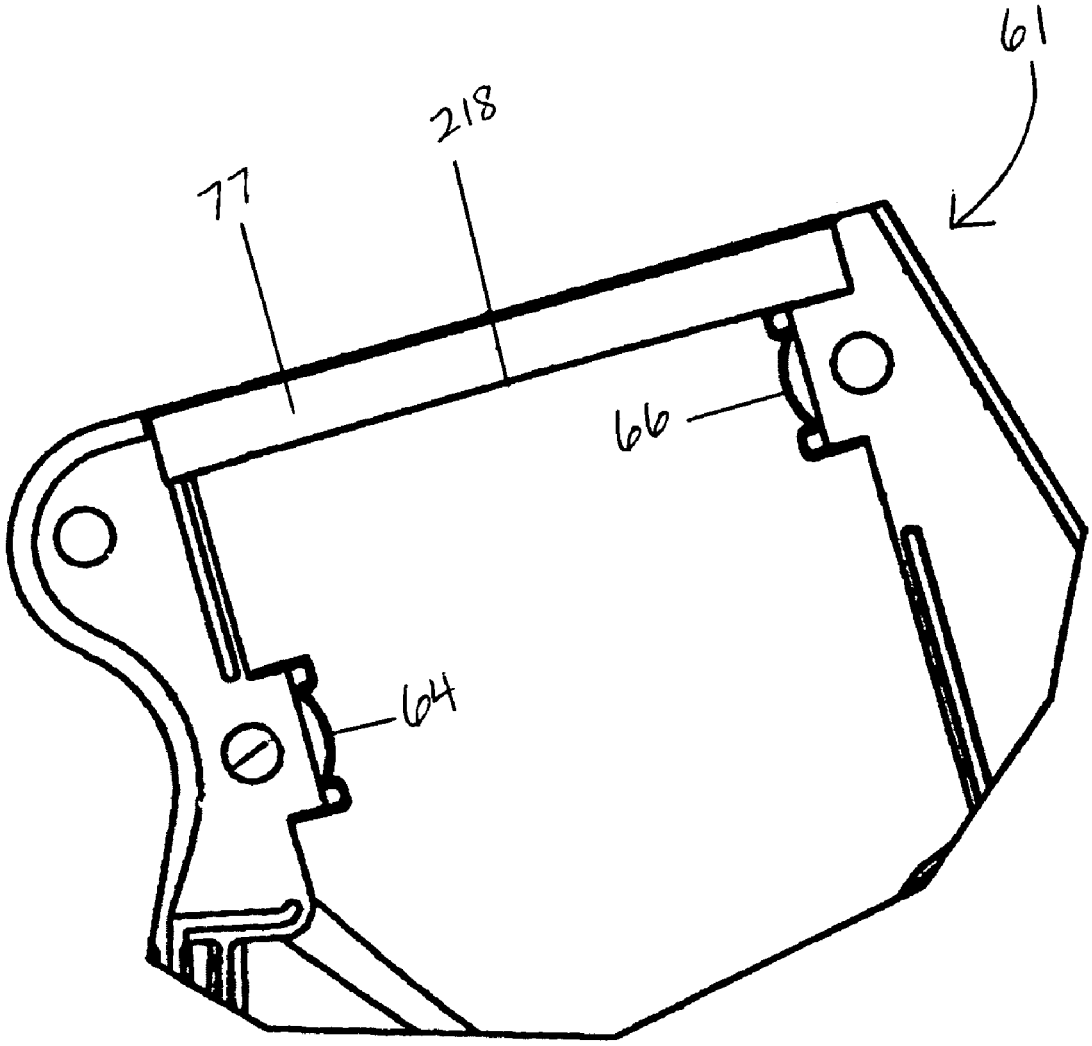
FIG. 96 is an enlarged view of detail LXXXX of FIG. 95.
Figure 97:
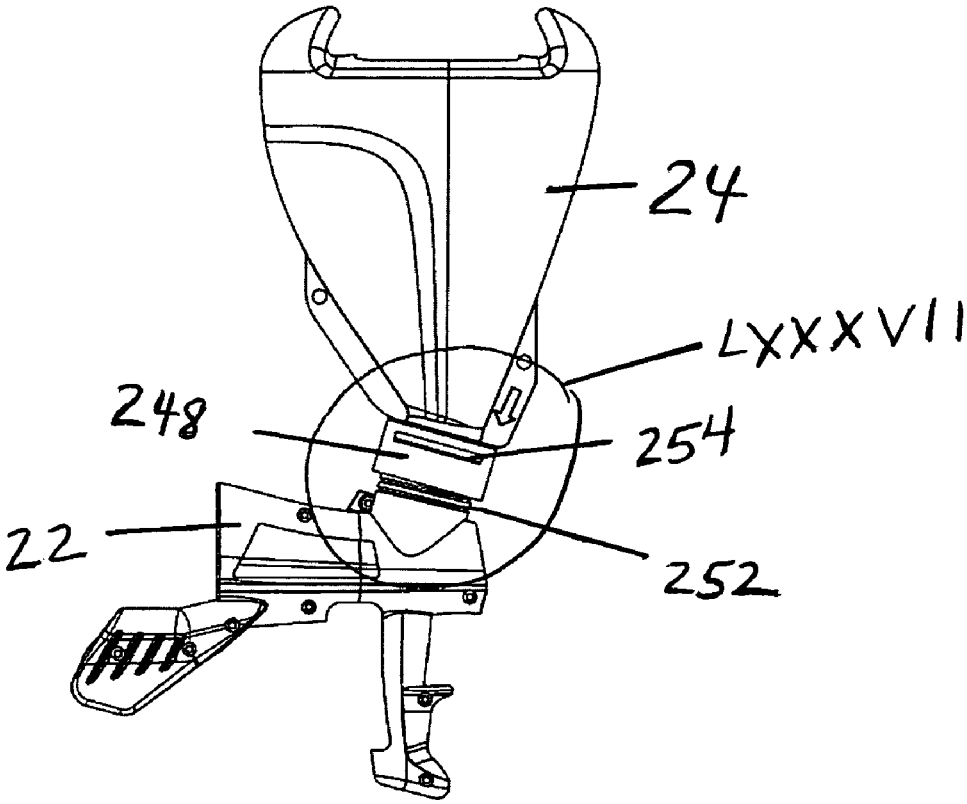
FIG. 97 is a side view of a third embodiment of a hand-held apparatus for spraying texture material invention.
Figure 98:
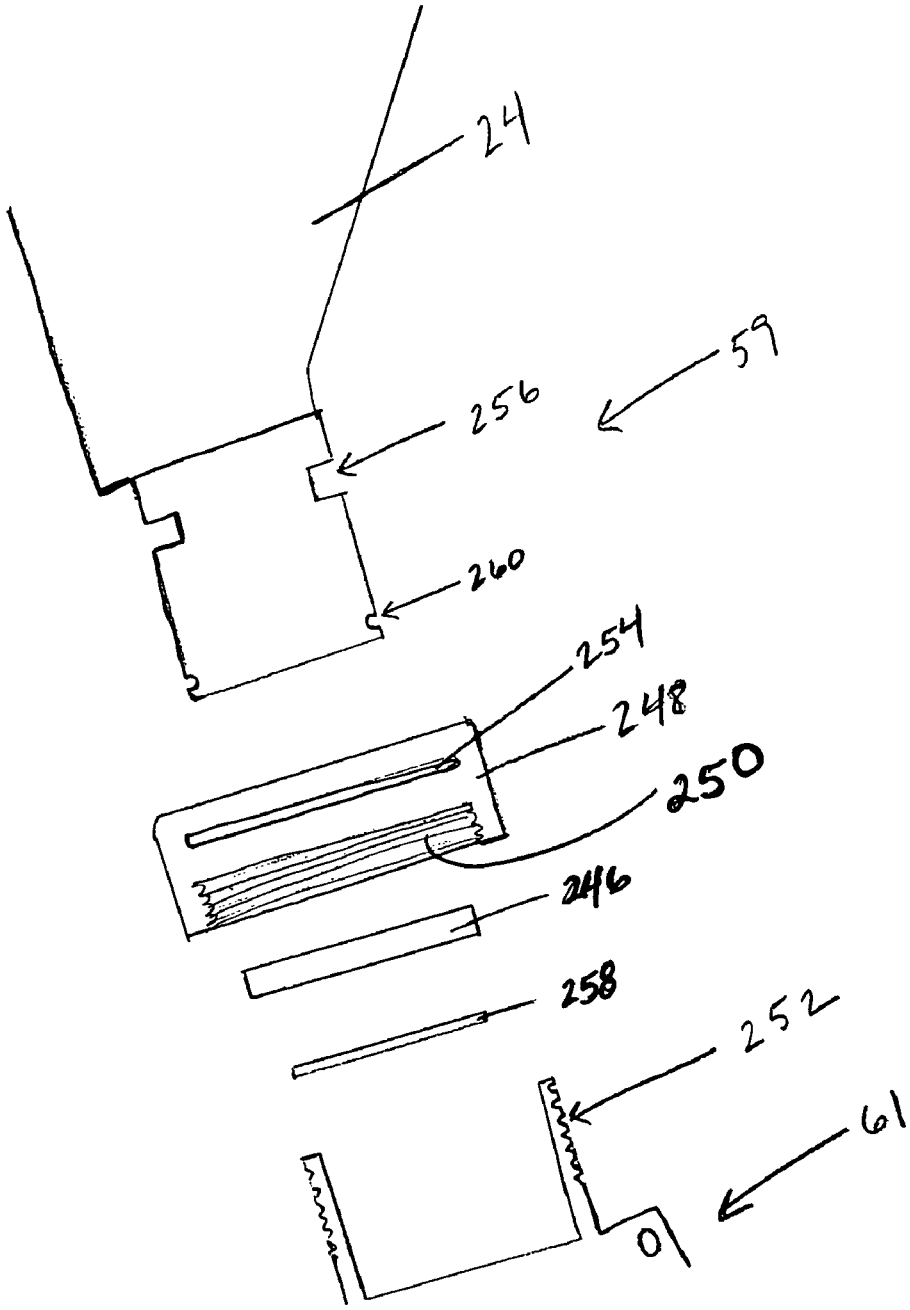
FIG. 98 is an enlarged and exploded view of detail LXXXVII of FIG. 97.
Figure 99:
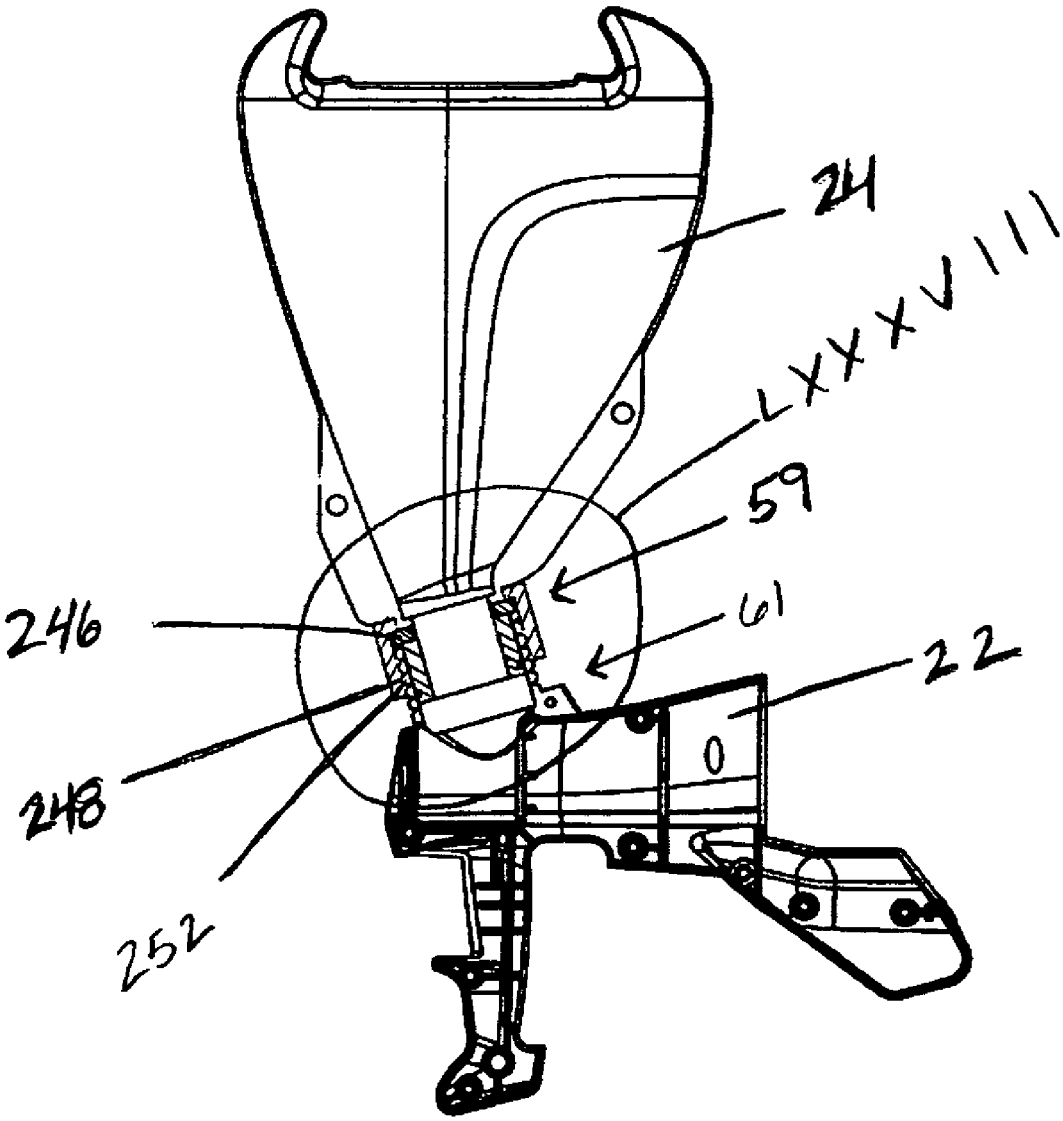
FIG. 99 is a side sectional view of the interior of the hand-held apparatus of FIG. 97.
Figure 100:
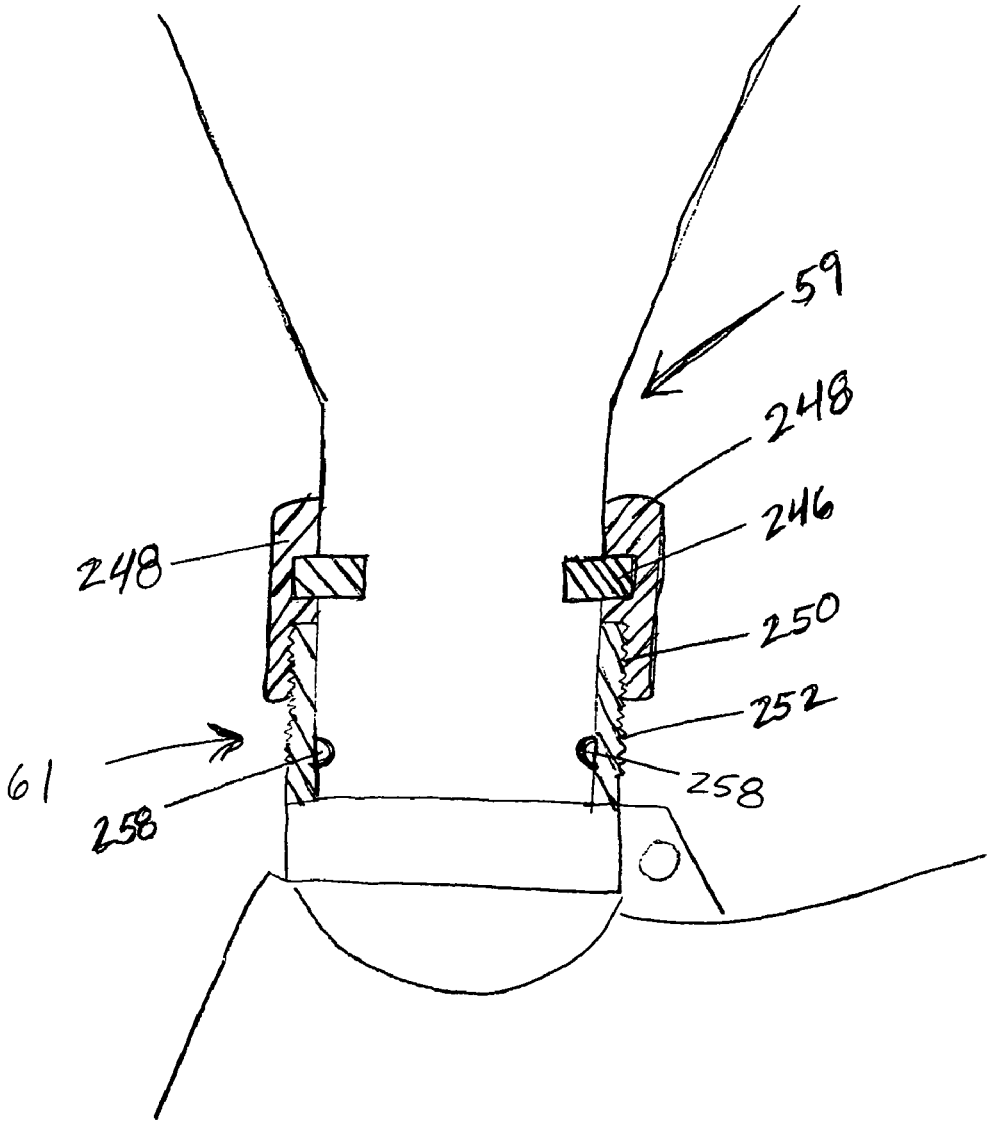
FIG. 100 is an enlarged view of detail LXXXVIII of FIG. 99.
Figure 101:
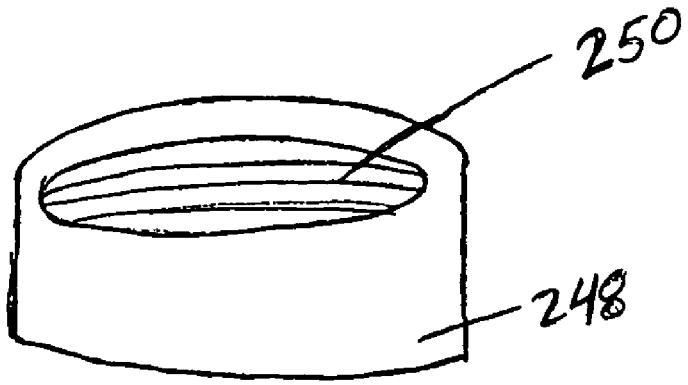
FIG. 101 is a perspective view of one embodiment of the knob useful in the practice of the present invention.
Figure 102:
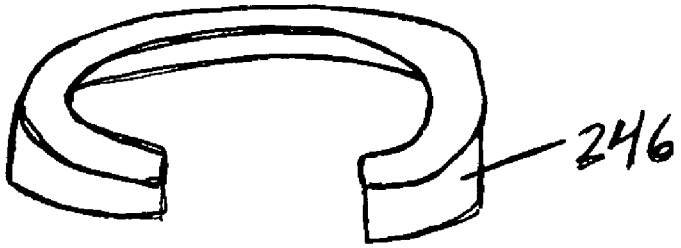
FIG. 102 is a perspective view of one embodiment of the C-clip useful in the practice of the present invention.
Figure 103:
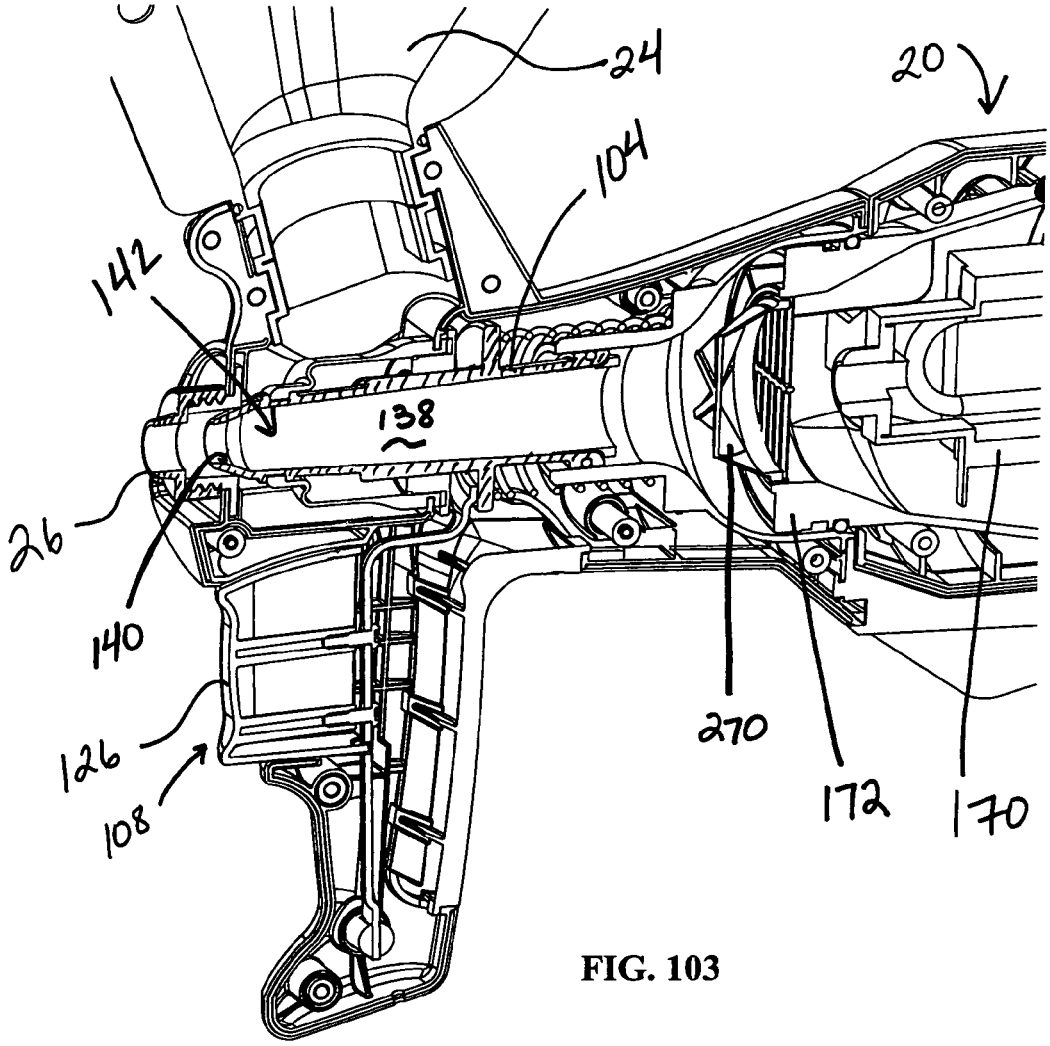
FIG. 103 is a sectional view of the interior of another embodiment of a hand-held apparatus for spraying texture material.
Figure 104:
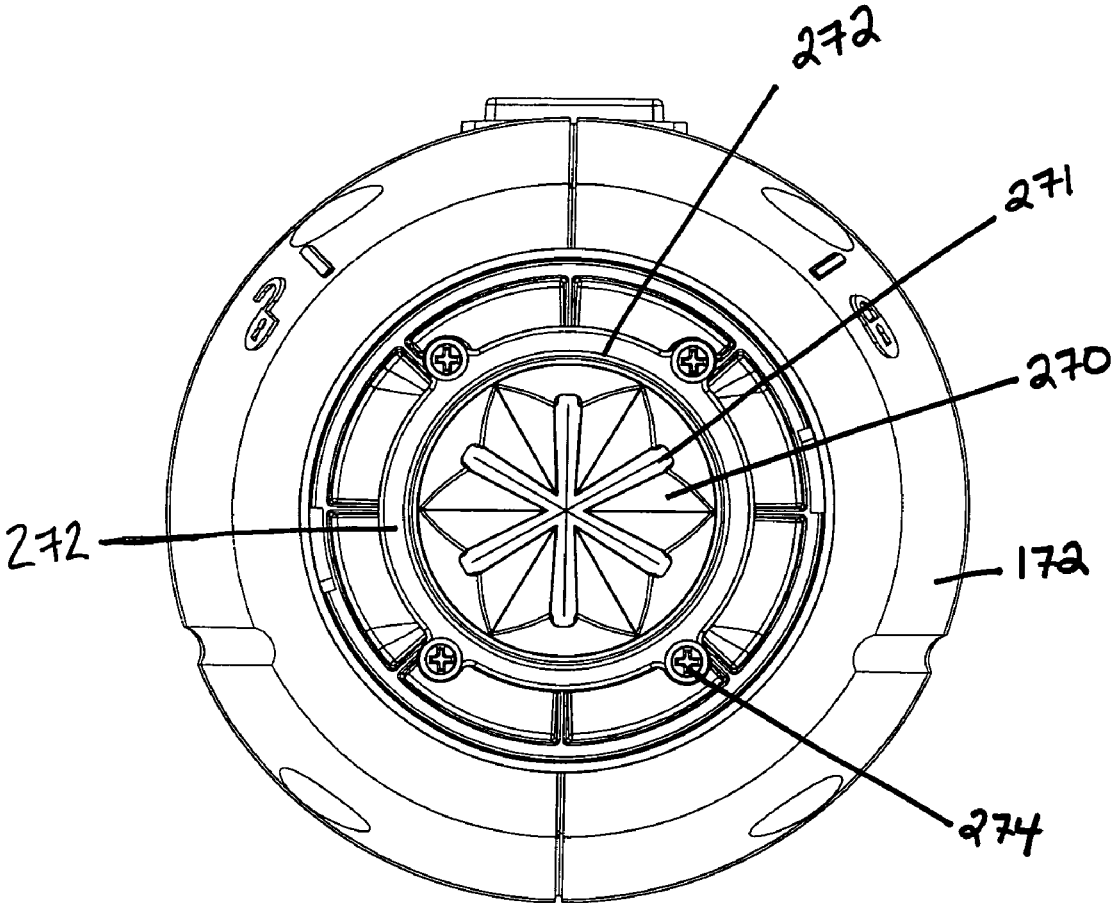
FIG. 104 is a rear-view of a turbine housing having a valve fastened to the turbine housing according to one aspect of the present invention
Figure 105:
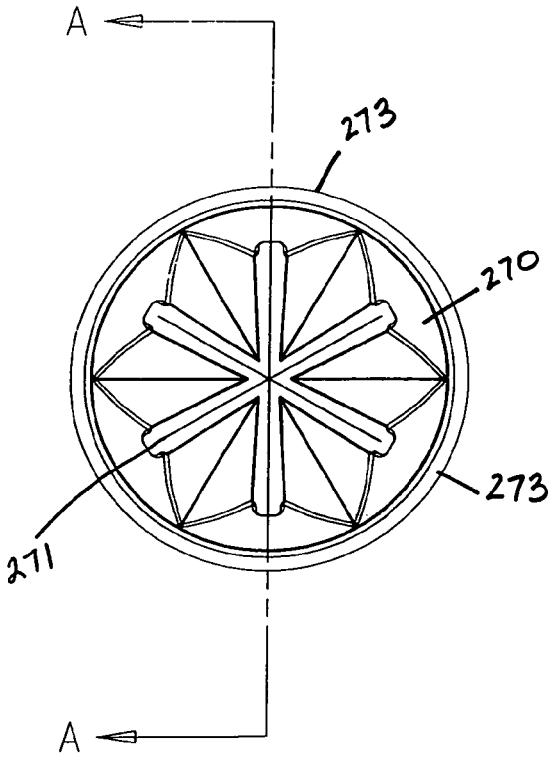
FIG. 105 is an end view of one embodiment of a valve useful in the practice of the present invention.
Figure 106:
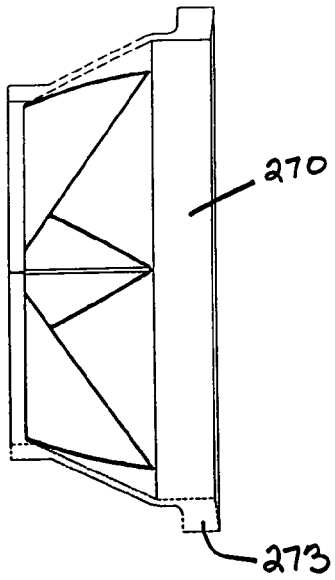
FIG. 106 is a section view taken along line A-A of FIG. 105.
Figure 107:
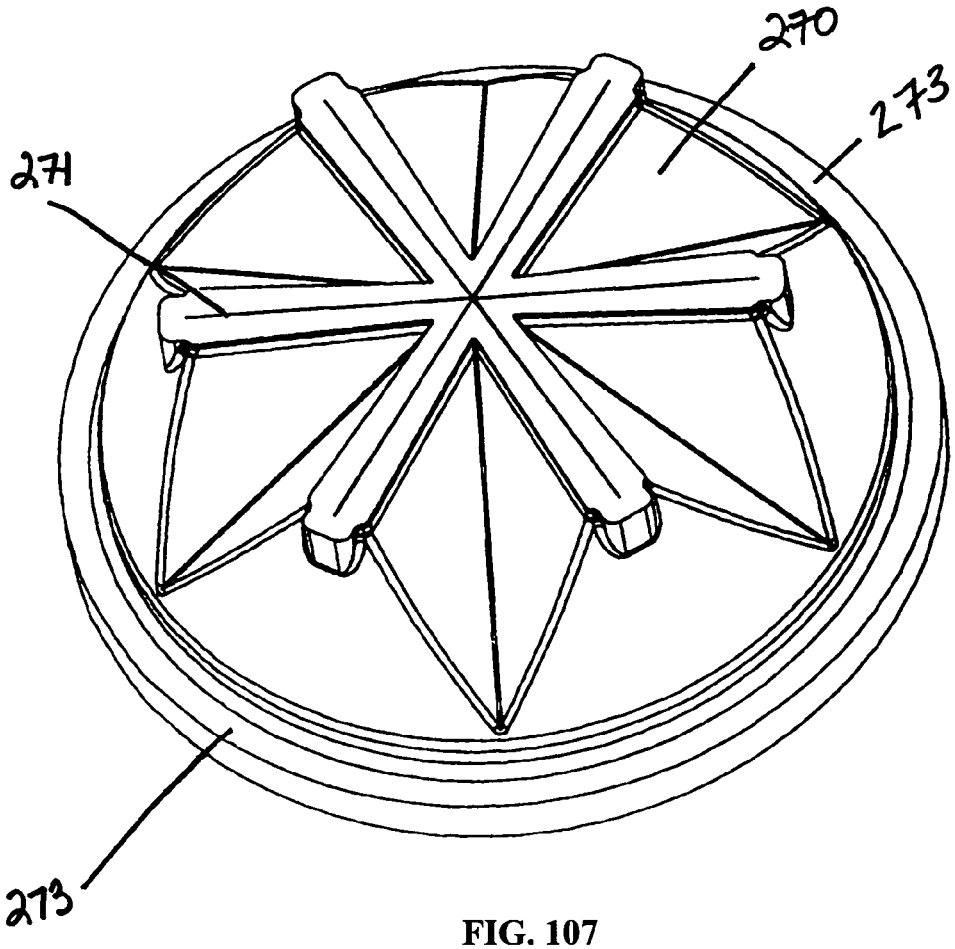
FIG. 107 is a perspective view of the valve of FIG. 105.
Figure 108:
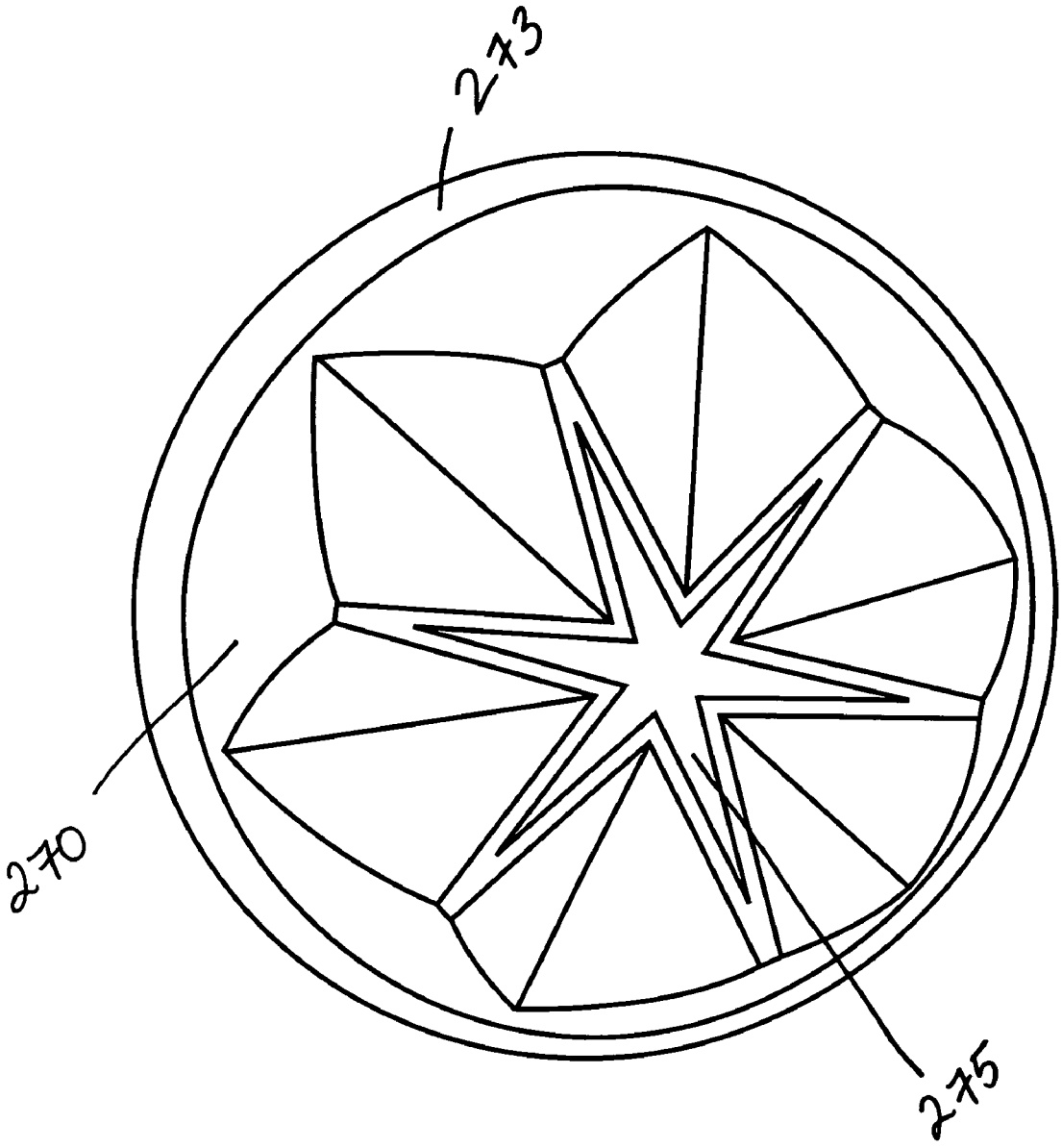
FIG. 108 is a perspective view of the valve of FIG. 105 in an open position.
Figure 109:
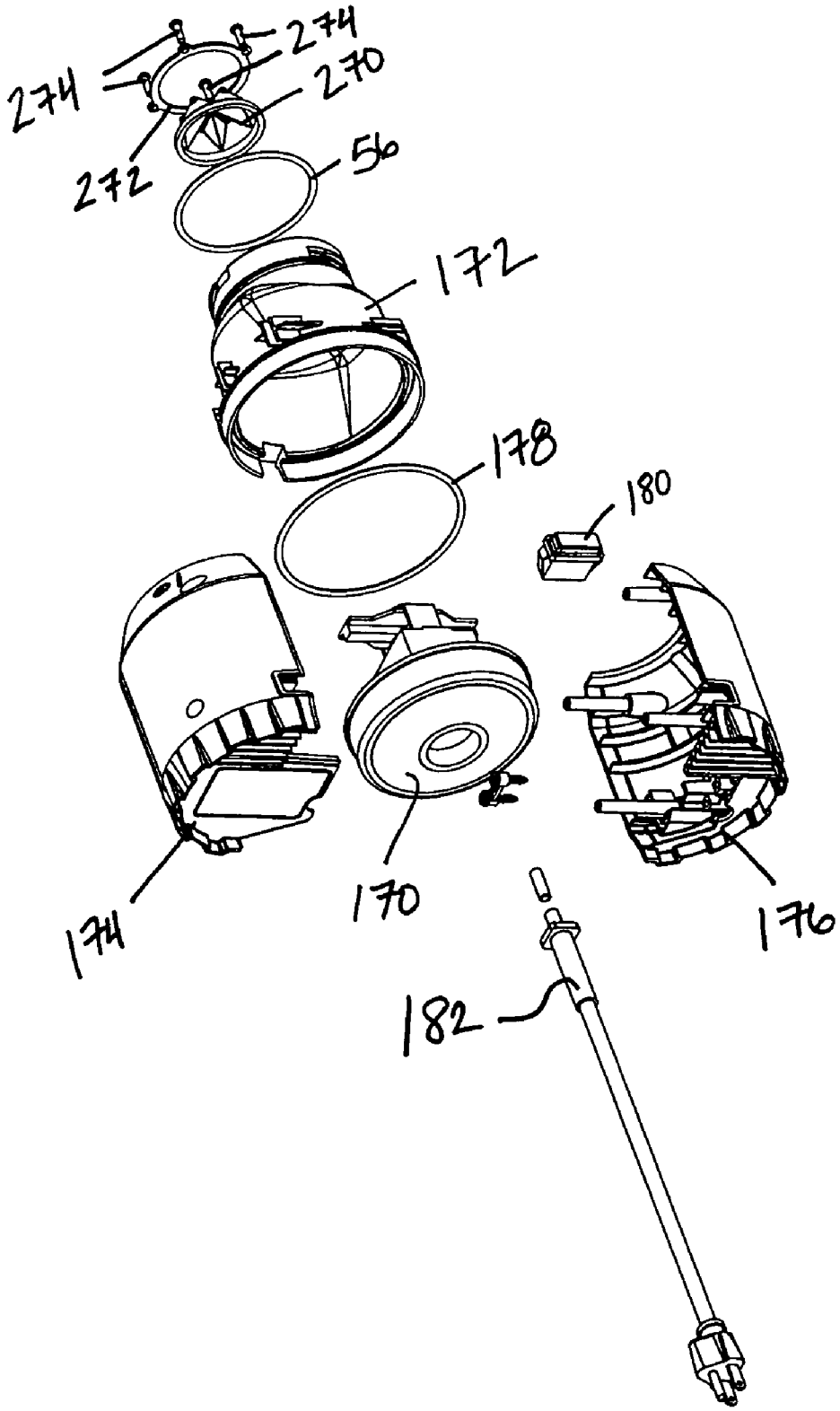
FIG. 109 is an exploded view of one embodiment of a turbine assembly useful in the practice of the present invention.
Figure 110:
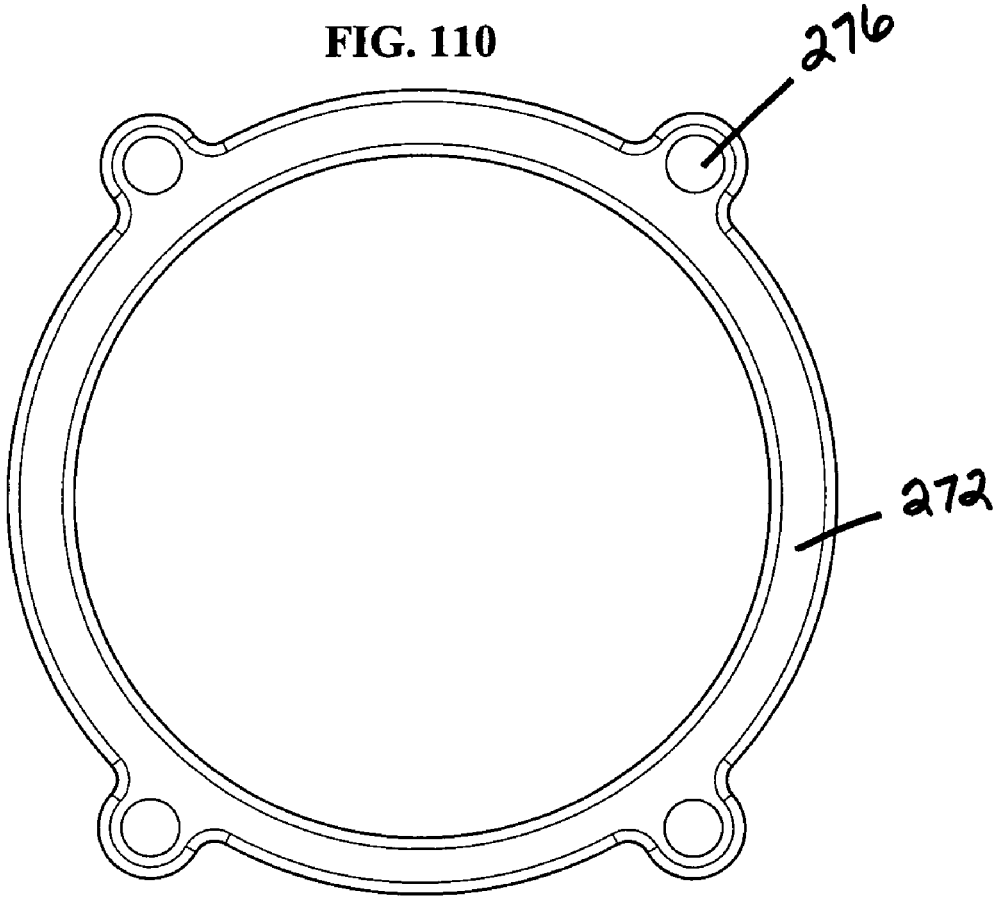
FIG. 110 is a front view of one embodiment of a ring-shaped holder useful in the practice of the present invention.
Figure 111:
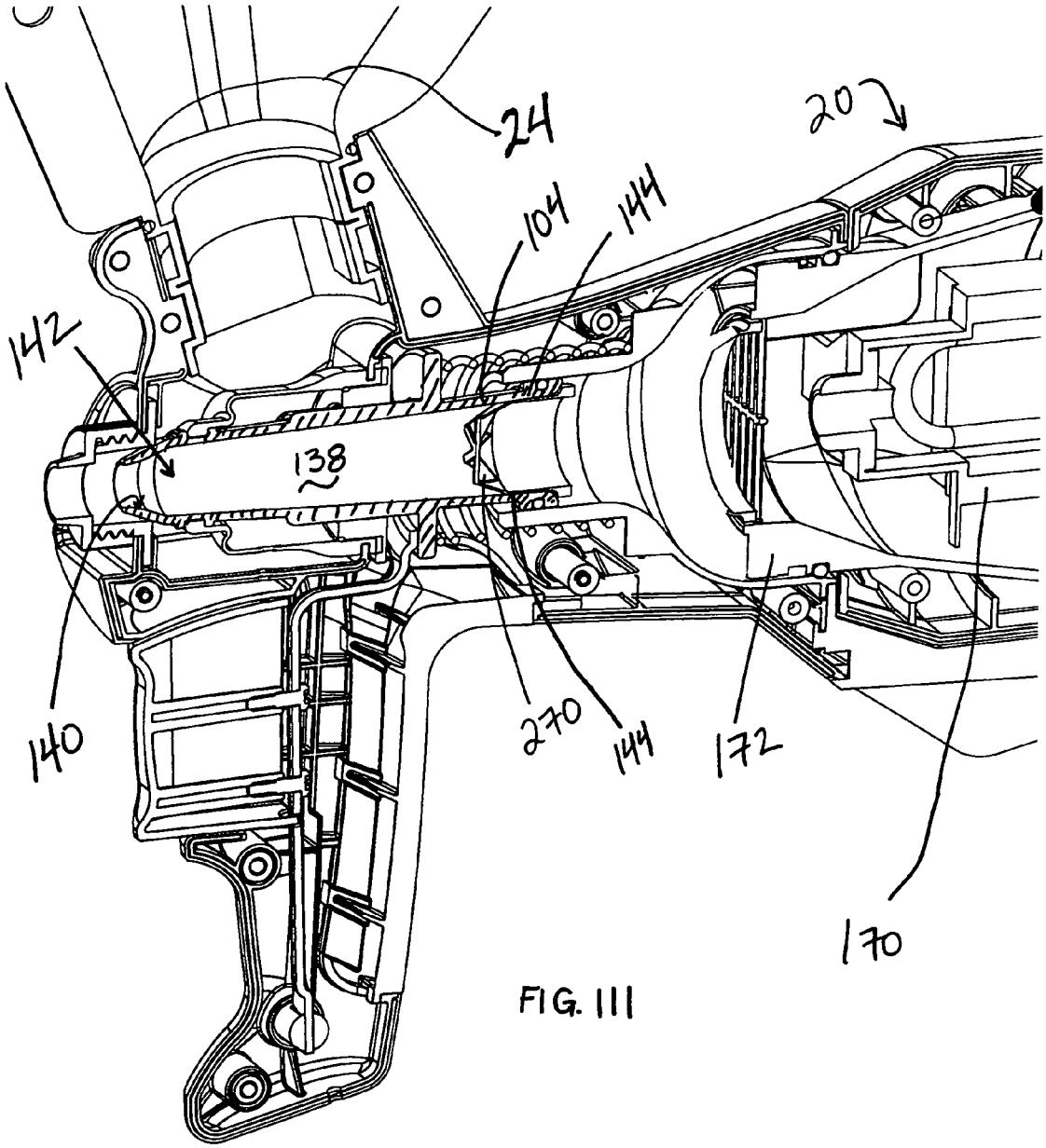
FIG. 111 is a sectional view of the interior of still another embodiment of a hand-held apparatus for spraying texture material.

Referring now to FIGS. 89 and 90, the internal operation of the texture sprayer is illustrated. Initially the hopper 24 and air source 20 are to be connected to the body 22 of the texture sprayer, and the hopper is filled with conventional texture material, which is a combined liquid and solid mixture or slurry. In FIG. 89, the trigger button 126 is released, and the texture material is prevented from being sprayed because the downstream end 142 of the plunger 104 is in contact with the nozzle plate 98, and the path from the hopper 24 to the nozzle 26 is closed. In this condition, the air source may be turned ON to direct air through the hollow through bore 138 of the plunger 104 to ready the sprayer 12 for spraying operation. Next, the trigger button 126 is depressed, moving from the dashed line position to the solid line position shown in FIG. 90. The trigger assembly 108 moves the plunger 104 to the position shown in FIG. 90, and the texture material (indicated by arrows 242) is permitted to flow in front of the downstream end 142 of the plunger where air (indicated by arrows 244) directs the texture material through the nozzle 26 and propels it to a surface to be coated with the texture material. As may be seen by comparison of FIGS. 89 and 90, the boot 100 covers and seals the exterior of plunger 104 (and the sliding connection including bushing 102 on the exterior of plunger 104) in both an ON and OFF (spraying and non-spraying) conditions of sprayer 12; and boot 100 may be seen to telescope back on itself in the ON or operating position shown in FIG. 90.

Thus it may be seen that in one aspect, the present invention may include the body 22 having a trigger 108 selectively operable to open and close a texture material passageway between the texture material hopper 24 and the texture delivery nozzle 26, and may further include the spring 106 urging the trigger to close the texture material passageway when the trigger button 126 is released by a user. The body 22 may have an air passageway (including bore 138) between the pressurized air source 20 and the texture delivery nozzle 26.

The present invention may also include the pistol grip 28 and the arm rest 38 for supporting the apparatus on the user's forearm 40 when the pistol grip is grasped by the user, and the arm rest may include the pair of legs 30, 32, such that the pistol grip and pair of legs provide the three point support 34 for the apparatus 12 when placed on a horizontal surface such as the floor 36.

In another aspect, the plunger 104 of the present invention may be in the form of a frusto-conical sleeve and axis 50 may be both a nozzle cone axis and the spray path axis 50. In this aspect, the plunger or sleeve is movable along the nozzle cone axis to open and close the texture material passageway. The frusto-conical sleeve may have the elastomeric boot 100 surrounding the sleeve or plunger 104 adjacent at least a portion of the texture material passageway.

In another aspect, referring to FIGS. 103-111, the present invention may include one or more valves to prevent water or debris from entering and damaging the air source 20 or turbine 170. As described above, when the trigger button 126 is depressed, the trigger assembly 108 moves the plunger 104 to a position that allows texture material to flow in front of the downstream end 142 of the plunger 104. Typically, the air source is turned ON to direct air through the hollow through bore 138 of the plunger 104 and direct the texture material through the nozzle 26. However, if the air source 20 is turned OFF so that no air is directed through the hollow through bore 138, the hopper 24 contains texture material, and the trigger button 126 is depressed, texture material is allowed to flow in front of the plunger 104 and may flow into the bore 138 and travel back to the air source 20 or turbine 170. To prevent texture material from flowing to the turbine 170, a valve 270 that allows pressurized air to flow downstream but does not allow texture material to flow upstream may be placed downstream from the air source 20 and upstream from the texture material passageway.

The valve 270 opens to form a valve opening 275 when pressurized air is directed from the pressurized air source 20 through the valve 270, but closes when there is no pressurized air directed through the valve 270. As illustrated, the valve 270 may be an accordion-shaped valve with a star-shaped slit 271 which, when opened, defines a valve opening 275. Any suitable material may be used to form the valve 270 such as, for example a nitrile rubber, a flouroelastomer, natural rubber, other polymers with a Shore A hardness rating, or thermoplastic elastomers, such as those available from Santoprene L.P. (Akron, Ohio). In one embodiment, the an air pressure of less than 0.1 psi may be needed to open the valve 270.

In one embodiment, the valve 270 may be fastened to the turbine housing 172 downstream from the air source 20. The valve 270 may be fastened to the turbine housing 172 in any suitable manner. For example, the valve 270 may be placed in a groove in the turbine housing 172. It may also be fastened to the turbine housing 172 by a suitable adhesive. In one embodiment, the valve 270 is fastened to the turbine housing with a ring-shaped holder 272. A lip 273 on the valve 270 may be held between the turbine housing 172 and the ring-shaped holder 272 to keep the valve 270 from dislodging. In one embodiment, the ring-shaped holder 272 includes fastener holders 276 through which fasteners 274 may be placed to hold the ring-shaped holder 272 to the turbine housing 172. The fasteners 274 may include screws, rivets or any suitable fastening part.

In another embodiment, the valve 270 is located between the conical tapered outlet 140 of the plunger 104 and the turbine 170. For example, in the illustrated embodiment, the valve 270 is located in the bore 138 of the plunger 104. The valve 270 may be fastened to the sidewall 144 of the bore 138 by any suitable method such an adhesive or a groove in the bore 138. In still another embodiment, the present invention may include more than one valve. For example, one valve 270 may be fastened to the turbine housing 172 while another valve 270 may be fastened to the sidewall 144 of the bore 138.

In another aspect, the present invention may be characterized as a method of cleaning a texture sprayer apparatus including the steps of manually disconnecting the electrically powered air source subassembly 20 from a wetted parts subassembly of the texture sprayer without the use of tools; cleaning the wetted parts subassembly; and manually reassembling the electrically powered air source subassembly to the wetted parts subassembly without the use of tools. The method may further include manually disconnecting the hopper 24 from the remainder of the wetted parts subassembly without the use of tools. The method may also include manually reconnecting the hopper 24 to the remainder of the wetted parts subassembly without the use of tools after cleaning. It being understood that the "wetted parts" are those which may come into contact with the texture material during use.

This invention is not to be taken as limited to all of the details thereof as modifications and variations thereof may be made without departing from the spirit or scope of the invention.

The invention claimed is:

1. A self-contained hand-held apparatus for spraying texture material comprising:

a body;

a texture delivery nozzle on an end of the body;

a texture material hopper extending above the body for holding and feeding texture material into the apparatus;

a pistol grip extending below the body;

an arm rest extending below the body at a location spaced from the pistol grip, the arm rest supporting the apparatus on a user's arm when the pistol grip is grasped by the user, the pistol grip and arm rest in combination forming a support that supports the apparatus with the texture material hopper upright when the apparatus is placed on a horizontal surface;

an on-board pressurized air source including a turbine housing releasably mounted on the body above the arm rest and a turbine disposed within the turbine housing; and a material connection structure for movably connecting the texture material hopper to the apparatus to enable the texture material hopper to be moved with respect to the apparatus and enable the texture material hopper to feed texture material as the apparatus is moved from a horizontal spray position to an upwardly, above horizontal, spray position.

2. The apparatus of claim 1 wherein the texture delivery nozzle includes threads threadably engaging the apparatus.

3. The apparatus of claim 1 further comprising an air source connection structure between the on-board pressurized air source and the body wherein the air source connection structure is operable to connect and disconnect the on-board pressurized air source to and from the body without the use of tools.

4. The apparatus of claim 3 wherein the air source connection structure further comprises a bayonet interlock between the on-board pressurized air source and the body.

5. The apparatus of claim 1 wherein the material connection structure connects the texture material hopper and the body and wherein the material connection structure is operable to connect and disconnect the texture material hopper to and from the body without the use of tools.

6. The apparatus of claim 5 wherein the hopper further comprises a generally cone-shaped structure with a top opening and having a conic axis and the material connection structure further comprises a rotatable connector having an axis of rotation to allow positioning of the conic axis of the cone-shaped structure at a location in a cone-shaped path such that the hopper may be rotated to:

i. a first position wherein the conic axis is directed generally vertically with the texture delivery nozzle directed in a horizontal direction, and ii. a second position wherein the conic axis is directed generally vertically when the texture delivery nozzle is directed upward above the horizontal direction.

7. The apparatus of claim 6 wherein the material connection structure further comprises a knob that engages with the texture material hopper and the body.

8. The apparatus of claim 1 wherein the body further comprises a trigger selectively operable to open and close a texture material passageway between the texture material hopper and the texture delivery nozzle.

9. The apparatus of claim 8 further comprising a spring urging the trigger to close the texture material passageway.

10. The apparatus of claim 9 wherein the body further comprises an air passageway between the on-board pressurized air source and the texture delivery nozzle.

11. The apparatus of claim 10 further comprising a valve to prevent texture material from entering the turbine located in the air passageway.

12. The apparatus of claim 8 further comprising a valve to prevent texture material from entering the air source, wherein the valve is located downstream from the air source and upstream from the texture material passageway.

13. The apparatus of claim 12 wherein the valve is fastened to the turbine housing.

14. The apparatus of claim 13 wherein the valve is fastened to the turbine housing with a ring-shaped holder.

15. The apparatus of claim 1 wherein the arm rest further comprises a pair of legs.

16. The apparatus of claim 15 wherein the pistol grip and pair of legs provide a three point support for the apparatus when placed on a horizontal surface.

17. The apparatus of claim 1 further including a frusto-conical sleeve having a nozzle cone axis defining a spray path axis and wherein the sleeve is movable along the nozzle cone axis to open and close the texture material passageway.

18. The apparatus of claim 17 wherein the frusto-conical sleeve has an elastomeric boot surrounding the sleeve adjacent at least a portion of the texture material passageway.

* * * * *